US011296435B2

(12) United States Patent
Watkins et al.

(10) Patent No.: US 11,296,435 B2
(45) **Date of Patent: *Apr. 5, 2022**

(54) COAXIAL CABLE CONNECTORS HAVING PORT GROUNDING

(71) Applicant: PPC BROADBAND, INC., East Syracuse, NY (US)

(72) Inventors: Harold J. Watkins, Chittenango, NY (US); Noah P. Montena, Syracuse, NY (US); Steven Stankovski, Clay, NY (US); Jeremy Amidon, Raleigh, NC (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/930,245

(22) Filed: May 12, 2020

(65) Prior Publication Data

US 2020/0274264 A1 Aug. 27, 2020

Related U.S. Application Data

(63) Continuation-in-part of application No. 16/740,162, filed on Jan. 10, 2020, now Pat. No. 11,024,989, (Continued)

(51) Int. Cl.
*H01R 9/05* (2006.01)
*H01R 13/52* (2006.01)
(Continued)

(52) U.S. Cl.
CPC ..... *H01R 9/0521* (2013.01); *H01R 13/521* (2013.01); *H01R 13/622* (2013.01); *H01R 24/38* (2013.01)

(58) Field of Classification Search
CPC .. H01R 9/0521; H01R 13/521; H01R 13/622; H01R 9/0527; H01R 2103/00;
(Continued)

(56) References Cited

U.S. PATENT DOCUMENTS 4,377,320 A * 3/1983 Lathrop ..... H01R 24/40 439/585
5,181,861 A 1/1993 Gaver, Jr. et al.
(Continued)

FOREIGN PATENT DOCUMENTS

CN 1853319 A 10/2006
CN 101064386 A 10/2007
(Continued)

OTHER PUBLICATIONS

International Preliminary Report on Patentability dated Feb. 19, 2019 in corresponding International Application No. PCT/US2017/047871, 8 pages.
(Continued)

*Primary Examiner* — Travis S Chambers
(74) *Attorney, Agent, or Firm* — MH2 Technology Law Group LLP

(57) ABSTRACT

A nut assembly for a coaxial cable connector includes a nut configured to engage an interface port and a cap encircling the nut. The nut includes an internal threaded portion configured to engage external threads of the interface port and at least one resilient finger extending in an axial direction from the internal threaded portion toward a forward end of the nut. The forward end includes a tooth extending radially inward, the tooth is configured to contact a surface of a thread of the external threads when the nut is coupled to the interface port, and the tooth is configured to provide ground continuity between the nut and the interface port before the internal threaded portion of the nut is coupled
(Continued)

with the external threads. The internal threaded portion and the external threads are configured to provide a retention force between the nut and the interface port.

20 Claims, 40 Drawing Sheets

Related U.S. Application Data which is a continuation-in-part of application No. 16/395,227, filed on Apr. 25, 2019, now Pat. No. 10,985,514, application No. 15/930,245, which is a continuation-in-part of application No. 16/382,171, filed on Apr. 11, 2019, now Pat. No. 10,651,574, which is a continuation-in-part of application No. 16/355,701, filed on Mar. 15, 2019, now Pat. No. 10,910,751, said application No. 16/395,227 is a continuation-in-part of application No. 15/682,538, filed on Aug. 21, 2017, now Pat. No. 10,622,749.

(60) Provisional application No. 62/790,496, filed on Jan. 10, 2019, provisional application No. 62/662,535, filed on Apr. 25, 2018, provisional application No. 62/656,103, filed on Apr. 11, 2018, provisional application No. 62/643,192, filed on Mar. 15, 2018, provisional application No. 62/410,370, filed on Oct. 19, 2016, provisional application No. 62/407,483, filed on Oct. 12, 2016, provisional application No. 62/377,476, filed on Aug. 19, 2016.

(51) Int. Cl.
*H01R 13/622* (2006.01)
*H01R 24/38* (2011.01)

(58) Field of Classification Search
CPC ..... H01R 9/05; H01R 9/0518; H01R 9/0524; H01R 13/502; H01R 13/6583; H01R 13/6598; H01R 13/6592; H01R 24/38; H01R 24/42
See application file for complete search history.

(56) References Cited

U.S. PATENT DOCUMENTS

| | | | | |
|---|---|---|---|---|
| 5,316,494 | A * | 5/1994 | Flanagan | H01R 13/627 439/352 |
| 5,362,251 | A | 11/1994 | Bielak | |
| 5,637,010 | A | 6/1997 | Jost et al. | |
| 6,267,612 | B1 | 7/2001 | Arcykiewicz et al. | |
| 6,769,926 | B1 | 8/2004 | Montena | |
| 7,189,091 | B1 * | 3/2007 | Montena | H01R 9/0521 439/322 |
| 7,396,249 | B2 | 7/2008 | Kauffman | |
| 7,402,063 | B2 | 7/2008 | Montena | |
| 7,938,680 | B1 | 5/2011 | Hsieh | |
| 7,972,158 | B2 | 7/2011 | Wild et al. | |
| 8,070,504 | B2 | 12/2011 | Amidon et al. | |
| 8,192,237 | B2 | 6/2012 | Purdy et al. | |
| 8,323,053 | B2 | 12/2012 | Montena | |
| 8,337,228 | B1 | 12/2012 | Montena | |
| 8,388,377 | B2 | 3/2013 | Zraik | |
| 8,506,325 | B2 | 8/2013 | Malloy et al. | |
| 8,517,764 | B2 | 8/2013 | Wei et al. | |
| 9,071,019 | B2 | 6/2015 | Burris et al. | |
| 9,553,375 | B2 | 1/2017 | Edmonds et al. | |
| 10,411,397 | B2 | 9/2019 | Haberek et al. | |
| 10,622,749 | B2 * | 4/2020 | Watkins | H01R 13/622 |
| 10,651,574 | B2 | 5/2020 | Maroney et al. | |
| 10,693,256 | B2 | 6/2020 | Haberek | |
| 2005/0164552 | A1 | 7/2005 | Wlos et al. | |
| 2006/0205272 | A1 | 9/2006 | Rodrigues | |
| 2007/0224880 | A1 | 9/2007 | Wlos et al. | |
| 2009/0191752 | A1 | 7/2009 | Montena | |
| 2009/0264003 | A1 | 10/2009 | Hertzler et al. | |
| 2010/0177380 | A1 | 7/2010 | Nagahama et al. | |
| 2010/0216355 | A1 | 8/2010 | Copper et al. | |
| 2011/0230089 | A1 | 9/2011 | Amidon et al. | |
| 2011/0250789 | A1 | 10/2011 | Burris et al. | |
| 2012/0094532 | A1 | 4/2012 | Montena | |
| 2012/0171894 | A1 | 7/2012 | Malloy et al. | |
| 2012/0252268 | A1 | 10/2012 | Zraik | |
| 2013/0065418 | A1 | 3/2013 | Evans | |
| 2013/0149896 | A1 | 6/2013 | Holland et al. | |
| 2013/0323967 | A1 | 12/2013 | Wood | |
| 2014/0342594 | A1 | 11/2014 | Montena | |
| 2015/0111429 | A1 | 4/2015 | Hoyak et al. | |
| 2018/0054017 | A1 | 2/2018 | Watkins et al. | |
| 2018/0358718 | A1 | 12/2018 | Youtsey | |
| 2019/0252836 | A1 | 8/2019 | Watkins et al. | |
| 2019/0288426 | A1 | 9/2019 | Maroney | |
| 2019/0334296 | A1 | 10/2019 | Watkins et al. | |
| 2019/0341705 | A1 | 11/2019 | Watkins | |
| 2019/0348776 | A1 | 11/2019 | Youtsey | |
| 2020/0227843 | A1 | 7/2020 | Watkins et al. | |

FOREIGN PATENT DOCUMENTS

| | | | |
|---|---|---|---|
| CN | 203456687 | U | 2/2014 |
| EP | 0549090 | A2 | 6/1993 |
| WO | 2014144447 | A1 | 9/2014 |

OTHER PUBLICATIONS

International Preliminary Report on Patentability dated Sep. 15, 2020 in corresponding International Application No. PCT/US2019/022641, 8 pages.
Extended European Search Report dated Feb. 27, 2020 in corresponding European Patent Application No. 17842276.2, 8 pages.
Second Office Action dated Dec. 8, 2020 in Chinese Patent Application No. 201780061076.7, translated, 9 pages.
Oct. 27, 2017 International Search Report and Written Opinion issued in PCT/US2017/047871.
Technetix catalog entitled "Class A ++ Fly-Leads—Reduce RM Interference within home installations (LTE/4G and Beyond)"; published Jun. 2016; version 1.0; 9 pages.
U.S. Appl. No. 16/911,389, filed Jun. 24, 2020 (120 pages).
Jun. 11, 2019 International Search Report and Written Opinion issued in International Application No. PCT/US19/22641.
Office Action issued in Chinese Patent Application No. 201780061076.7 dated Mar. 23, 2020 (15 pages).
European Office Action dated Jun. 14, 2021 in corresponding European Application 17842276.2, 8 pages.

* cited by examiner

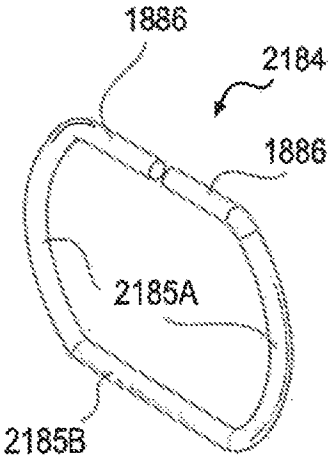
FIG. 21B
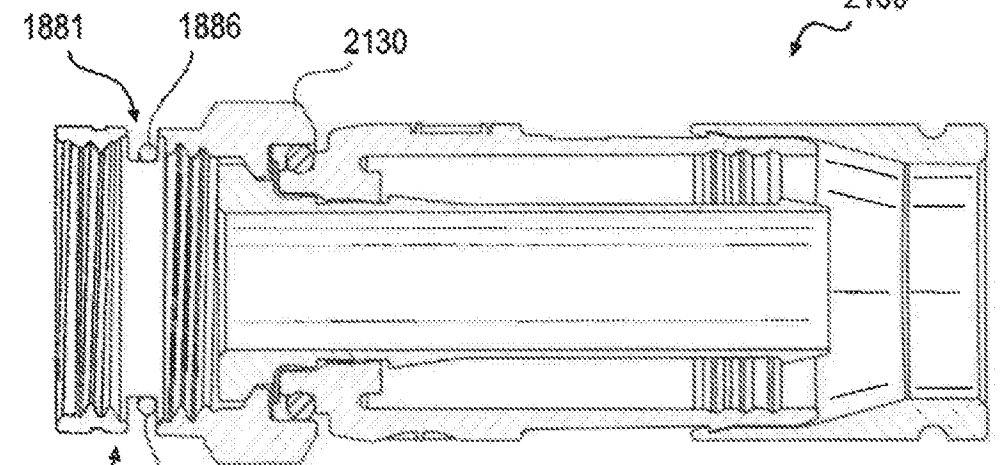
FIG. 21A
FIG. 22B
FIG. 22A

COAXIAL CABLE CONNECTORS HAVING PORT GROUNDING

CROSS-REFERENCE TO RELATED APPLICATIONS

This is a continuation-in-part of U.S. application Ser. No. 16/740,162, filed Jan. 10, 2020, now U.S. Pat. No. 11,024,989, which is a continuation-in-part of U.S. application Ser. No. 16/395,227, filed Apr. 25, 2019, now. U.S. Pat. No. 10,985,514, which is a continuation-in-part of U.S. application Ser. No. 15/682,538, filed Aug. 21, 2017, now U.S. Pat. No. 10,622,749, which claims the benefit of U.S. Provisional Application No. 62/377,476, filed Aug. 19, 2016; U.S. Provisional Application No. 62/407,483, filed Oct. 12, 2016; and U.S. Provisional Application No. 62/410,370, filed Oct. 19, 2016. In addition, U.S. application Ser. No. 16/395,227 claims the benefit of U.S. Provisional Application No. 62/662,535, filed Apr. 25, 2018; and U.S. application Ser. No. 16/740,162 claims the benefit of U.S. Provisional Application No. 62/790,496, filed Jan. 10, 2019. The disclosures of the prior applications are hereby incorporated by reference herein in their entirety.

This is also a continuation-in-part of U.S. application Ser. No. 16/382,171, filed on Apr. 11, 2019, U.S. Pat. No. 10,651,574, which is a continuation-in-part of U.S. application Ser. No. 16/355,701, filed on Mar. 15, 2019, now U.S. Pat. No. 10,910,751, which claims the benefit of U.S. Provisional Application No. 62/643,192, filed Mar. 15, 2018, the disclosures of which are incorporated herein by reference in their entirety. In addition, U.S. application Ser. No. 16/382,171 claims the benefit of U.S. Provisional Application No. 62/656,103, filed Apr. 11, 2018. The disclosures of the prior applications are hereby incorporated by reference herein in their entirety.

In addition, the present application is related to the subject matter of U.S. Design patent Application No. 29/580,627, filed Oct. 11, 2016, now U.S. Design Patent No. D810,024; U.S. Design patent application Ser. No. 29/580,628, filed Oct. 11, 2016, now U.S. Design Pat. No. D810,684; U.S. Design patent application Ser. No. 29/587,518, filed Dec. 13, 2016, now U.S. Design Pat. No. D810,685; and U.S. Design patent application Ser. No. 29/587,519, filed Dec. 13, 2016, now U.S. Design Pat. No. D810,025, the disclosures of which are incorporated herein by reference in their entirety.

BACKGROUND

Broadband communications have become an increasingly prevalent form of electromagnetic information exchange and coaxial cables are common conduits for transmission of broadband communications. Coaxial cables are typically designed so that an electromagnetic field carrying communications signals exists only in the space between inner and outer coaxial conductors of the cables. This allows coaxial cable runs to be installed next to metal objects without the power losses that occur in other transmission lines, and provides protection of the communications signals from external electromagnetic interference.

Connectors for coaxial cables are typically connected onto complementary interface ports to electrically integrate coaxial cables to various electronic devices and cable communication equipment. Connection is often made through rotatable operation of an internally threaded nut of the connector about a corresponding externally threaded interface port. Fully tightening the threaded connection of the coaxial cable connector to the interface port helps to ensure a ground connection between the connector and the corresponding interface port.

However, often connectors are not fully and/or properly tightened or otherwise installed to the interface port and proper electrical mating of the connector with the interface port does not occur. Moreover, typical component elements and structures of common connectors may permit loss of ground and discontinuity of the electromagnetic shielding that is intended to be extended from the cable, through the connector, and to the corresponding coaxial cable interface port. In particular, in order to allow the threaded nut of a connector to rotate relative to the threaded interface port, sufficient clearance must exist between the matching male and female threads. When the connector is left loose on the interface port (i.e., not fully and/or properly tightened), gaps may still exist between surfaces of the mating male and female threads, thus creating a break in the electrical connection of ground.

Lack of continuous port grounding in a conventional threaded connector, for example, when the conventional threaded connector is loosely coupled with an interface port (i.e., when in a loose state relative to the interface port), introduces noise and ultimately performance degradation in conventional RF systems. Furthermore, lack of ground contact prior to the center conductor contacting the interface port may also introduce an undesirable "burst" of noise upon insertion of the center conductor into the interface port. This noise may be sent back to the headend, causing packet errors.

In some conventional connectors having "finger" connectors, the formed finger connectors traditionally will lose their shape or "spring back" with repeated use or when stressed beyond a point of deformation. When the finger connectors lose their shape, the connector may not provide a tight coupling with an interface port.

Accordingly, there is a need to overcome, or otherwise lessen the effects of, the disadvantages and shortcomings described above. Hence a need exists for a coaxial cable connector having improved ground continuity between the coaxial cable, the connector, and the coaxial cable connector interface port.

Some embodiments of the invention relate generally to data transmission system components, and more particularly to nut seal assemblies for use with a connector of a coaxial cable system component for sealing a threaded port connection, and to a coaxial cable system component incorporating the seal assemblies.

Community antenna television (CATV) systems and many broadband data transmission systems rely on a network of coaxial cables to carry a wide range of radio frequency (RF) transmissions with low amounts of loss and distortion. A covering of plastic or rubber adequately seals an uncut length of coaxial cable from environmental elements such as water, salt, oil, dirt, etc. However, the cable must attach to other cables, components and/or to equipment (e.g., taps, filters, splitters and terminators) generally having threaded ports (hereinafter, "ports") for distributing or otherwise utilizing the signals carried by the coaxial cable. A service technician or other operator must frequently cut and prepare the end of a length of coaxial cable, attach the cable to a coaxial cable connector, or a connector incorporated in a coaxial cable system component, and install the connector on a threaded port. This is typically done in the field. Environmentally exposed (usually threaded) parts of the components and ports are susceptible to corrosion and contamination from environmental elements and other sources, as the connections are typically located outdoors, at taps on telephone poles, on customer premises, or in underground vaults. These environmental elements eventually corrode the electrical connections located in the connector and between the connector and mating components. The resulting corrosion reduces the efficiency of the affected connection, which reduces the signal quality of the RF transmission through the connector. Corrosion in the immediate vicinity of the connector-port connection is often the source of service attention, resulting in high maintenance costs.

Numerous methods and devices have been used to improve the moisture and corrosion resistance of connectors and connections. With some conventional methods and devices, operators may require additional training and vigilance to seal coaxial cable connections using rubber grommets or seals. An operator must first choose the appropriate seal for the application and then remember to place the seal onto one of the connective members prior to assembling the connection. Certain rubber seal designs seal only through radial compression. These seals must be tight enough to collapse onto or around the mating parts. Because there may be several diameters over which the seal must extend, the seal is likely to be very tight on at least one of the diameters. High friction caused by the tight seal may lead an operator to believe that the assembled connection is completely tightened when it actually remains loose. A loose connection may not efficiently transfer a quality RF signal causing problems similar to corrosion.

Other conventional seal designs require axial compression generated between the connector nut and an opposing surface of the port. An appropriate length seal that sufficiently spans the distance between the nut and the opposing surface, without being too long, must be selected. If the seal is too long, the seal may prevent complete assembly of the connector or component. If the seal is too short, moisture freely passes. The selection is made more complicated because port lengths may vary among different manufacturers.

Furthermore, coaxial cables are typically designed so that an electromagnetic field carrying communications signals exists only in the space between inner and outer coaxial conductors of the cables. This allows coaxial cable runs to be installed next to metal objects without the power losses that occur in other transmission lines, and provides protection of the communications signals from external electromagnetic interference.

Connectors for coaxial cables are typically connected onto complementary interface ports to electrically integrate coaxial cables to various electronic devices and cable communication equipment. Connection is often made through rotatable operation of an internally threaded nut of the connector about a corresponding externally threaded interface port. Fully tightening the threaded connection of the coaxial cable connector to the interface port helps to ensure a ground connection between the connector and the corresponding interface port. However, when the connector is not fully tightened or becomes loose, the ground connection between the connector and the interface port is lost. This loss of ground results in loss of video, internet service, and/or speed.

Therefore, in view of the aforementioned shortcomings and others known by those skilled in the art, it may be desirable to provide a seal and/or a sealing connector that applies a biasing force between the connector and the interface port to maintain an electrical ground path when the connector is not fully tightened.

SUMMARY

According to various aspects of the disclosure, a coaxial cable connector includes a nut having a seal-grasping surface portion and a seal having an elastically deformable tubular body attached to the nut. The body has a posterior end with a sealing surface that cooperatively engages the seal-grasping surface portion of the nut and an anterior end with a forward sealing surface configured to cooperatively engage an interface port. The nut defines a first through hole extending in the longitudinal direction and configured to receive a center conductor of a coaxial cable. The anterior end of the seal defines a second through hole extending in the longitudinal direction and configured to receive a center conductor of a coaxial cable. A center axis of the first through hole and a center axis of the second through hole are offset from one another such that the anterior end the seal is configured to urge at least the center conductor of the coaxial cable to an off-center position of the second through hole when the nut is coupled with the interface port thereby creating radial interference between the nut and the interface port. The nut is urged to make contact with the interface port whenever mounted thereon, thus maintaining electrical grounding between the nut and the port, even when the nut is loosely coupled with the interface port.

According to some aspects of the disclosure, a coaxial cable connector includes a body configured to engage a coaxial cable having a conductive electrical grounding property, a post configured to engage the body and the coaxial cable when the connector is installed on the coaxial cable, a nut configured to engage an interface port at a retention force, and a grounding member extending about the nut. The grounding member is configured to increase the retention force between the nut and the interface port so as to maintain an electrical ground connection between the interface port and the nut when the nut is in a loosely tightened position on the interface port In various aspects, a coaxial cable connector includes a body configured to engage a coaxial cable having a conductive electrical grounding property, a post configured to engage the body and the coaxial cable when the connector is installed on the coaxial cable, a nut configured to engage an interface port at a retention force, and a retention adding element configured to increase the retention force between the nut and the interface port so as to maintain ground continuity between the interface port and the nut when the nut is in a loosely tightened position on the interface port.

In some aspects of the disclosure, the nut may include internal threads configured to engage the interface port at the retention force.

According to various aspects, the retention adding element may comprise a plurality of resilient fingers formed in a forward portion of the nut, and the fingers may be configured to define an inner diameter smaller than an outer diameter of the interface port. In some aspects, at least one of the plurality of resilient fingers is configured to taper from a first diameter at a rearward end portion to a second smaller diameter at a middle portion. The at least one finger may be configured to flare out from the middle portion to a front end portion. In some aspects, the at least one finger may be configured define a bend point at the middle portion, and the bend point may be configured to further increase the retention force between the nut and the interface port.

According to some aspects, the coaxial cable connector may further comprise a cap extending about the plurality of resilient fingers. The cap may be configured to further increase the retention force between the nut and the interface port.

In some aspects, the retention adding element may include a pair of offset slots defining a finger configured to define an inner diameter of the nut that is smaller than an outer diameter of the interface port.

According to various aspects, the retention adding element may include a longitudinal slot extending through an entire length of the nut. The slot may be configured to permit the nut to be configured to define an inner diameter of the nut that is smaller than an outer diameter of the interface port.

In accordance with some aspects, the retention adding element may include a deformed portion along a portion of a circumference of the nut. The deformed portion may be configured to define an inner diameter of the nut that is smaller than an outer diameter of the interface port.

According to some aspects, the retention adding element may include a grounding member extending about the nut. The grounding member may be configured to extend beyond a forward end of the nut and engage the interface port. In some aspects, the grounding member may include at least one resilient finger configured to define an inner diameter of the grounding member that is smaller than an outer diameter of the interface port. According to some aspects, the grounding member may include an engagement feature configured to couple the grounding member to the nut. In some aspects, the engagement feature may include at least one resilient figure configured to couple the grounding member to the nut.

According to various aspects, the retention adding element may include a clip configured to engage the interface port through a cross-cut extending radially through the nut.

In some aspects, the retention adding element may include an offset creating feature configured to offset a center conductor of the coaxial cable relative to an axial center of the connector such that when the nut coupled with the interface port. The interface port may urge the center conductor in a direction opposite to the offset and a side of the nut of the connector is urged toward the interface port.

According to some aspects of the disclosure, the offset creating feature may include an insert configured to be received by the coupler.

BRIEF DESCRIPTION OF THE DRAWINGS

Features and advantages of the present disclosure are described in, and will be apparent from, the following Brief Description of the Drawings and Detailed Description.

FIG. 21A is a side cross-sectional view of an exemplary connector in accordance with various aspects of the disclosure.

FIG. 21B is a perspective view of an exemplary clip in accordance with various aspects of the disclosure.

FIG. 22A is a side cross-sectional view of an exemplary connector in accordance with various aspects of the disclosure.

FIG. 22B is a perspective view of an exemplary clip in accordance with various aspects of the disclosure.

FIG. 43 is a side-front perspective view of an exemplary conductive insert in accordance with various aspects of the disclosure.

DETAILED DESCRIPTION OF EMBODIMENTS

The accompanying figures illustrate various exemplary embodiments of coaxial cable connectors that provide improved ground continuity between the coaxial cable, the connector, and the coaxial cable connector interface port. Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a", "an" and "the" include plural referents, unless the context clearly dictates otherwise.

Figure 1:
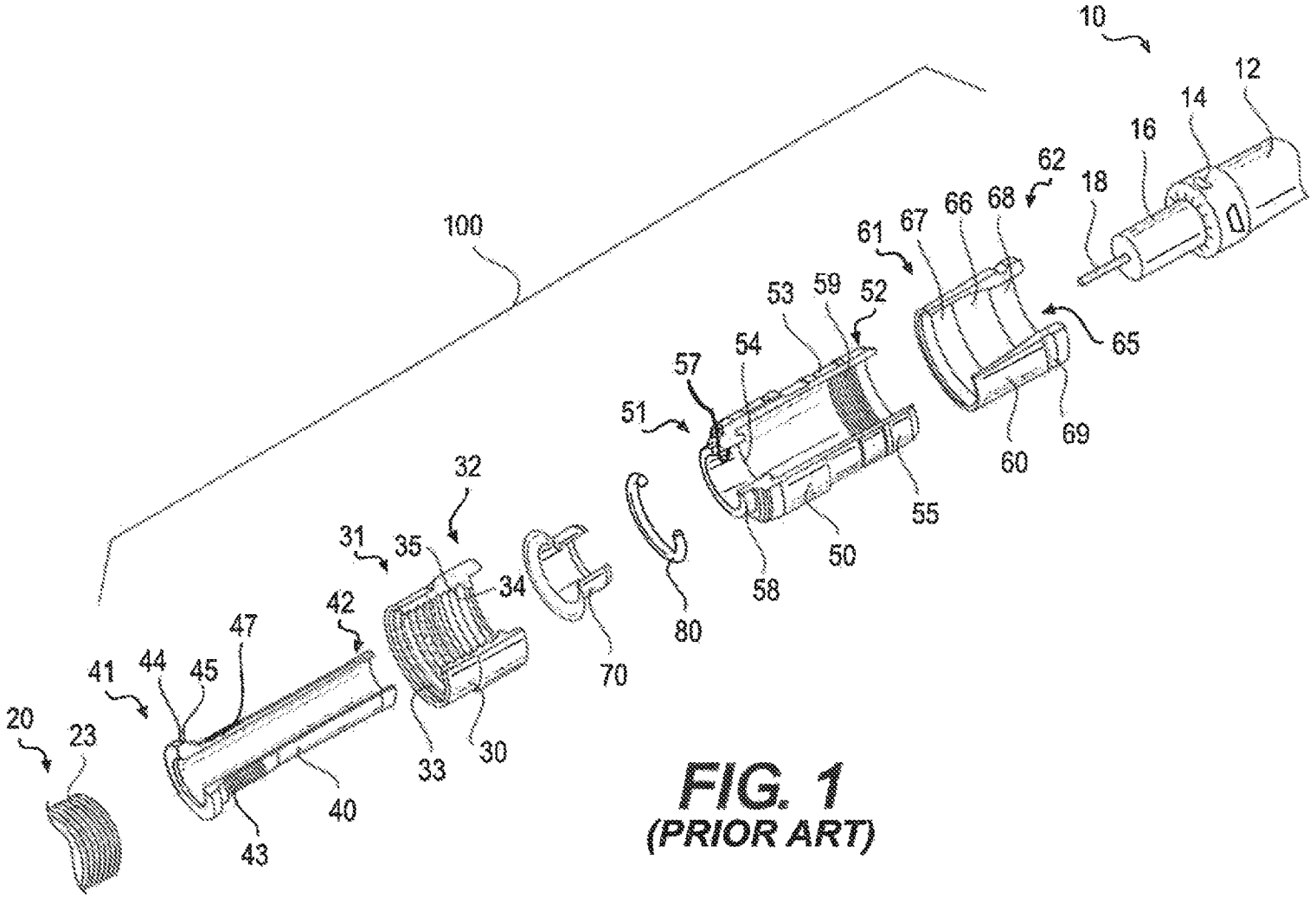
FIG. 1 (PRIOR ART)
FIG. 1 is an exploded perspective cut-away view of a conventional coaxial cable connector.
Figure 2A:
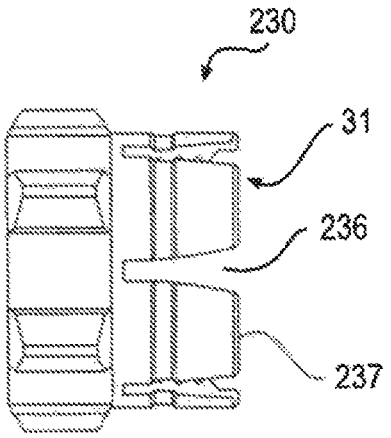
FIGS. 2A-2D are side, top, front, and perspective views of an exemplary nut in accordance with various aspects of the disclosure.
Figure 2B:
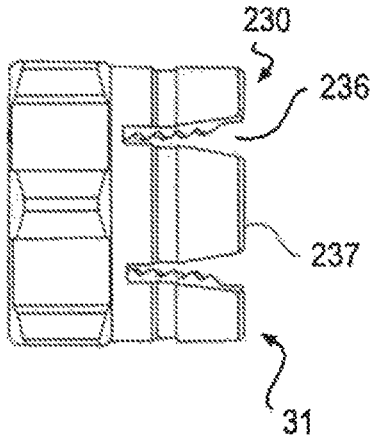
Figure 2C:
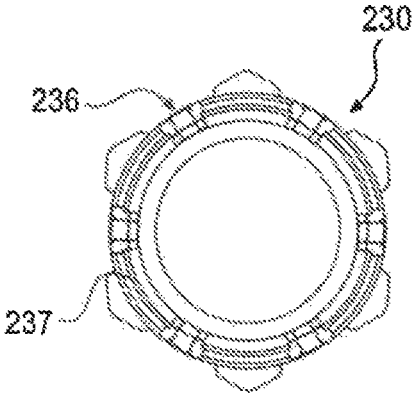
Figure 2D:
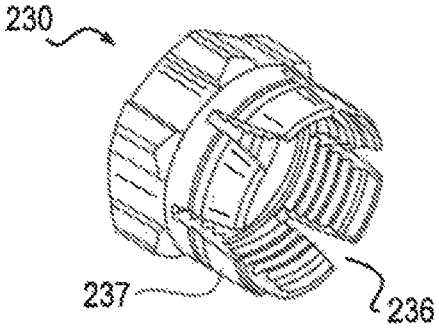
Figure 3A:
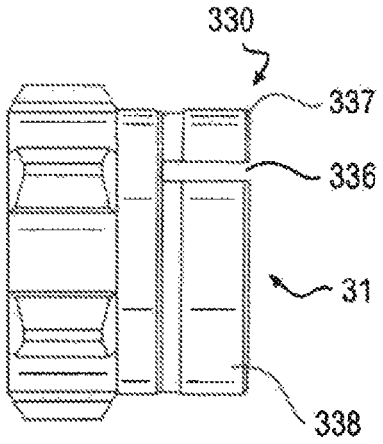
FIGS. 3A-3D are side, top, front, and perspective views of an exemplary nut in accordance with various aspects of the disclosure.
Figure 3B:
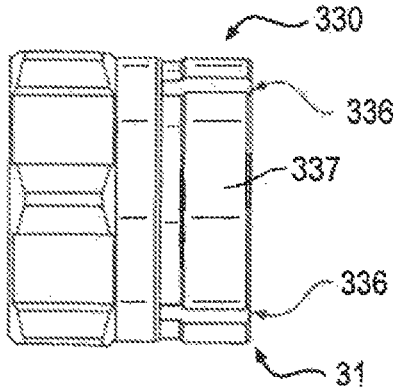
Figure 3C:
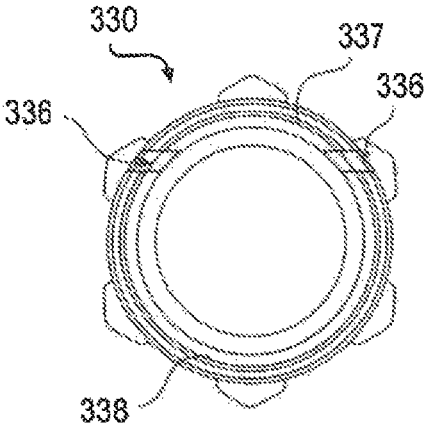
Figure 3D:
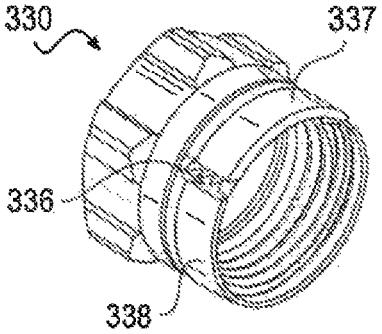

Referring to the drawings, FIG. 1 depicts a conventional coaxial cable connector 100. The coaxial cable connector 100 may be operably affixed, or otherwise functionally attached, to a coaxial cable 10 having a protective outer jacket 12, a conductive grounding shield 14, an interior dielectric 16 and a center conductor 18. The coaxial cable 10 may be prepared as embodied in FIG. 1 by removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection, such as cuprous braided material, aluminum foils, thin metallic elements, or other like structures. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation, such as plastic foam material, paper materials, rubber-like polymers, or other functional insulating materials. It should be noted that the various materials of which all the various components of the coaxial cable 10 are comprised should have some degree of elasticity allowing the cable 10 to flex or bend in accordance with traditional broadband communication standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

Referring further to FIG. 1, the connector 100 may be configured to be coupled with a coaxial cable interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 23. It should be recognized that the radial thickness and/or the length of the coaxial cable interface port 20 and/or the conductive receptacle of the port 20 may vary based upon generally recognized parameters corresponding to broadband communication standards and/or equipment. Moreover, the pitch and height of threads which may be formed upon the threaded exterior surface 23 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's operable electrical interface with the connector 100. However, the receptacle of the port 20 should be formed of a conductive material, such as a metal, like brass, copper, or aluminum. Further still, it will be understood by those of ordinary skill that the interface port 20 may be embodied by a connective interface component of a coaxial cable communications device, a television, a modem, a computer port, a network receiver, or other communications modifying devices such as a signal splitter, a cable line extender, a cable network module and/or the like.

Referring still further to FIG. 1, the conventional coaxial cable connector 100 may include a coupler, for example, threaded nut 30, a post 40, a connector body 50, a fastener member 60, a continuity member 70 formed of conductive material, and a connector body sealing member 80, such as, for example, a body O-ring configured to fit around a portion of the connector body 50. The nut 30 at the front end of the post 40 serves to attach the connector 100 to an interface port.

The threaded nut 30 of the coaxial cable connector 100 has a first forward end 31 and opposing second rearward end 32. The threaded nut 30 may comprise internal threading 33 extending axially from the edge of first forward end 31 a distance sufficient to provide operably effective threadable contact with the external threads 23 of the standard coaxial cable interface port 20. The threaded nut 30 includes an internal lip 34, such as an annular protrusion, located proximate the second rearward end 32 of the nut. The internal lip 34 includes a surface 35 facing the first forward end 31 of the nut 30. The forward facing surface 35 of the lip 34 may be a tapered surface or side facing the first forward end 31 of the nut 30. The structural configuration of the nut 30 may vary according to differing connector design parameters to accommodate different functionality of a coaxial cable connector 100. For instance, the first forward end 31 of the nut 30 may include internal and/or external structures such as ridges, grooves, curves, detents, slots, openings, chamfers, or other structural features, etc., which may facilitate the operable joining of an environmental sealing member, such a water-tight seal or other attachable component element, that may help prevent ingress of environmental contaminants, such as moisture, oils, and dirt, at the first forward end 31 of a nut 30, when mated with the interface port 20. Moreover, the second rearward end 32 of the nut 30 may extend a significant axial distance to reside radially extent, or otherwise partially surround, a portion of the connector body 50, although the extended portion of the nut 30 need not contact the connector body 50. The threaded nut 30 may be formed of conductive materials, such as copper, brass, aluminum, or other metals or metal alloys, facilitating grounding through the nut 30. Accordingly, the nut 30 may be configured to extend an electromagnetic buffer by electrically contacting conductive surfaces of an interface port 20 when a connector 100 is advanced onto the port 20. In addition, the threaded nut 30 may be formed of both conductive and non-conductive materials. For example, the external surface of the nut 30 may be formed of a polymer, while the remainder of the nut 30 may be comprised of a metal or other conductive material. The threaded nut 30 may be formed of metals or polymers or other materials that would facilitate a rigidly formed nut body. Manufacture of the threaded nut 30 may include casting, extruding, cutting, knurling, turning, tapping, drilling, injection molding, blow molding, combinations thereof, or other fabrication methods that may provide efficient production of the component. The forward facing surface 35 of the nut 30 faces a flange 44 of the post 40 when operably assembled in a connector 100, so as to allow the nut to rotate with respect to the other component elements, such as the post 40 and the connector body 50, of the connector 100.

Referring still to FIG. 1, the connector 100 may include a post 40. The post 40 may include a first forward end 41 and an opposing second rearward end 42. Furthermore, the post 40 may include a flange 44, such as an externally extending annular protrusion, located at the first end 41 of the post 40. The flange 44 includes a rearward facing surface 45 that faces the forward facing surface 35 of the nut 30, when operably assembled in a coaxial cable connector 100, so as to allow the nut to rotate with respect to the other component elements, such as the post 40 and the connector body 50, of the connector 100. The rearward facing surface 45 of flange 44 may be a tapered surface facing the second rearward end 42 of the post 40. Further still, an embodiment of the post 40 may include a surface feature 47 such as a lip or protrusion that may engage a portion of a connector body 50 to secure axial movement of the post 40 relative to the connector body 50. However, the post need not include such a surface feature 47, and the coaxial cable connector 100 may rely on press-fitting and friction-fitting forces and/or other component structures having features and geometries to help retain the post 40 in secure location both axially and rotationally relative to the connector body 50. The location proximate or near where the connector body is secured relative to the post 40 may include surface features 43, such as ridges, grooves, protrusions, or knurling, which may enhance the secure attachment and locating of the post 40 with respect to the connector body 50. Moreover, the portion of the post 40 that contacts embodiments of a continuity member 70 may be of a different diameter than a portion of the nut 30 that contacts the connector body 50. Such diameter variance may facilitate assembly processes. For instance, various components having larger or smaller diameters can be readily press-fit or otherwise secured into connection with each other. Additionally, the post 40 may include a mating edge 46, which may be configured to make physical and electrical contact with a corresponding mating edge 26 of the interface port 20. The post 40 should be formed such that portions of a prepared coaxial cable 10 including the dielectric 16 and center conductor 18 may pass axially into the second end 42 and/or through a portion of the tube-like body of the post 40. Moreover, the post 40 should be dimensioned, or otherwise sized, such that the post 40 may be inserted into an end of the prepared coaxial cable 10, around the dielectric 16 and under the protective outer jacket 12 and conductive grounding shield 14. Accordingly, where an embodiment of the post 40 may be inserted into an end of the prepared coaxial cable 10 under the drawn back conductive grounding shield 14, substantial physical and/or electrical contact with the shield 14 may be accomplished thereby facilitating grounding through the post 40. The post 40 should be conductive and may be formed of metals or may be formed of other conductive materials that would facilitate a rigidly formed post body. In addition, the post may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, combinations thereof, or other fabrication methods that may provide efficient production of the component.

The coaxial cable connector 100 may include a connector body 50. The connector body 50 may comprise a first end 51 and opposing second end 52. Moreover, the connector body may include a post mounting portion 57 proximate or otherwise near the first end 51 of the body 50, the post mounting portion 57 configured to securely locate the body 50 relative to a portion of the outer surface of post 40, so that the connector body 50 is axially secured with respect to the post 40, in a manner that prevents the two components from moving with respect to each other in a direction parallel to the axis of the connector 100. The internal surface of the post mounting portion 57 may include an engagement feature 54 that facilitates the secure location of the continuity member 70 with respect to the connector body 50 and/or the post 40, by physically engaging the continuity member 70 when assembled within the connector 100. The engagement feature 54 may simply be an annular detent or ridge having a different diameter than the rest of the post mounting portion 57. However other features such as grooves, ridges, protrusions, slots, holes, keyways, bumps, nubs, dimples, crests, rims, or other like structural features may be included to facilitate or possibly assist the positional retention of embodiments of the electrical continuity member 70 with respect to the connector body 50. Nevertheless, embodiments of the continuity member 70 may also reside in a secure position with respect to the connector body 50 simply through press-fitting and friction-fitting forces engendered by corresponding tolerances, when the various coaxial cable connector 100 components are operably assembled, or otherwise physically aligned and attached together. Various exemplary continuity members 70 are illustrated and described in U.S. Pat. No. 8,287,320, the disclosure of which is incorporated herein by reference. In addition, the connector body 50 may include an outer annular recess 58 located proximate or near the first end 51 of the connector body 50. Furthermore, the connector body 50 may include a semi-rigid, yet compliant outer surface 55, wherein an inner surface opposing the outer surface 55 may be configured to form an annular seal when the second end 52 is deformably compressed against a received coaxial cable 10 by operation of a fastener member 60. The connector body 50 may include an external annular detent 53 located proximate or close to the second end 52 of the connector body 50. Further still, the connector body 50 may include internal surface features 59, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 55. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With further reference to FIG. 1, the coaxial cable connector 100 may include a fastener member 60. The fastener member 60 may have a first end 61 and opposing second end 62. In addition, the fastener member 60 may include an internal annular protrusion 63 located proximate the first end 61 of the fastener member 60 and configured to mate and achieve purchase with the annular detent 53 on the outer surface 55 of connector body 50. Moreover, the fastener member 60 may comprise a central passageway 65 defined between the first end 61 and second end 62 and extending axially through the fastener member 60. The central passageway 65 may comprise a ramped surface 66 which may be positioned between a first opening or inner bore 67 having a first diameter positioned proximate with the first end 61 of the fastener member 60 and a second opening or inner bore 68 having a second diameter positioned proximate with the second end 62 of the fastener member 60. The ramped surface 66 may act to deformably compress the outer surface 55 of a connector body 50 when the fastener member 60 is operated to secure a coaxial cable 10. For example, the narrowing geometry will compress squeeze against the cable, when the fastener member is compressed into a tight and secured position on the connector body. Additionally, the fastener member 60 may comprise an exterior surface feature 69 positioned proximate with or close to the second end 62 of the fastener member 60. The surface feature 69 may facilitate gripping of the fastener member 60 during operation of the connector 100. Although the surface feature 69 is shown as an annular detent, it may have various shapes and sizes such as a ridge, notch, protrusion, knurling, or other friction or gripping type arrangements. The first end 61 of the fastener member 60 may extend an axial distance so that, when the fastener member 60 is compressed into sealing position on the coaxial cable 100, the fastener member 60 touches or resides substantially proximate significantly close to the nut 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

The manner in which the coaxial cable connector 100 may be fastened to a received coaxial cable 10 may also be similar to the way a cable is fastened to a common CMP-type connector having an insertable compression sleeve that is pushed into the connector body 50 to squeeze against and secure the cable 10. The coaxial cable connector 100 includes an outer connector body 50 having a first end 51 and a second end 52. The body 50 at least partially surrounds a tubular inner post 40. The tubular inner post 40 has a first end 41 including a flange 44 and a second end 42 configured to mate with a coaxial cable 10 and contact a portion of the outer conductive grounding shield or sheath 14 of the cable 10. The connector body 50 is secured relative to a portion of the tubular post 40 proximate or close to the first end 41 of the tubular post 40 and cooperates, or otherwise is functionally located in a radially spaced relationship with the inner post 40 to define an annular chamber with a rear opening. A tubular locking compression member may protrude axially into the annular chamber through its rear opening. The tubular locking compression member may be slidably coupled or otherwise movably affixed to the connector body 50 to compress into the connector body and retain the cable 10 and may be displaceable or movable axially or in the general direction of the axis of the connector 100 between a first open position (accommodating insertion of the tubular inner post 40 into a prepared cable 10 end to contact the grounding shield 14), and a second clamped position compressibly fixing the cable 10 within the chamber of the connector 100, because the compression sleeve is squeezed into retraining contact with the cable 10 within the connector body 50.

Referring now to FIGS. 2A-2D, an exemplary nut 230 in accordance with various aspects of the disclosure is illustrated. The nut 230 can be used with the coaxial cable connector 100 in place of the conventional nut 30. The nut 230 includes a plurality of slots 236 extending rearward in the axial direction of the nut 230 from the first forward end 31. As illustrated, the plurality of slots 236 define a corresponding plurality of fingers 237. Before being coupled with the interface port 20, the plurality of fingers 237 are crimped radially inward such that the resulting inside diameter of the first forward end 31 of the nut 230 is smaller than the outside diameter of the interface port 20. The fingers 237 are constructed of a material having sufficient resiliency such that the fingers 237 are configured to deflect radially outward to receive the interface port 20 therein when the nut 230 is coupled with the interface port 20, while remaining biased radially inward. The fingers 237 remain biased radially inward to maintain constant contact with the threaded exterior surface 23 of the interface port 20 at all times, for example, even when the nut 230 is not fully tightened to the interface port 20. Thus, even when the nut 230 is loosely coupled (i.e., partially or loosely tightened) with the interface port 20, electrical ground between the nut 230 and the interface port 20 is maintained.

As shown in FIGS. 2A-2D, an exemplary nut 230 may six slots 236 and six fingers 237. However, nuts according to this disclosure could have more than six slots and fingers or less than six slots and fingers. Of course, at a minimum, two slots are needed to define a pair of fingers. Also, although FIG. 1 shows six slots and fingers that are symmetrically arranged, the slots and fingers can also be asymmetrically arranged. Exemplary nuts can include an even number of fingers or an odd number of fingers.

As shown in FIGS. 2A-2D, the slots 236 that are cut into the nut 230 in the axial direction of the nut 230 can be tapered such that the forward end of the slot 236 is wider than the rearward end of the slot 236. With such a configuration, when the fingers 237 are crimped before attaching to the interface post, the forward ends assume a position relative to one another that is at least closer to parallel.

Referring to FIGS. 3A-3D, another exemplary nut 330 in accordance with various aspects of the disclosure is illustrated. The nut 330 can be used with the coaxial cable connector 100 in place of the conventional nut 30. The nut 330 includes two off-center slots 336 cut into first forward end 31 of the nut 330 to create a smaller finger 337 and a larger region 338. Before being coupled with the interface port 20, the finger 337 is crimped radially inward such that the resulting inside diameter of the first forward end 31 of the nut 330 is smaller than the outside diameter of the interface port 20. The larger region 338 can remain uncrimped. The finger 337 is constructed of a material having sufficient resiliency such that the finger 337 is configured to deflect radially outward to receive the interface port 20 therein when the nut 330 is coupled with the interface port 20, while remaining biased radially inward. The finger 337 remains biased radially inward to maintain constant contact with the threaded exterior surface 23 of the interface port 20 at all times, for example, even when the nut 330 is not fully tightened to the interface port 20. Thus, even when the nut 330 is loosely coupled (i.e., partially or loosely tightened) with the interface port 20, electrical ground between the nut 330 and the interface port 20 is maintained. As shown in FIGS. 3A-3D, the slots can be cut in a direction that is not radially aligned with the center of the nut. Also, as shown in FIGS. 3A-3D, the slots can be cut in a non-tapered manner. Of course, the slots can be cut in a radial direction and can be tapered.

Figure 4A:
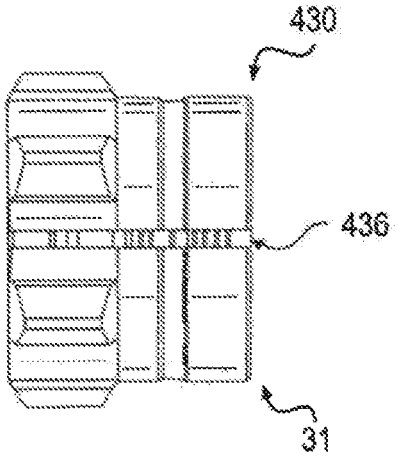
FIGS. 4A-4D are side, top, front, and perspective views of an exemplary nut in accordance with various aspects of the disclosure.
Figure 4B:
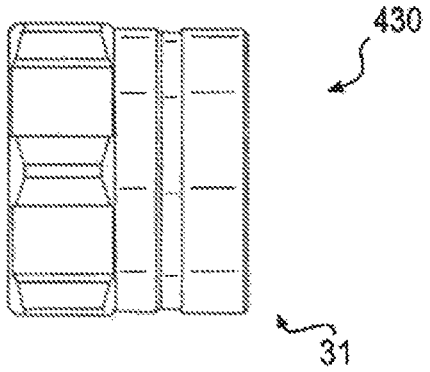
Figure 4C:
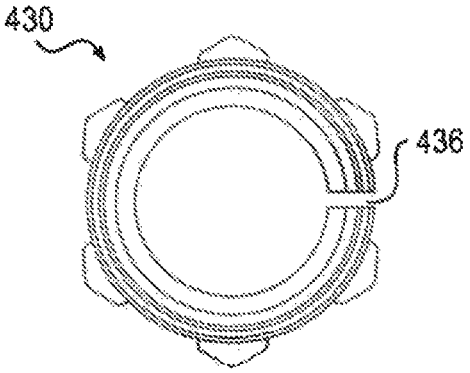
Figure 4D:
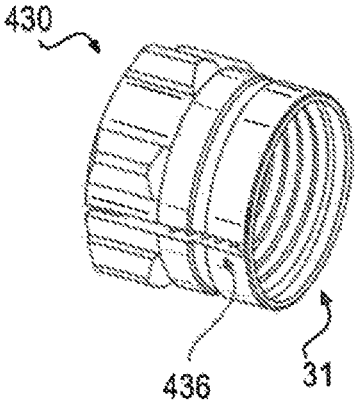

Referring to FIGS. 4A-4D, another exemplary nut 430 in accordance with various aspects of the disclosure is illustrated. The nut 430 can be used with the coaxial cable connector 100 in place of the conventional nut 30. The nut 430 includes a single slot 436 that is cut through the entire length of the nut 430 in the axial direction, as illustrated in FIGS. 4A, 4C, and 4D. The first forward end 31 of the nut 430 can be crimped about its entire periphery or about a portion of the periphery prior to mounting on the interface port 20. For example, the first forward end 31 may be crimped at either or both sides of slot 436. The resulting inside diameter of the first forward end 31 of the nut 430 is smaller than the outside diameter of the interface port 20. The nut 430 is constructed of a material having sufficient resiliency such that the first forward end 31 is configured to deflect radially outward to receive the interface port 20 therein when the nut 430 is coupled with the interface port 20, while remaining biased radially inward. The first forward end 31 remains biased radially inward to maintain constant contact with the threaded exterior surface 23 of the interface port 20 at all times, for example, even when the nut 430 is not fully tightened to the interface port 20. Thus, even when the nut 430 is loosely coupled (i.e., partially or loosely tightened) with the interface port 20, electrical ground between the nut 430 and the interface port 20 is maintained.

Figure 5A:
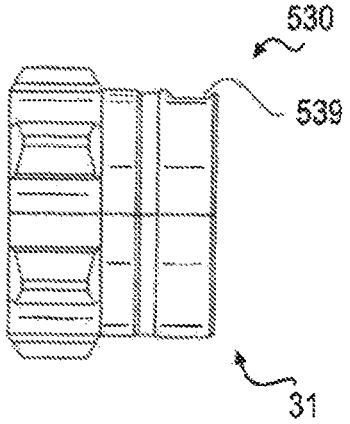
FIGS. 5A-5D are side, top, front, and perspective views of an exemplary nut in accordance with various aspects of the disclosure.
Figure 5B:
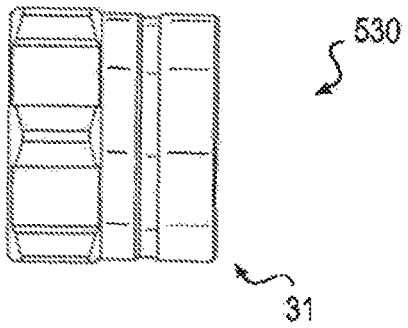
Figure 5C:
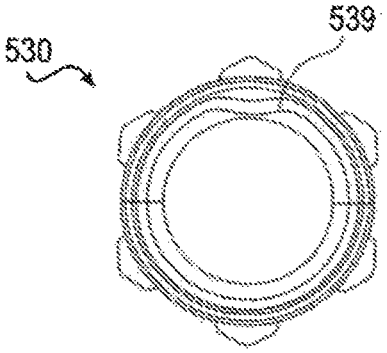
Figure 5D:
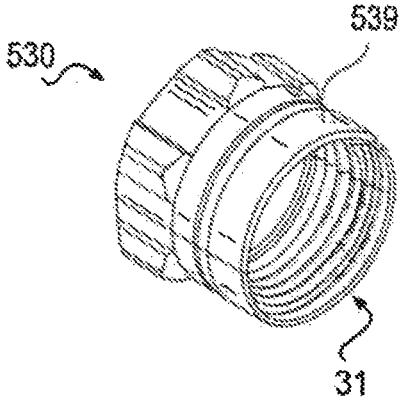

Referring to FIGS. 5A-5D, another exemplary nut 530 in accordance with various aspects of the disclosure is illustrated. The nut 530 can be used with the coaxial cable connector 100 in place of the conventional nut 30. As best shown in FIGS. 5A and 5C, the nut 530 may include a deformed portion 539 of the periphery of the first forward end 31 of the nut 530. As illustrated in FIG. 5C, the deformed portion 539 of the circumference of the forward end of the nut is deformed to form an inwardly-directed portion. The deformed portion 539 of the first forward end 31 of the nut 530 is thus configured to maintain a desired amount of interference with the interface port 20 when mounted thereon. The size of the deformed portion 539 of the circumference and the degree of inward deformation may be varied to achieve a desired amount of interference with the interface port 20 when the nut 530 is mounted thereon. The deformed portion 539 is constructed of a material having sufficient resiliency such that the deformed portion 539 is configured to deflect radially outward to receive the interface port 20 therein when the nut 530 is coupled with the interface port 20, while remaining biased radially inward. The deformed portion 539 remains biased radially inward to maintain constant contact with the threaded exterior surface 23 of the interface port 20 at all times, for example, even when the nut 530 is not fully tightened to the interface port 20. Thus, even when the nut 530 is loosely coupled (i.e., partially or loosely tightened) with the interface port 20, electrical ground between the nut 530 and the interface port 20 is maintained.

Figure 6A:
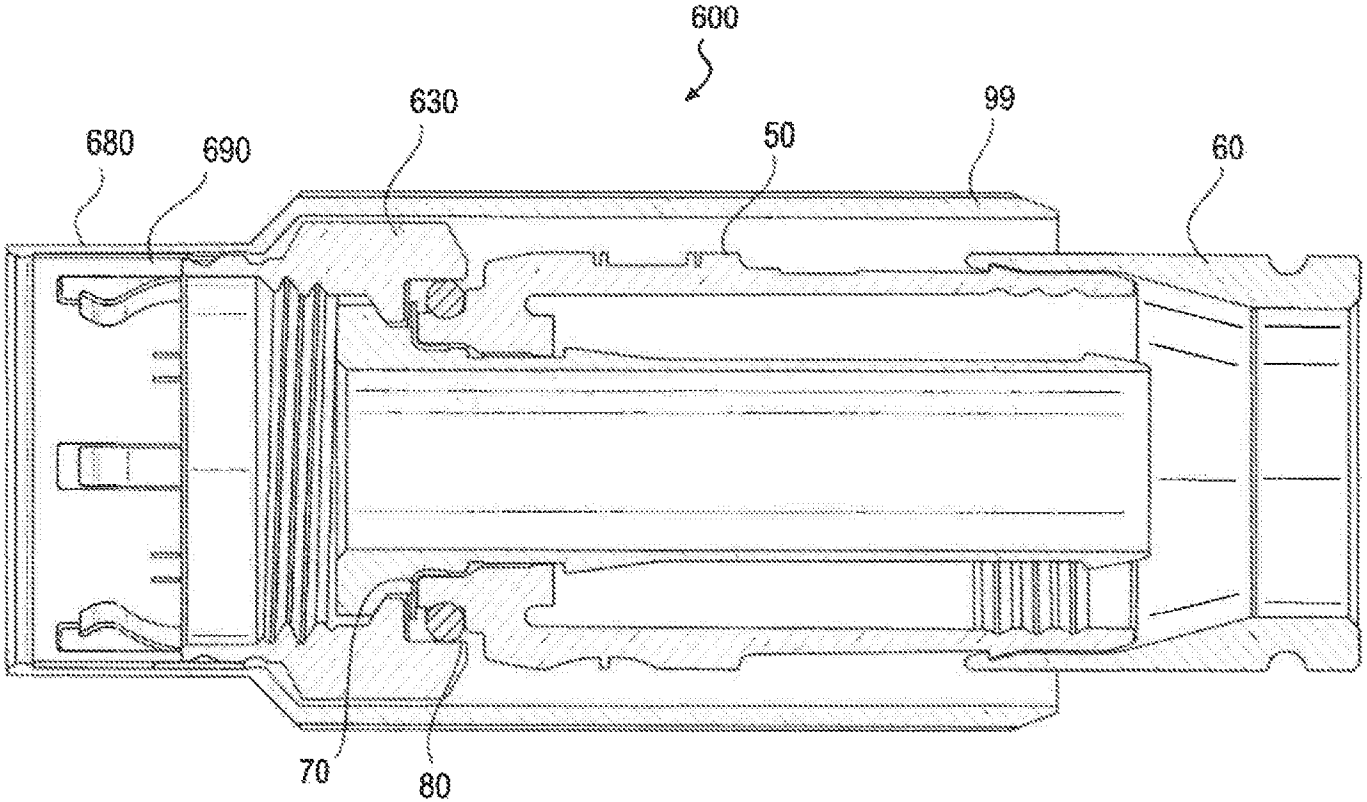
FIG. 6A is a side cross-sectional view of an exemplary connector in accordance with various aspects of the disclosure.
Figure 6B:
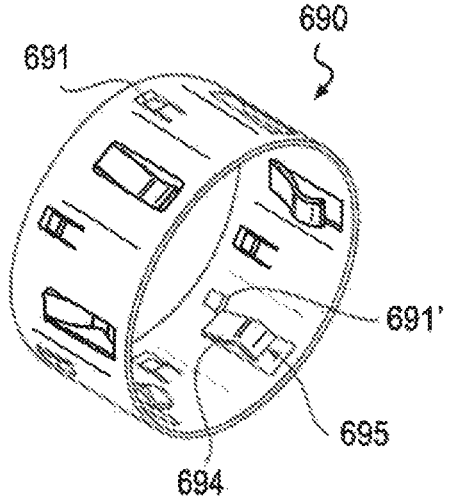
FIG. 6B is a perspective view of an exemplary grounding member in accordance with various aspects of the disclosure.

In accordance with various aspects of the disclosure, as shown in FIGS. 6A and 6B, an exemplary embodiment of a coaxial cable connector 600 may include a nut 630 and a grounding member 690 connected with the nut 630. As shown in FIG. 6, the grounding member 690 may extend about a periphery of the nut 630. The grounding member 690 may be connected with the nut 630 in any manner that ensures a ground path between the nut 630 and the grounding member 690, such as, for example, a snap fit, interference fit, press fit, or the like. For example, as shown in FIGS. 6A and 6B, the grounding member 690 may include one or more fingers 691 formed by cuts in the grounding member 690. The fingers 691 are configured to project radially inward such that the resulting inside diameter of the fingers 691 is smaller than the outside diameter of the nut 630. The fingers 691 are constructed of a material having sufficient resiliency such that the fingers 691 are configured to deflect radially outward to receive the nut 630 therein when the nut 630 is coupled with the grounding member 690, while remaining biased radially inward. As shown in FIGS. 6A and 6B, the fingers 691 may be configured such that a free end of the each finger extends in a rearward direction. Additionally or alternatively, the grounding member 690 may include one or more fixed protrusions 691' extending inwardly from an inner surface of the grounding member 690.

The nut 630 may include a circumferential groove 692 extending about the outer surface 693 of the nut 630. Alternatively, the nut 630 may include one or more arcuate grooves (not shown) spaced apart circumferentially about the outer surface 693 of the nut 630, wherein the one or more arcuate grooves correspond with the one or more fingers 692. When the nut 630 is received by the grounding member 690, for example, by sliding the nut 630 and the grounding member 690 relative to one another in the axial direction, the bias of the fingers 691 urges the fingers 691 into the groove 692 to couple the grounding member 690 with the nut 630. It should be appreciated that, in some embodiments, the nut 630 and the grounding member 690 may be configured as a single piece.

The grounding member 690 may include one or more continuity fingers 694 formed by cuts in the grounding member 690. The continuity fingers 694 are configured to project radially inward such that the resulting inside diameter of the continuity fingers 694 is smaller than the outside diameter of the interface port 20. The continuity fingers 694 are constructed of a material having sufficient resiliency such that the fingers 694 are configured to deflect radially outward to receive the interface port 20 therein when the nut 630 is coupled with the interface port 20, while remaining biased radially inward. As shown in FIGS. 6A and 6B, the fingers 694 may be configured such that a free end 695 of the each finger 694 extends in a forward direction. In some embodiments, the free end 695 may have a squared-off shape. The fingers 694 remain biased radially inward to maintain constant contact with the threaded exterior surface 23 of the interface port 20 at all times, for example, even when the nut 630 is not fully tightened to the interface port 20. Thus, even when the nut 630 is loosely coupled (i.e., partially or loosely tightened) with the interface port 20, electrical ground between the nut 630 and the interface port 20 is maintained.

Although FIGS. 6A and 6B illustrate a grounding member 690 having a plurality of fingers 691, the grounding member 690 may have a single finger 694 that maintains contact between the grounding member 690 and the interface port 20. For example, if the grounding member 690 includes a single finger 694 on one side of the grounding member 690, the single finger 694 will push the internal thread 73 of the nut 630 against the threaded exterior surface 23 on that same side of the interface port 20 by creating a torque force about a point that is between the single finger 694 and the internal thread 73, thus maintaining electrical continuity between the nut 630 and the port 20 through the grounding member 690.

As shown in FIGS. 6A and 6B, the connector 600 may include a sleeve 99, such as, for example, a torque sleeve or a gripping sleeve. In some embodiments, the sleeve 99 may be constructed of rubber, plastic, an elastomer, or the like. In some embodiments, the sleeve 99 may be overmolded onto the grounding member 690. Alternatively, the sleeve 99 may be coupled with the grounding member 690 through a press-fit, snap-fit, interference-fit, or any other coupling relationship.

In addition to the embodiment shown in FIGS. 6A and 6B, one or more continuity fingers may be configured to contact the port threads at different circumferential, longitudinal, and/or radial (i.e., helical or spiral) locations when the nut/sleeve is pushed (or rotated) toward the post, such as by configuring them to follow a helical path to helically contact the port threads. One way to do this would be to configure the fingers to have different lengths or to keep the same length but locate them so as to be at different longitudinal and/or radial locations so as to match the helix angle of standard port threads. Such a configuration may allow the nut or torque sleeve 99 to be more easily installed on the interface port by causing the fingers to engage different thread portions in a staggered fashion. Helically spaced port thread contact points may also result in a more reliable ground contact path (e.g., since such helix contact point may create a biasing force between different port thread portions or surfaces in the longitudinal direction when the nut/sleeve is in the installed position on the port. Alternatively, the inner surface of the one or more continuity fingers that contacts the port threads could be shaped to fit the port threads (e.g., include a set of helical threads or discontiguous segments that match the helix structure of the port threads). FIGS. 7A-17B illustrate a number of alternative embodiments similar to the connector 600 and grounding member 690 of FIGS. 6A and B.

Figure 7A:
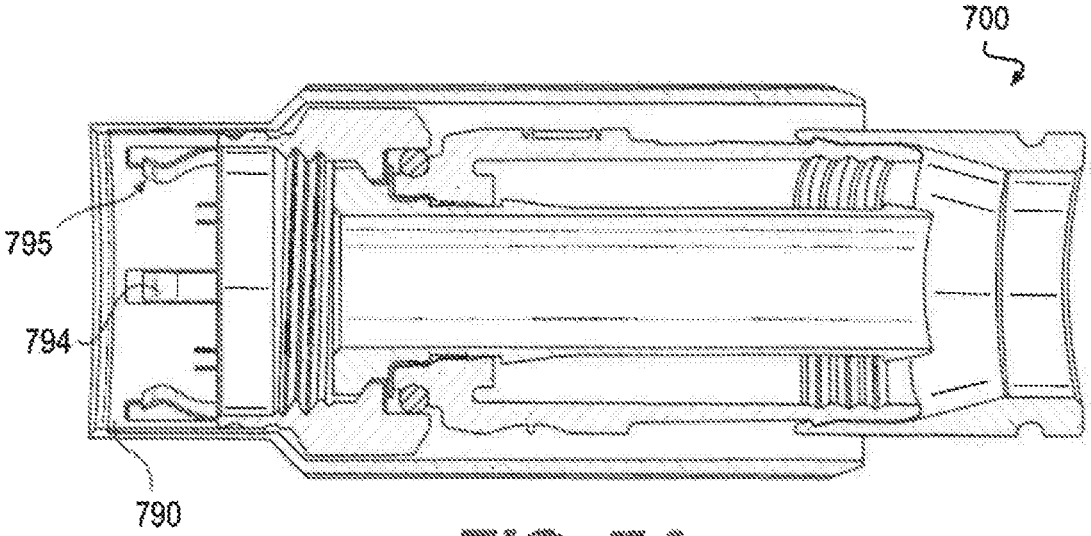
FIG. 7A is a side cross-sectional view of an exemplary connector in accordance with various aspects of the disclosure.
Figure 7B:
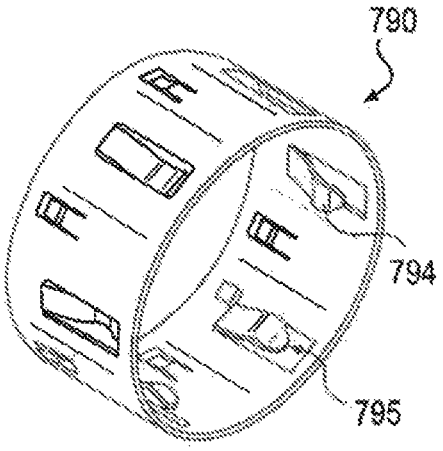
FIG. 7B is a perspective view of an exemplary grounding member in accordance with various aspects of the disclosure.
Figure 8B:
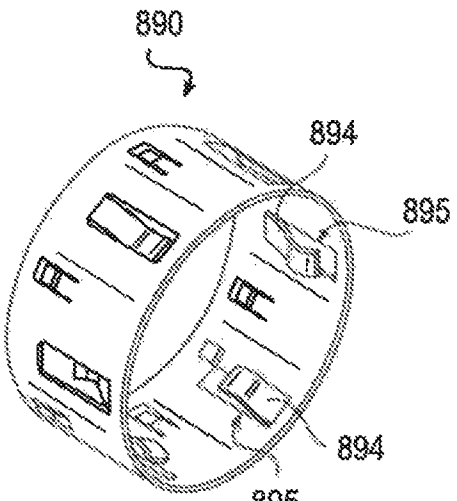
FIG. 8B is a perspective view of an exemplary grounding member in accordance with various aspects of the disclosure.
Figure 8A:
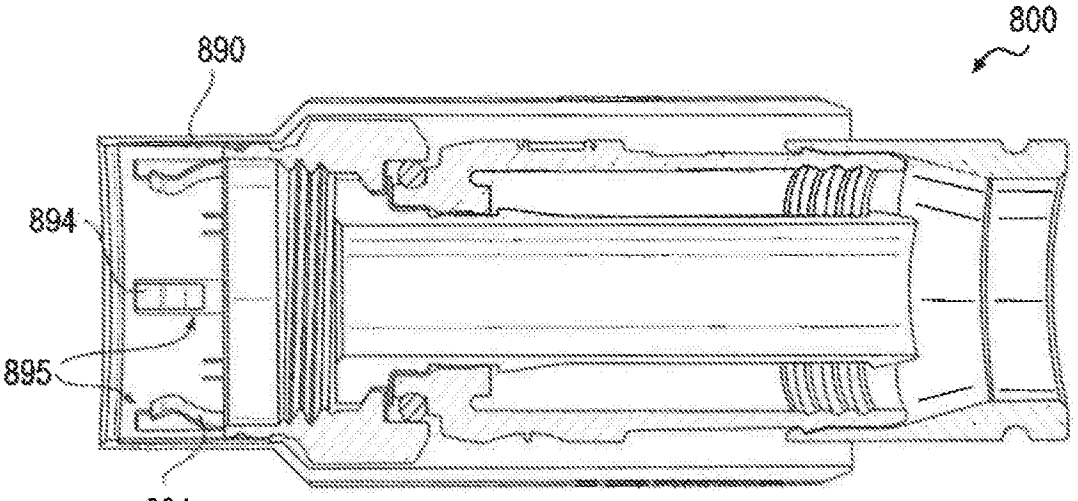
FIG. 8A is a side cross-sectional view of an exemplary connector in accordance with various aspects of the disclosure.
Figure 9B:
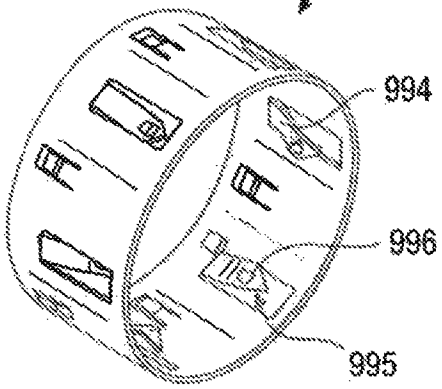
FIG. 9B is a perspective view of an exemplary grounding member in accordance with various aspects of the disclosure.
Figure 9A:
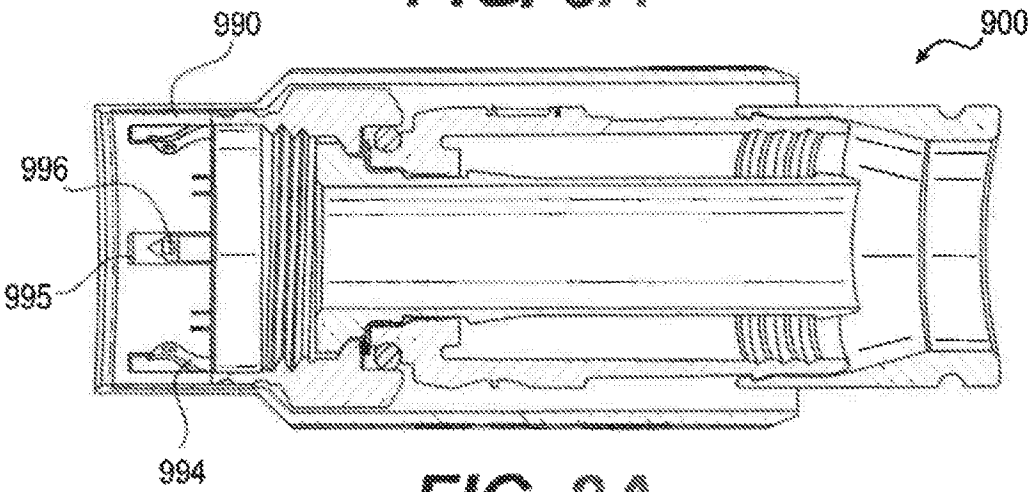
FIG. 9A is a side cross-sectional view of an exemplary connector in accordance with various aspects of the disclosure.
Figure 10A:
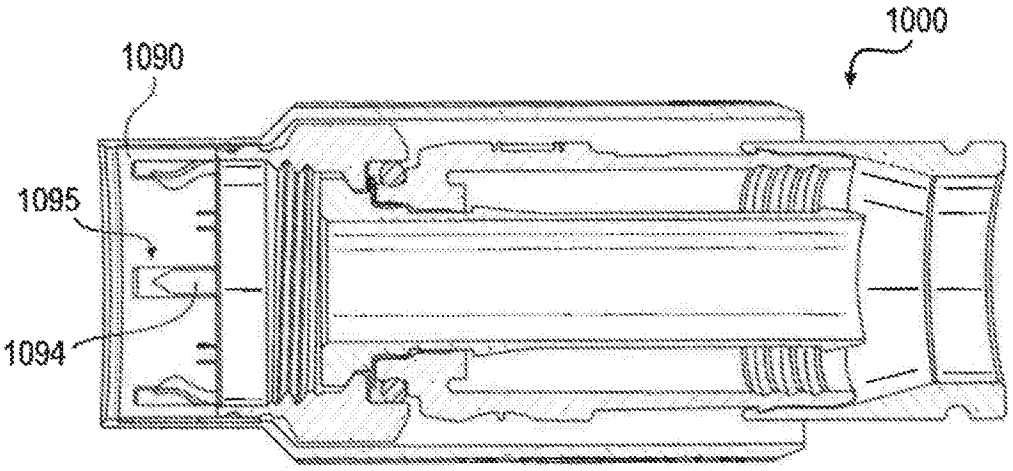
FIG. 10A is a side cross-sectional view of an exemplary connector in accordance with various aspects of the disclosure.
Figure 10B:
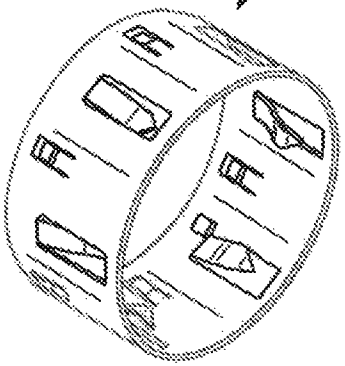
FIG. 10B is a perspective view of an exemplary grounding member in accordance with various aspects of the disclosure.
Figure 11A:
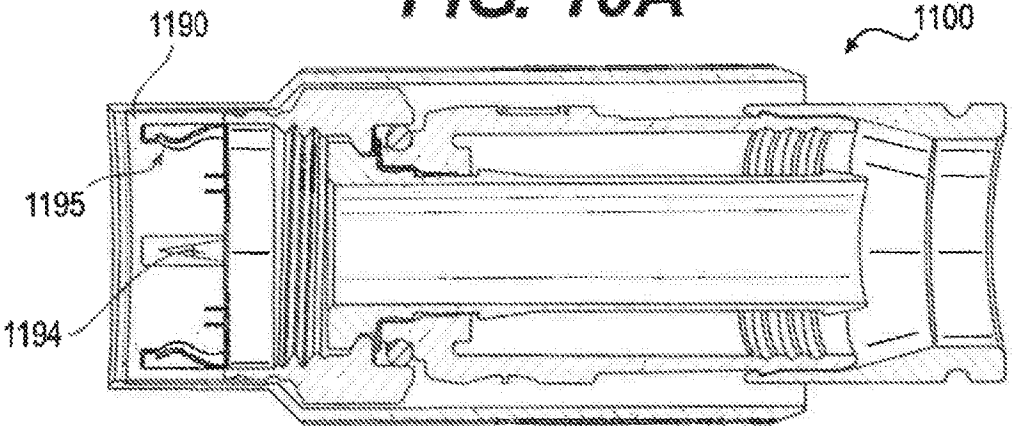
FIG. 11A is a side cross-sectional view of an exemplary connector in accordance with various aspects of the disclosure.
Figure 11B:
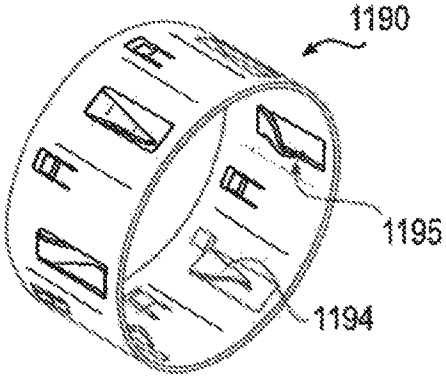
FIG. 11B is a perspective view of an exemplary grounding member in accordance with various aspects of the disclosure.
Figure 12B:
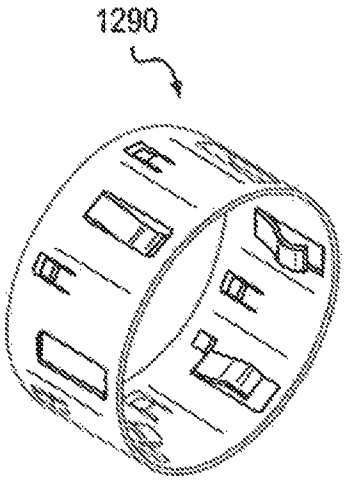
FIG. 12B is a perspective view of an exemplary grounding member in accordance with various aspects of the disclosure.
Figure 12A:
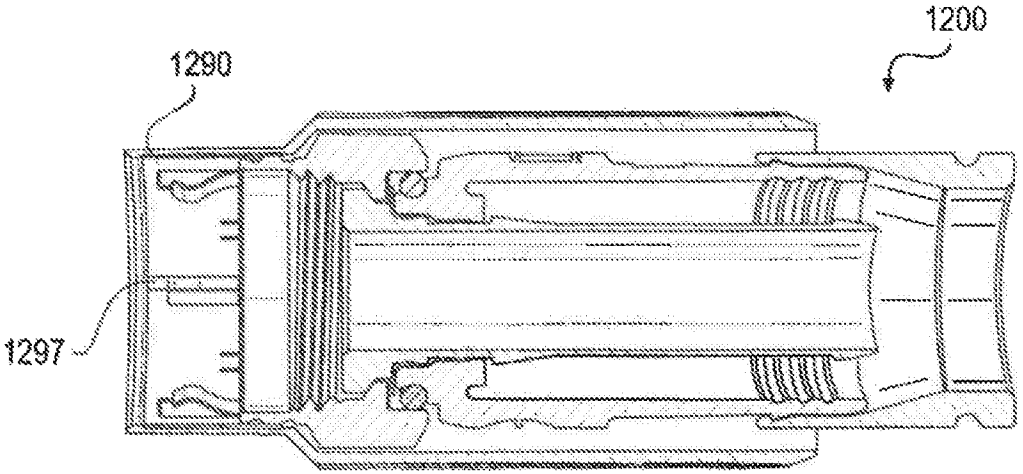
FIG. 12A is a side cross-sectional view of an exemplary connector in accordance with various aspects of the disclosure.
Figure 13B:
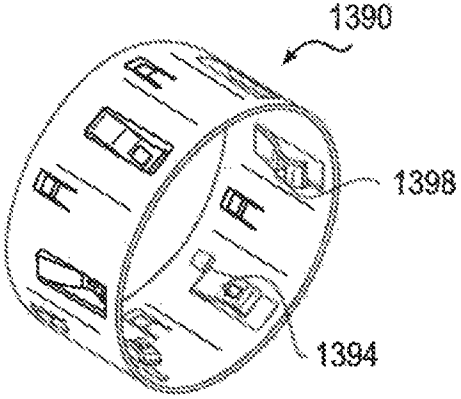
FIG. 13B is a perspective view of an exemplary grounding member in accordance with various aspects of the disclosure.
Figure 13A:
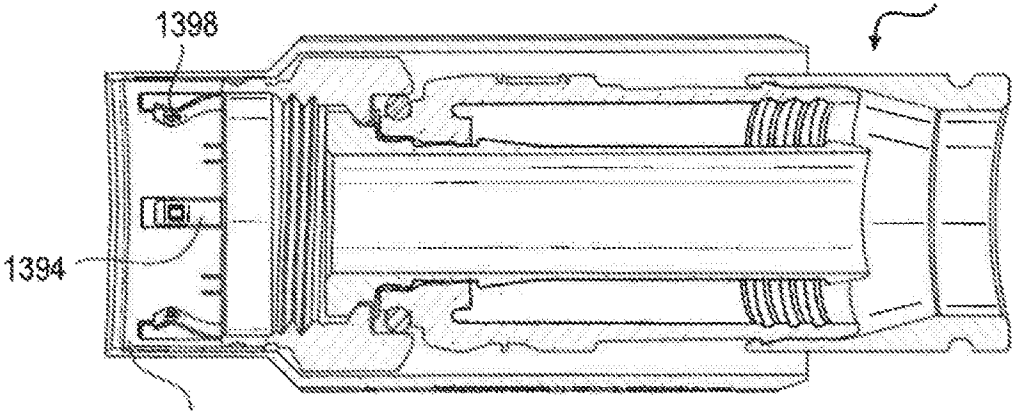
FIG. 13A is a side cross-sectional view of an exemplary connector in accordance with various aspects of the disclosure.
Figure 14B:
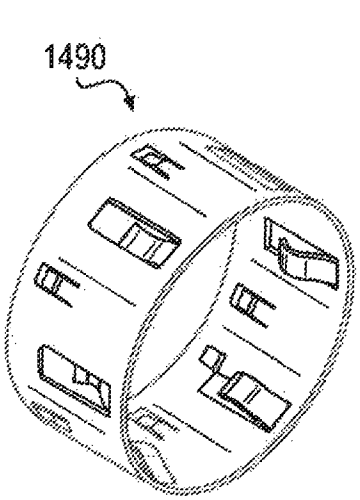
FIG. 14B is a perspective view of an exemplary grounding member in accordance with various aspects of the disclosure.
Figure 14A:
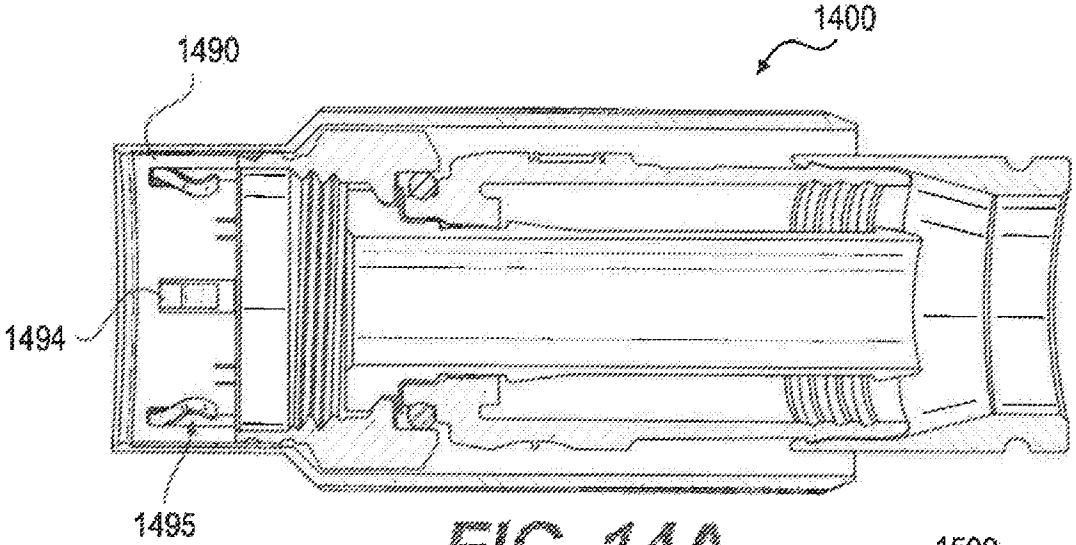
FIG. 14A is a side cross-sectional view of an exemplary connector in accordance with various aspects of the disclosure.
Figure 15B:
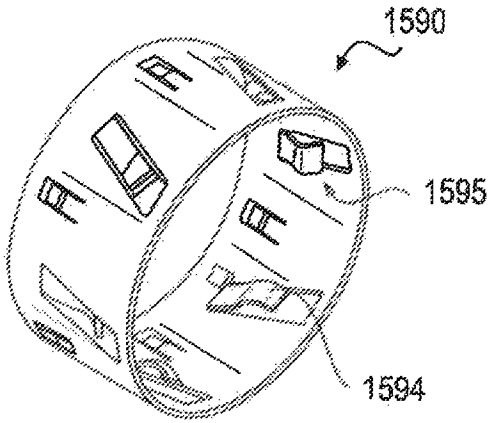
FIG. 15B is a perspective view of an exemplary grounding member in accordance with various aspects of the disclosure.
Figure 15A:
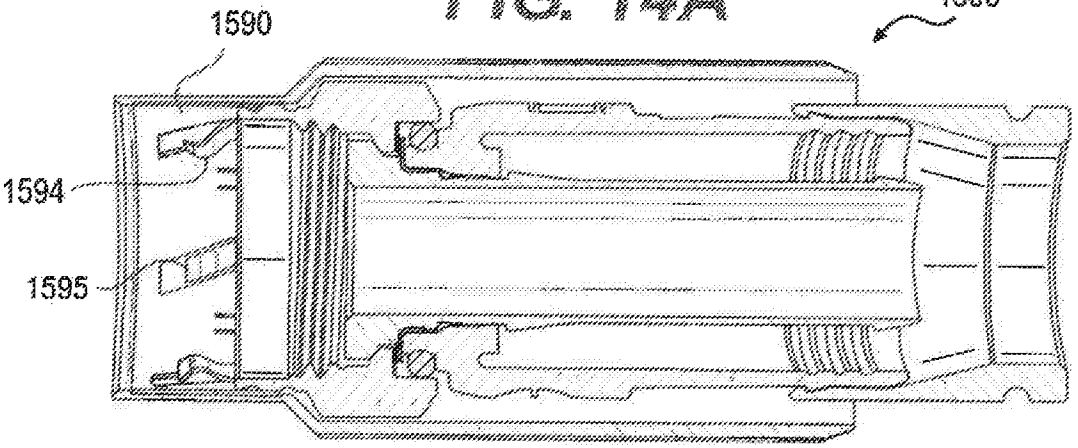
FIG. 15A is a side cross-sectional view of an exemplary connector in accordance with various aspects of the disclosure.
Figure 16A:
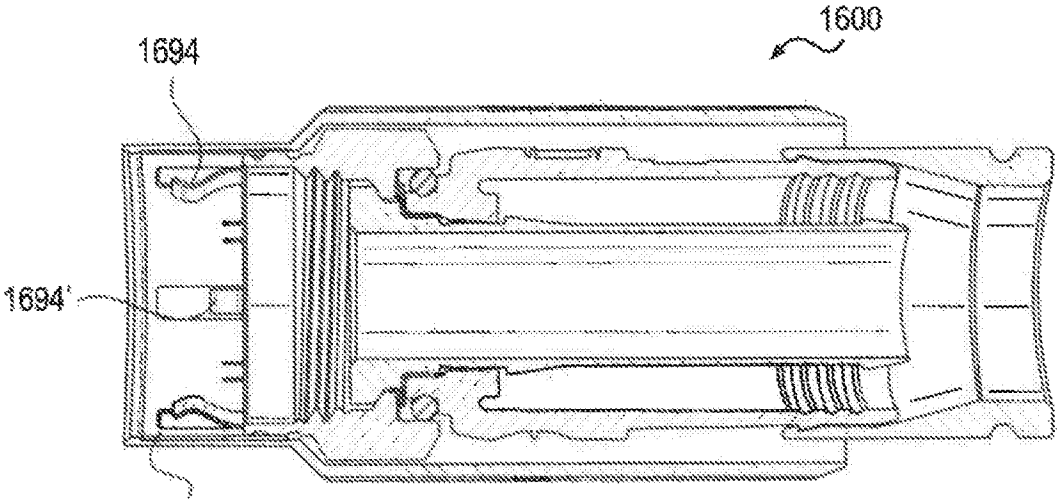
FIG. 16A is a side cross-sectional view of an exemplary connector in accordance with various aspects of the disclosure.
Figure 16B:
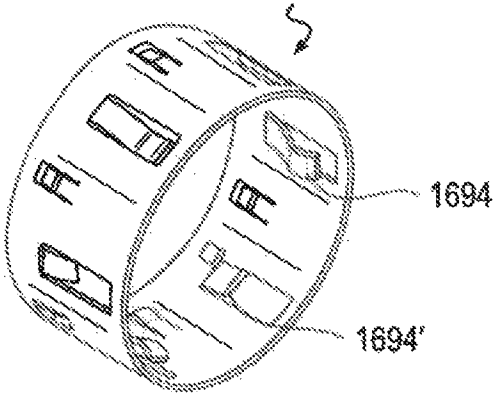
FIG. 16B is a perspective view of an exemplary grounding member in accordance with various aspects of the disclosure.
Figure 17A:
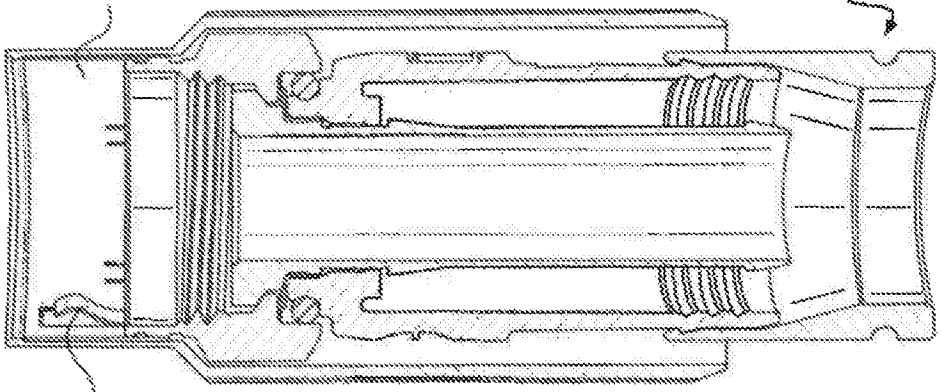
FIG. 17A is a side cross-sectional view of an exemplary connector in accordance with various aspects of the disclosure.
Figure 17B:
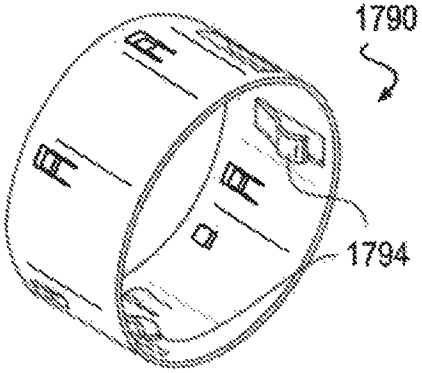
FIG. 17B is a perspective view of an exemplary grounding member in accordance with various aspects of the disclosure.

For example, FIGS. 7A and 7B illustrate an exemplary coaxial cable connector 700 and grounding member 790 similar to connector 600 and grounding member 690, but having continuity fingers 794 with free ends 795 that are rounded. FIGS. 8A and 8B illustrate an exemplary connector 800 and grounding member 890 similar to connector 600 and grounding member 690, but having continuity fingers 894 with free ends 895 that are alternatingly extending in the forward and rearward directions. FIGS. 9A and 9B illustrate an exemplary connector 900 and grounding member 990 similar to connector 600 and grounding member 690, but having trapezoidal continuity fingers 994 with triangular free ends 995 that include an inwardly directed barb 996. FIGS. 10A and 10B illustrate an exemplary connector 1000 and grounding member 1090 similar to connector 600 and grounding member 690, but having trapezoidal continuity fingers 1094 with triangular free ends 1095. FIGS. 11A and 11B illustrate an exemplary connector 1100 and grounding member 1190 similar to connector 600 and grounding member 690, but having triangular continuity fingers 1194 with free ends 1195. FIGS. 12A and 12B illustrate an exemplary connector 1200 and grounding member 1290 similar to connector 600 and grounding member 690, but include a plastic finger insert 1297. FIGS. 13A and 13B illustrate an exemplary connector 1300 and grounding member 1390 similar to connector 600 and grounding member 690, but include a reverse finger 1398 extending radially inward from an internal surface of the continuity fingers 1394. FIGS. 14A and 14B illustrate an exemplary connector 1400 and grounding member 1490 similar to connector 600 and grounding member 690, but having continuity fingers 1494 with free ends 1495 that extend in the rearward direction. FIGS. 15A and 15B illustrate an exemplary connector 1500 and grounding member 1590 similar to connector 600 and grounding member 690, but having continuity fingers 1594 that are helically arranged relative to the axial direction of the connector 1500 and have free ends 1595 that are angled to correspond with the helical arrangement. FIGS. 16A and 16B illustrate an exemplary connector 1600 and grounding member 1690 similar to connector 600 and grounding member 690, but having continuity fingers 1694, 1694' having different lengths. FIGS. 17A and 17B illustrate an exemplary connector 1700 and grounding member 1790 similar to connector 600 and grounding member 690, but having continuity fingers 1794 that are spaced unevenly about the circumference of the grounding member 1790.

Figure 18:
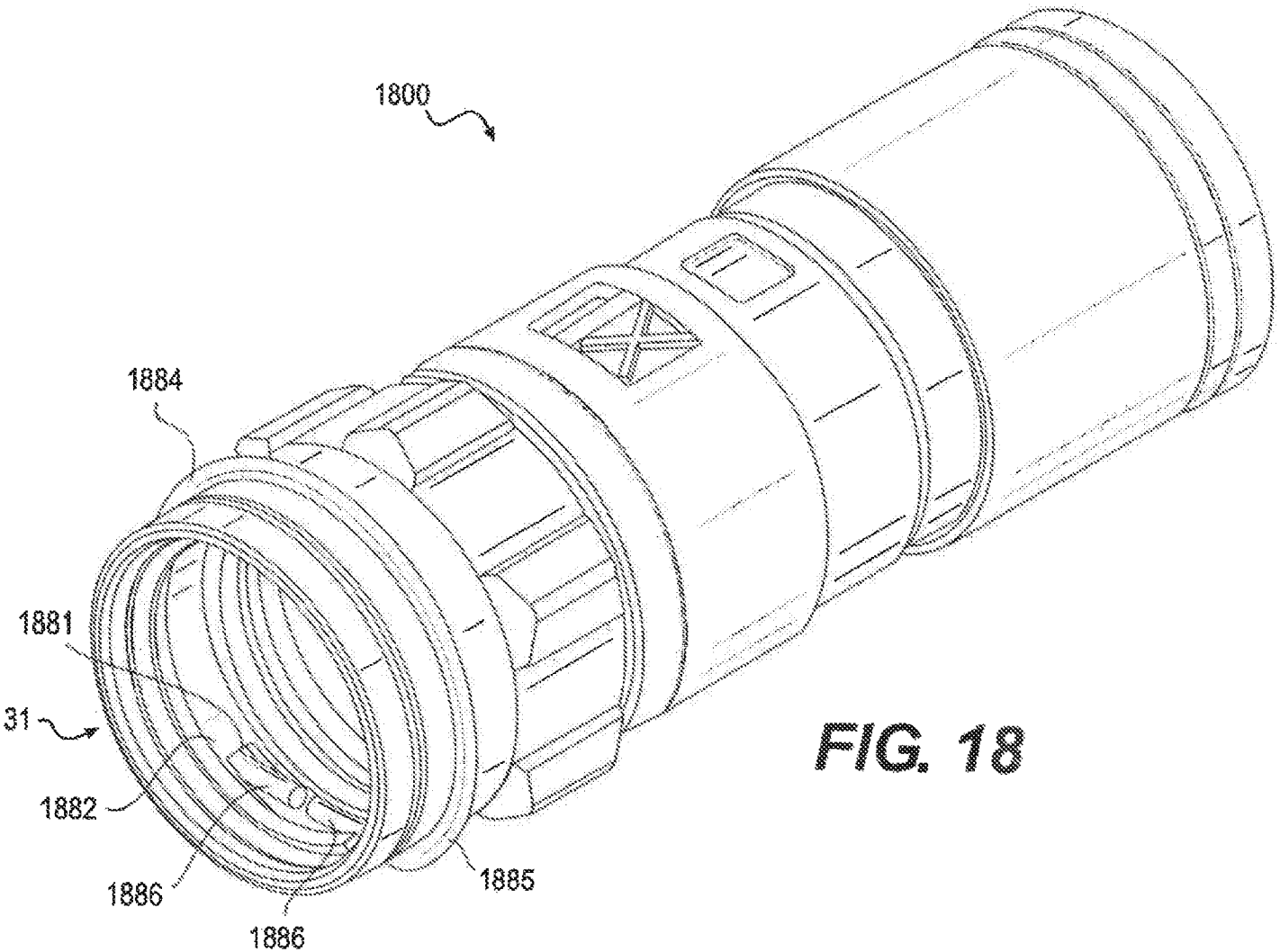
FIG. 18 is a perspective view of an exemplary connector in accordance with various aspects of the disclosure.
Figure 19B:
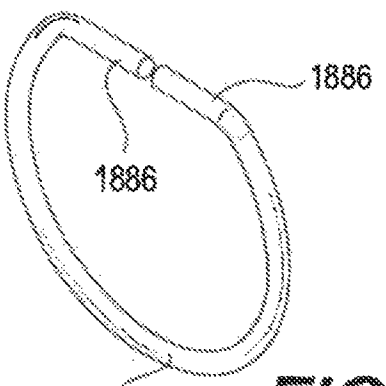
FIG. 19B is a perspective view of an exemplary clip in accordance with various aspects of the disclosure.
Figure 20B:
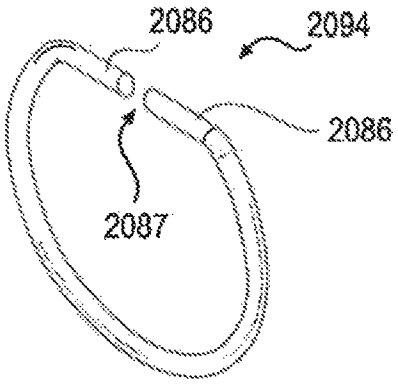
FIG. 20B is a perspective view of an exemplary clip in accordance with various aspects of the disclosure.
Figure 19A:
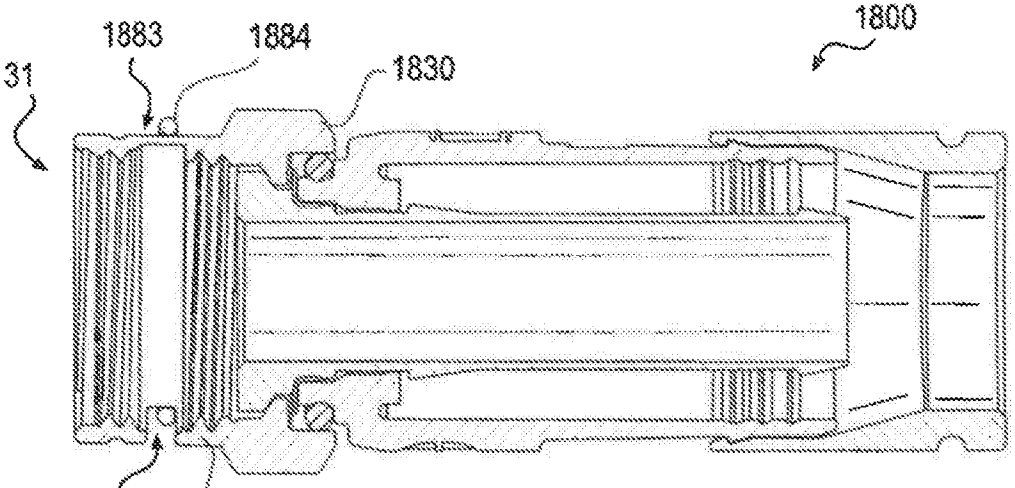
FIG. 19A is a side cross-sectional view of an exemplary connector in accordance with various aspects of the disclosure.

Referring now to FIGS. 18, 19A, and 19B, an exemplary coaxial cable connector 1800 and nut 1830 are illustrated. The nut 1830 may include a cross-cut 1881 through the wall 1182 of the nut 1830. The cross-cut 1881 may be disposed near to, but spaced from, the first forward end 31 of the nut 1830. For example, as shown in FIG. 19A, the cross-cut 1881 is at a middle region 1883 of the internal thread 73 along the axial direction. The cross-cut 1881 is configured to expose a portion of the threaded exterior surface 23 of the interface port 20 when the nut 1830 is coupled with the interface port 20. A clip 1884, such as, for example, a wire form, C-ring, or the like, can be coupled with the nut 1830 so as to extend through the cross-cut 1881 and into the interior of the nut 1830. For example, the clip 1884 may include a C-shaped region 1885 with straighten portions 1886 extending from both ends of the C-shaped region 1885. When the clip 1884 is coupled with the nut 1830, the straighten portions 1886 are aligned with the cross-cut 1881 such that the straighten portions 1886 maintain contact with the threaded exterior surface 23 of the port 20. In various aspects, the clip 1884 may be a metal stamping or a plastic finger that acts tangential to the mating interface port 20 and provides a force in the radial direction to maintain electrical ground between the nut 1830 and the threaded exterior surface 23 of the interface port 20. In the case of wire form or metal stamping, such a member can provide electrical continuity.

Figure 20A:
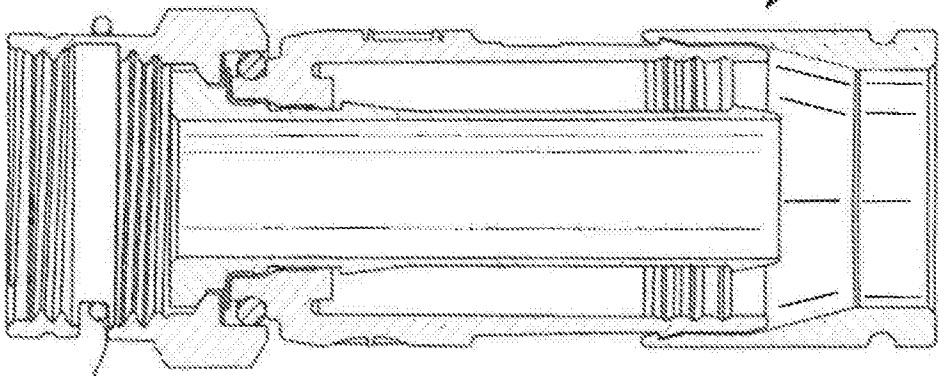
FIG. 20A is a side cross-sectional view of an exemplary connector in accordance with various aspects of the disclosure.
Figure 23B:
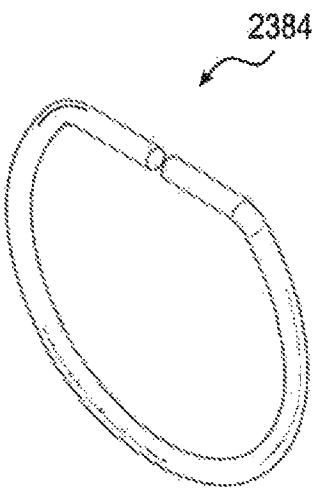
FIG. 23B is a perspective view of an exemplary clip in accordance with various aspects of the disclosure.
Figure 23A:
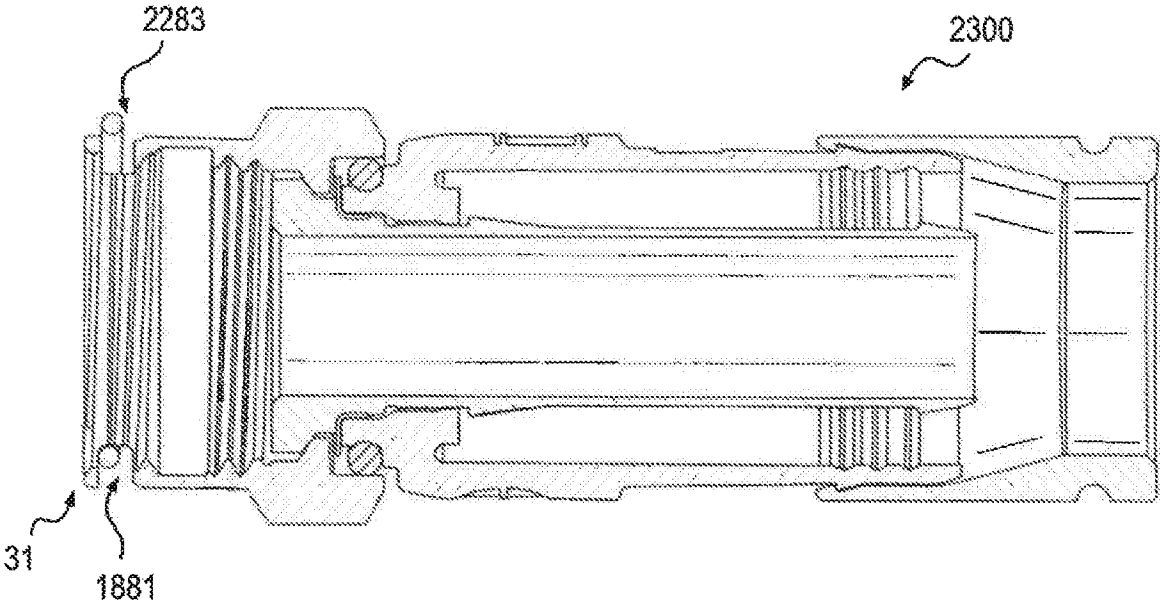
FIG. 23A is a side cross-sectional view of an exemplary connector in accordance with various aspects of the disclosure.

FIGS. 20A-23B illustrate a number of alternative embodiments similar to the connector 1800 and the clip 1884 of FIGS. 18-19B. For example, FIGS. 20A and 20B illustrate an exemplary connector 2000 having a clip 2084 configured as a locking clip, wherein the ends 2087 of the straightened portions 2086 are angled complementary to one another. FIGS. 21A and 21B illustrate an exemplary connector 2100 having a clip 2184 configured to have multiple points of contact with the interface port 20. For example, the clip 2184 includes two arcuate regions 2185A extending from opposite ends of a straight region 2185B. The two straighten portions 1886 extend from ends of the arcuate regions 2185A. In addition, the nut 2130 includes two cross-cuts 1881, 1881' configured to receive the straight portions 1886 and the straight region 2185B, respectively. FIGS. 22A and 22B illustrate an exemplary connector 2200 having a spiral or helical clip 2284 configured to have multiple points of contact with the interface port 20 staggered in the axial direction. For example, the clip 2284 includes two staggered ends 2286, and the nut 2130 includes two cross-cuts 1881, 1881' staggered in the axial direction of the connector 2200. The two cross-cuts 1881, 1881' are configured to receive the two respective staggered ends 2286. FIGS. 23A and 23B illustrate an exemplary connector 2300 having a clip 2384 similar to the connector 1800 and clip 1884. However, as shown in FIG. 23A, the cross-cut 1881 is disposed closer to the first forward end 31 of the connector 2300 compared to the cross-cut shown in FIG. 19A.

Figure 24:
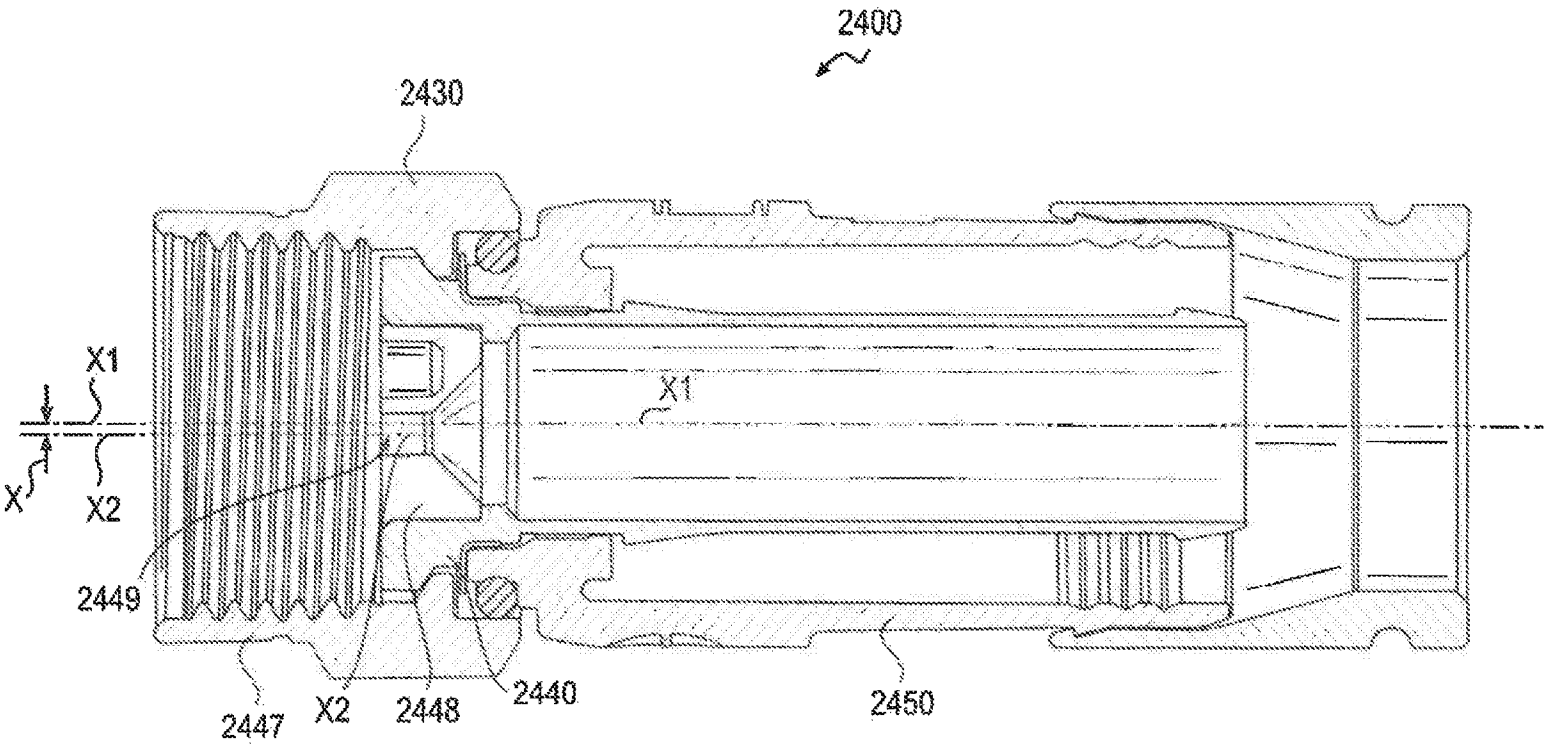
FIG. 24 is a side cross-sectional view of an exemplary connector in accordance with various aspects of the disclosure.

Referring to FIG. 24, an exemplary coaxial cable connector 2400 may be configured to align the coaxial cable off-center relative to the center of the mating interface port 20 to ensure that the nut 2430 of the connector 2400 will be biased toward one side and thus maintain ground between the nut 2430 and the interface port 20. For example, as shown in FIG. 24, an insert 2448, such as a plastic insert, may be placed inside the post 2440. The insert 2448 includes a though hole 2449 extending the longitudinal direction and configured to received the center conductor 18 of the coaxial cable 10. As illustrated in FIG. 24, axis X1 is the center axis of the connector 2400 (i.e., nut 2430, post 2440, and body 2450) extending in the longitudinal direction, while axis X2 is the center axis of the through hole 2449 of the insert 2448. Axis X1 and axis X2 are not concentric, but are offset by a distance X. Axis X1 and axis X2 may be parallel to one another or non-parallel, as long as they are not concentric. Of course, if axis X1 and axis X2 are non-parallel, the axes may intersect at a point.

As a result of the above configuration, the insert 2448, in particular, the off-center through hole 2449 urges at least the center conductor 18 of the coaxial cable 10 to the off-center position of axis X2. Thus, when the connector 2400 is coupled with the interface port 20, the center conductor 18 of the coaxial cable 10 is received by a female end of the interface port 20, while nut 2430 receives the interface port 20. Because the center conductor 18 is offset by distance X, the interface port 20 urges the cable 10, via the center conductor 18, in a direction from axis X2 toward axis X1. Thus, the side 2447 of the nut 2430 of the connector 2400 is urged toward the exterior threaded surface 23 at an adjacent side of the interface port 20 by the cable 10 being urged from axis X2 toward axis X1 via the center conductor 18. As a result of the off-center coaxial cable, or at least the center conductor 18 of the coaxial cable 10, the nut 2430 of the connector 2400 is biased to one side relative to the interface port 20 and creates radial interference between the nut 2430 and the interface port 20. Thus, the nut 2430 makes constant contact with the interface port 20 when mounted thereon, thus maintaining electrical continuity between the nut 2430 and the port 20 at all times, for example, even when the nut 2430 is not fully tightened to the interface port 20. Thus, even when the nut 2430 is loosely coupled (i.e., partially or loosely tightened) with the interface port 20, electrical ground between the nut 2430 and the interface port 20 can be maintained. In other embodiments according to the disclosure, the center conductor 18 may be offset by the nut 2430 or the post 2440, rather than by the plastic insert 2448.

Figure 25B:
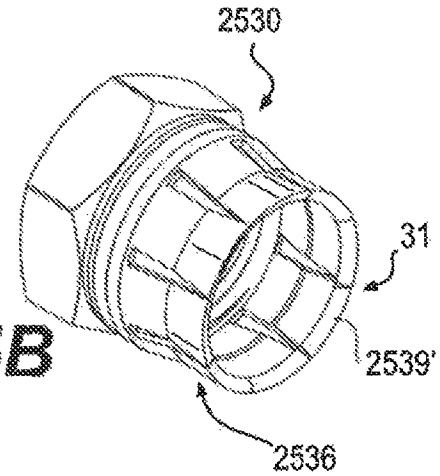
FIGS. 25B and 25C are a perspective view and a side cross-sectional view of an exemplary nut in accordance with various aspects of the disclosure.
Figure 25A:
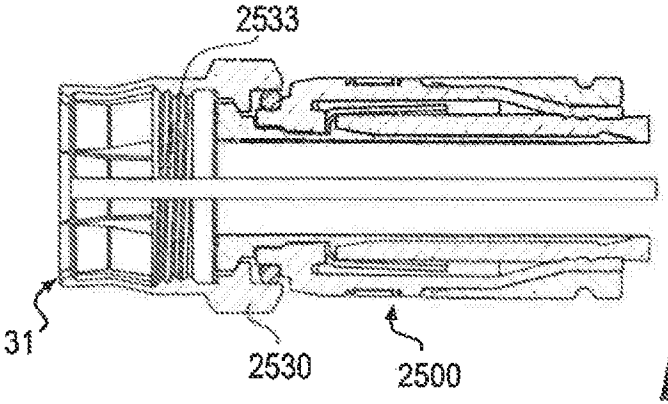
FIG. 25A is a side cross-sectional view of an exemplary connector in accordance with various aspects of the disclosure.
Figure 25C:
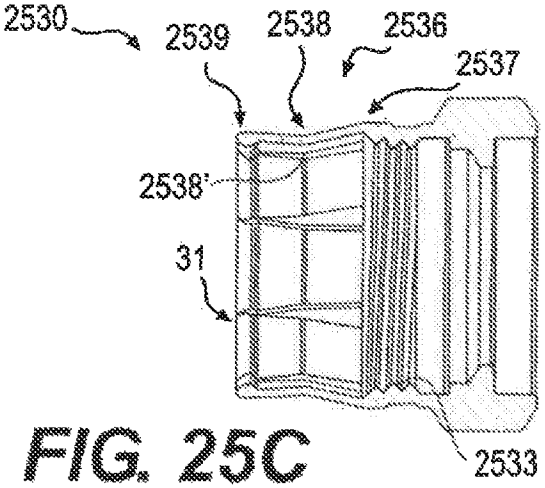

Referring now to FIGS. 25A through 26B, an exemplary coaxial cable connector 2500 is illustrated. The connector 2500 may include redundant port grounding contacts in addition to threads. For example, a nut 2530 may be provided with extended contact fingers formed in a way that promotes redundant contact, higher retention forces, and continuous port grounding even when loosely connected to an interface port. As shown in FIGS. 25A-25C, the connector 2500 includes the nut 2530 having internal threading 2533 spaced axially from the edge of first forward end 31 and configured to provide operably effective threadable contact with the external threads 23 of the standard coaxial cable interface port 20.

As illustrated is FIGS. 25A through 26B, the nut 2530 may include a front portion 2536, for example, forward of the internal threading 2533 in the axial direction, that tapers from a first diameter at a rearward end portion 2537 to a second smaller diameter at a middle portion 2538. The front portion 2536 may then flare out from the middle portion 2538, thereby defining a bend point 2538', to a front end portion 2539 at the first forward end 31. The front portion 2536 may include a tooth 2539*a* having a curved front end 2539*b* with a predetermined radius and flat angle at the rear end 2539*c*. The front portion 2536 is crimped down to a final desired diameter. In some embodiments, the front portion 2536 may be slotted to form a plurality of fingers 2539'. The one or more fingers 2539' have sufficient resiliency to radially deflect outward to receive the interface port therein. However, the bent fingers 2539' remain biased radially inward to maintain constant contact with the interface port 20 at all times, for example, even when the nut 2530 is not fully tightened to the interface port 20. Thus, even when the nut 2530 is loosely coupled (i.e., partially tightened) with the interface port 20, electrical ground between the nut 2530 and the interface port 20 is maintained.

Figures 26A, 26B:
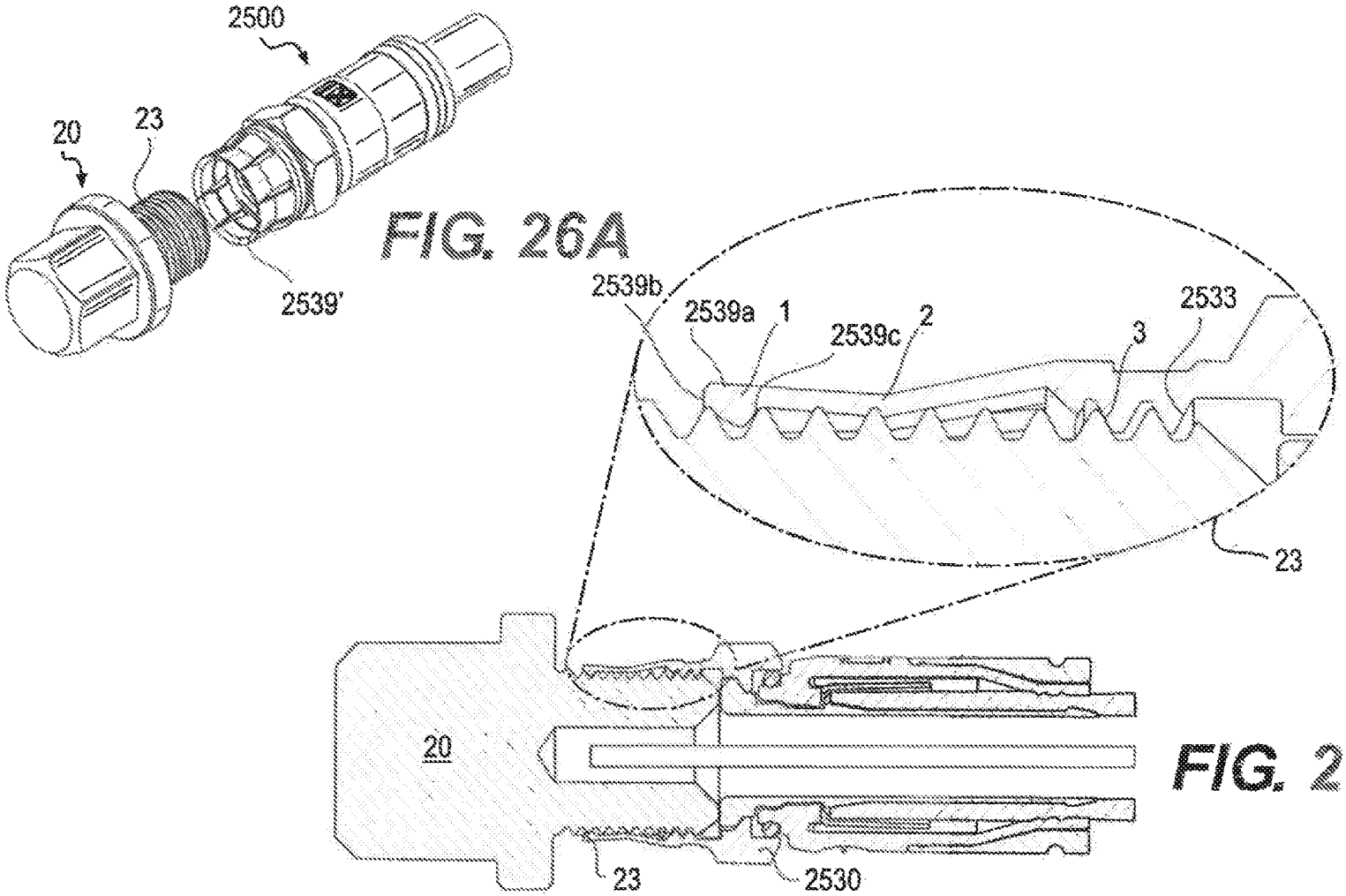
FIGS. 26A and 26B are a perspective view and a side cross-sectional view of the exemplary connector of FIG. 25A coupled with an interface port.
Figure 27A:
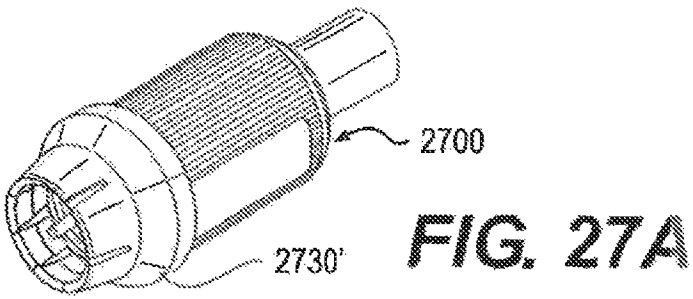
FIGS. 27A and 27B are a perspective view and a side cross-sectional view of an exemplary connector in accordance with various aspects of the disclosure.
Figure 27B:
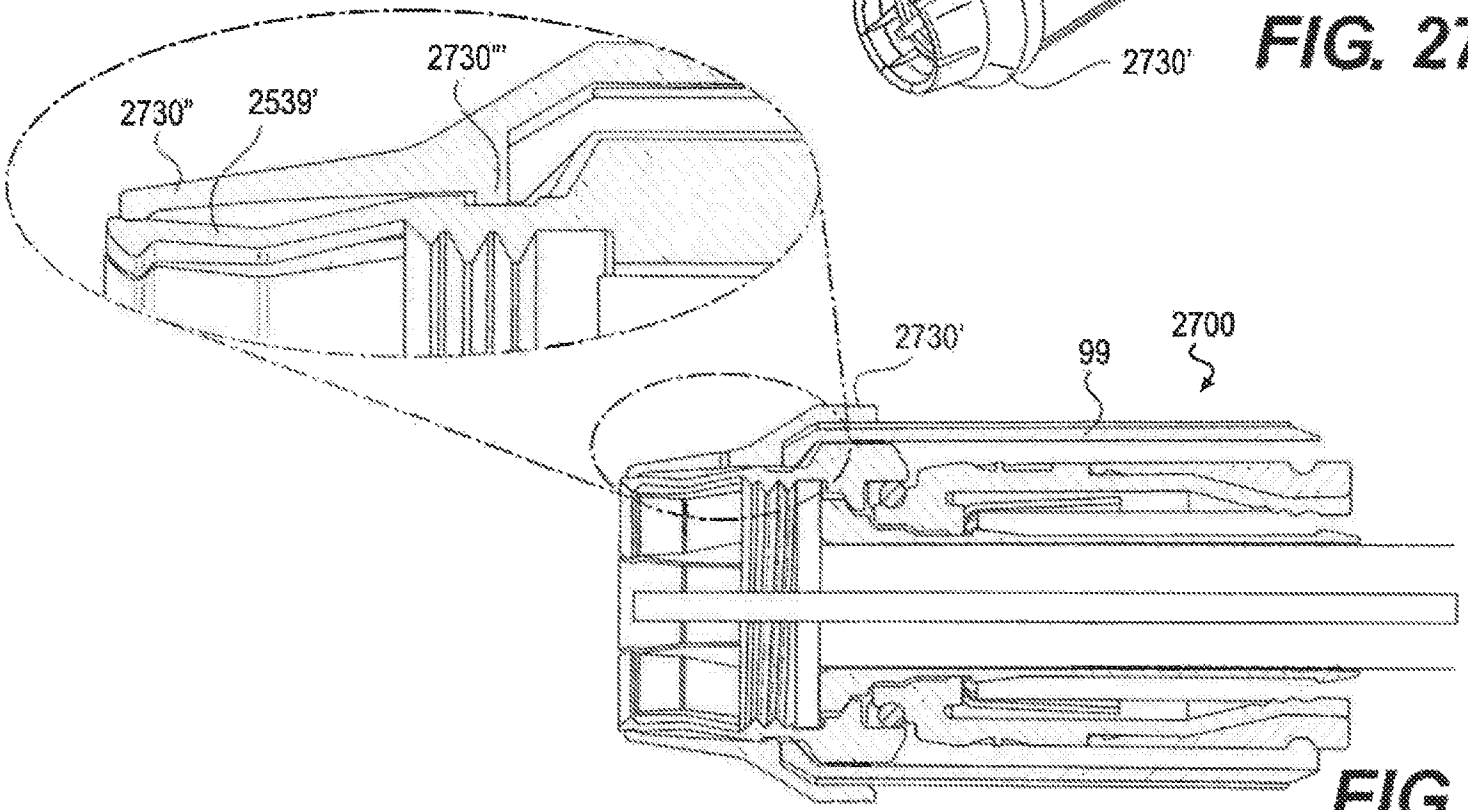
Figure 28B:
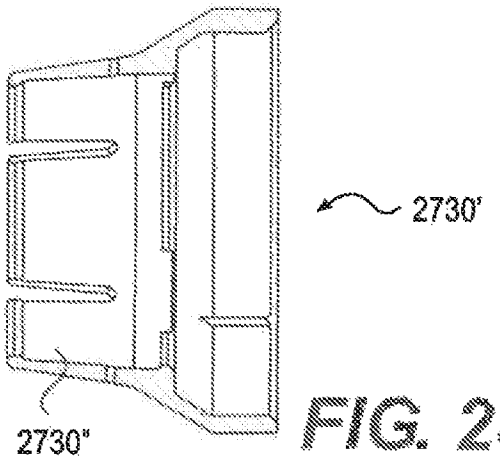
FIGS. 28A and 28B are a perspective view and a side cross-sectional view of an exemplary cap in accordance with various aspects of the disclosure.
Figure 28A:
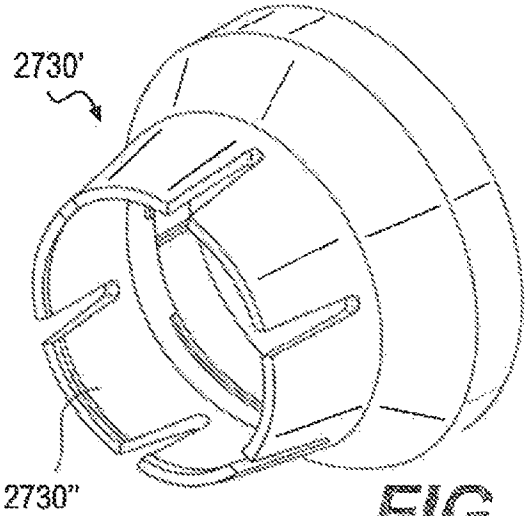

As shown in FIG. 26B, when the nut 2530 is coupled with the interface port 20, the front portion 2536 provides a first contact point with the external threads 23 of the port 20, the bend point 2538' at the middle portion 2538 of the fingers 2539' provides a second contact point (midway along the contact fingers 2539') with the external threads 23 of the port 20, and the internal threading 2533 provides a third contact point with the external threads 23 of the port 20. The first and second contact point may further reduce the chance of losing ground contact, even when the connector 2500 is only loosely or partially coupled with the interface port 20 (i.e., when the internal threading 2533 is not coupled with the external threads 23 or is only loosely or partially coupled with the external threads 23).

The curved front end 2539*b* of the front contact tooth 2539*a* is configured to allow the tooth 2539*a* to ride over the threads 23 of the interface port 20 when installed on the port 20. Thus, the connector 2500 facilitates easy insertion of the port 20 into the front portion 2536 of the connector 2500. On the other hand, the flat angle at the rear end 2539*c* of the tooth 2539*a* is configured to engage a surface of the thread 23 of the port 20, thereby making removal of the connector 2500 from the interface port 20 (e.g., by pulling off) more difficult. It should be appreciated that the nut 2530 may be a brass plus nut machined at a longer length with the front portion 2536.

Referring now to FIGS. 27A through 28B, an exemplary coaxial cable connector 2700 is illustrated. The connector 2700 may be similar to the connector 2500 described with reference to FIGS. 25A through 26B, but may include a cap 2730', for example, a tapered cap, that assembles over the nut 2530 having extended contact fingers 2539'. The cap 2730' may be configured to provide added spring force and protection for coupling with the interface port 20.

As illustrated in FIGS. 27A through 28B, the cap 2730' may be configured as a nose-cone/tapered cap and assembled over the nut 2530 that has the extended contact fingers 2539'. The one or more fingers 2539' have sufficient resiliency to radially deflect outward to receive the interface port 20 therein. However, the bent fingers 2539' remain biased radially inward to maintain constant contact with the interface port 20 at all times, for example, even when the nut 2530 is not fully tightened to the interface port 20. Thus, even when the nut 2530 is loosely coupled (i.e., partially tightened) with the interface port 20, electrical ground between the nut 2530 and the interface port 20 is maintained. The cap 2730' may be, for example, an injection molded sleeve with tapered front members 2730". The tapered front members 2730" overlie the fingers 2539' of the nut 2530 and thereby compound the radial inward force of the fingers 2539'. The cap 2730' may also serve to protect the fingers 2539' of the nut 2530.

In some aspects, mechanical engagement of the cap 2730' to the connector 2700 may use, but is not limited to, inner diameter snap tabs 2730'" that are molded into the cap 2730' and fall into one or more grooves 2530*a* on the outer diameter of the nut 2530. The cap 2730' may also be attached by a press fit, with or without knurls, to the nut 2530 and/or to an existing torque member 99 so that the cap 2730' and the nut 2530 rotate uniformly. Other methods of attachment may include threads or the displacement of material to pinch the cap 2730' in place, such as a rolled edge.

Figure 29:
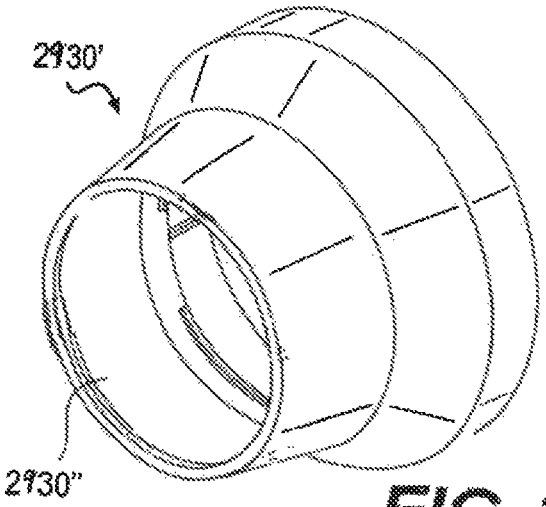
FIG. 29 is a perspective view of another exemplary cap in accordance with various aspects of the disclosure.
Figures 30A, 30B, 30C, 30D, 30E:
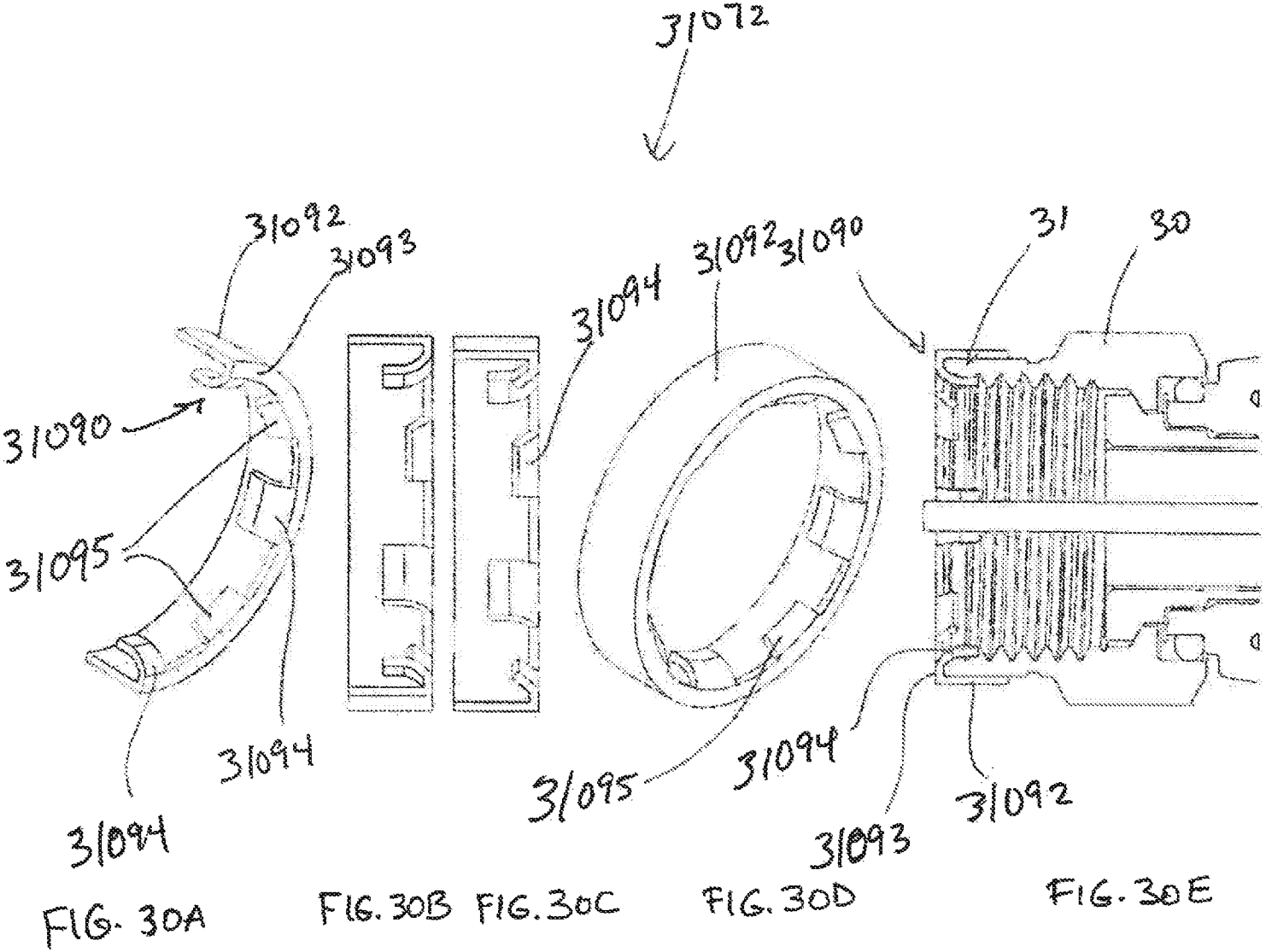
FIG. 30A is a perspective and cross-sectional view of an exemplary grounding member in accordance with various aspects of the disclosure.
FIGS. 30B and 30C are cross-sectional views of the exemplary grounding member of FIG. 30A.
FIG. 30D is a perspective view of the exemplary grounding member of FIG. 30A.
FIG. 30E is a cross-sectional view of the exemplary grounding member of FIG. 30A assembled on a connector.
Figures 31A, 31B, 31C, 31D, 31E, 31F:
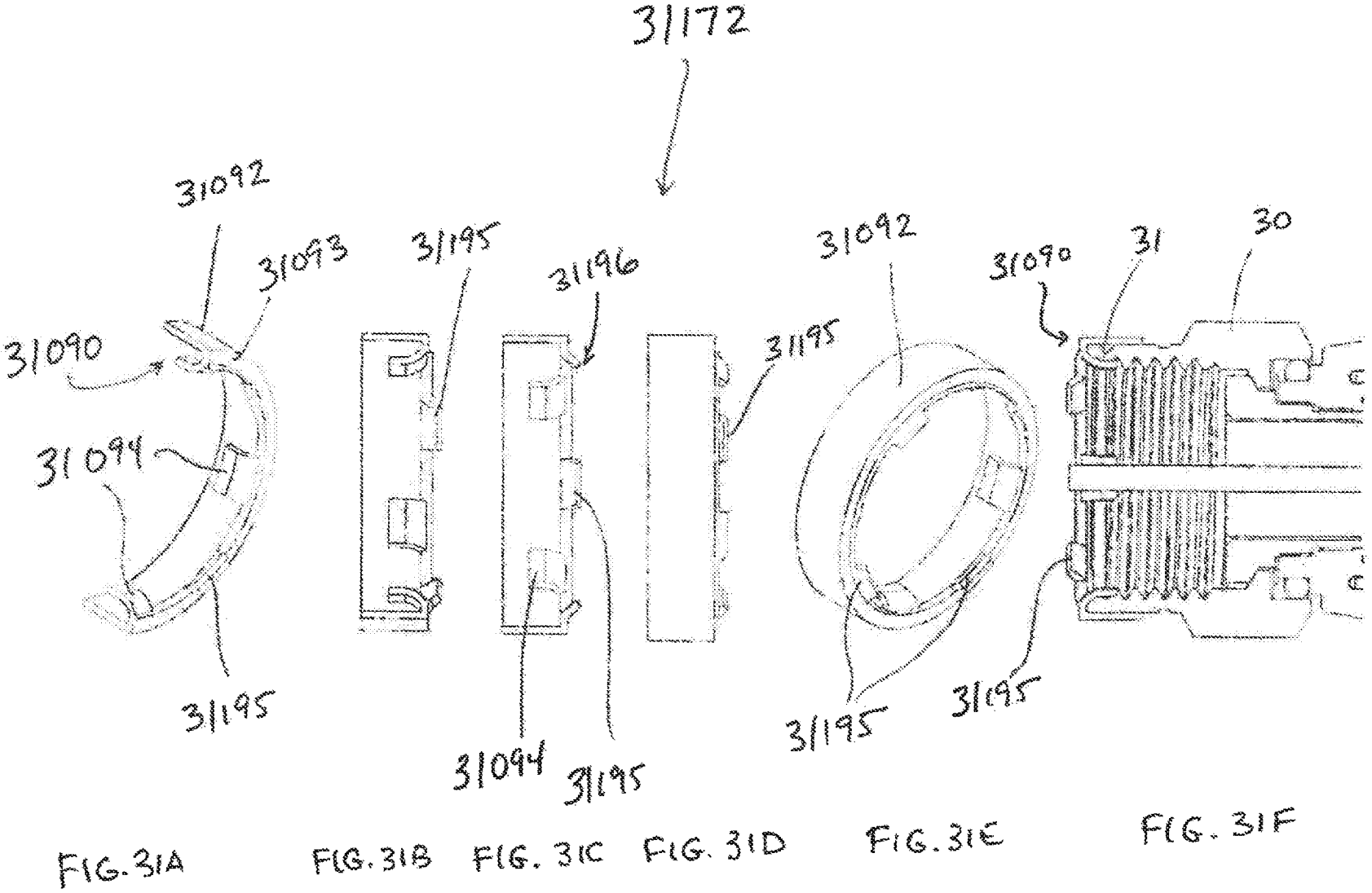
FIG. 31A is a perspective and cross-sectional view of an exemplary grounding member in accordance with various aspects of the disclosure.
FIGS. 31B and 31C are cross-sectional views of the exemplary grounding member of FIG. 31A.
FIGS. 31D and 31E are perspective and side views of the exemplary grounding member of FIG. 31A.
FIG. 31F is a cross-sectional view of the exemplary grounding member of FIG. 31A assembled on a connector.

FIG. 29 illustrates an alternative cap 2930' configured to be assembled over the nut 2530. As shown, the cap 2930' includes a frustoconical nose cone 2930" at its forward end. The cap 2930' is configured to provide increased resistance against radially outward deflection of the fingers 2539' of the nut 2530, including when the nut is coupled with the interface port 20.

Similar to cap 2730', the cap 2930' may be configured as a nose-cone/tapered cap and assembled over the nut 2530 that has the extended contact fingers 2539'. The one or more fingers 2539' have sufficient resiliency to radially deflect outward to receive the interface port 20 therein. However, the cap 2930' maintains the bent fingers 2539' biased radially inward to maintain constant contact with the interface port 20 at all times, for example, even when the nut 2530 is not fully tightened to the interface port 20. Thus, even when the nut 2530 is loosely coupled (i.e., partially tightened) with the interface port 20, electrical ground between the nut 2530 and the interface port 20 is maintained. The cap 2930' may be, for example, an injection molded sleeve, and the frustoconical nose cone 2930" overlies the fingers 2539' of the nut 2530 and thereby resists a radial outward force of the fingers 2539'. The cap 2930' may also serve to protect the fingers 2539' of the nut 2530. The cap 2930' may be attached to the nut 2530 is any conventional manner.

While a metal snap spring may be provided to add spring pressure to the nut 2530, a nose cone style cap 2730', 2930' may provide additional benefits in a more aesthetical manner and may be incorporated with an existing torque sleeve 99. For example, a plastic support finger may be molded as part of the torque sleeve 99. Consequently, a more ergonomic look and feel may be achieved, while simplifying assembly.

It should be appreciated that, despite the number of slots and fingers that are illustrated in FIGS. 25A though 28B, connectors according to this disclosure could have any number of slots and fingers as desired. Of course, at a minimum, two slots are needed to create at least one finger. Also, the slots and fingers may be symmetrically arranged or asymmetrically arranged. Exemplary connectors can include an even number of fingers or an odd number of fingers. Also the depth and width of the slots and fingers, as well as the cross-sectional thickness and taper of the fingers may be varied as desired.

While conventional "RCA style" contact fingers do not have any retention adders, and rely solely on friction between the port and a smooth surface, the connectors 2500, 2700 described above with reference to FIGS. 25A through 28B provide a higher retention force while keeping insertion force low. As a result, these connectors 2500, 2700 help to keep the connector on the interface port 20 in the case that no threads are engaged or in the case that the threads are only loosely or partially engaged.

Referring now to FIGS. 30A-30E, an exemplary conductive insert 31072 in accordance with various aspects of the disclosure is illustrated. As shown in FIGS. 2A-2E, the conductive insert 31072 may include a securing portion 31090 configured to be coupled to the forward end 31 of the nut 30. The securing portion 31090 includes an annular ring 31092 sized to fit about an outer periphery of the forward end 31 of the nut 30 and a forward wall 31093 that extends radially inward from the annular ring 31092. The securing portion 31090 includes a plurality of securing fingers 31094 that extend rearward in the axial direction from the forward wall 31093 to wrap back inside the forward end 31 of the nut 30 to secure the securing portion 31090 to the forward end 31 of the nut 30. When the securing portion 31090 is coupled with the nut 30, the forward wall 31093 of the conductive insert 31072 is disposed forward relative to the forward end 31 of the nut 30.

The securing portion 31090 also includes a plurality of grounding fingers 31095 that extend inward from the forward wall 31093 beyond an inner surface of the securing fingers 31094. As illustrated, the grounding fingers 31095 extend radially inward and rearward at an angle relative to the radial direction of the conductive insert 31072 and the nut 30. The conductive insert 31072 is secured to the forward end 31 of the nut 30 by the securing portion 31090. The securing portion 31090 restricts axial motion of the conductive insert 31072 relative to the nut 30 while permitting rotation of the nut 30 relative to the conductive insert 31072.

As illustrated, the grounding fingers 31095 extend radially inward beyond threads of the internal threading 33 of the nut 30. Thus, when coupled with the threaded exterior surface 23 of the coaxial cable interface port 20, the grounding fingers 31095 promote redundant contact, higher retention forces, and continuous grounding from the interface port 20 through to the post 40, even when the nut 30 is loosely connected (i.e., not fully tightened) to the interface port 20.

Referring now to FIGS. 31A-31F, an exemplary conductive insert 31172 in accordance with various aspects of the disclosure is illustrated. The conductive insert 31172 is substantially the same as the conductive insert 31072 described above, except for the orientation of the grounding fingers 31195. In particular, the grounding fingers 31195 extend radially inward and forward at an angle relative to the radial direction of the conductive insert 31172 and the nut 30. Thus, a radially innermost portion 31196 of each of the grounding fingers 31195 is forward of the forward end 31 and the internal threading 33 of the nut 30.

As a result, the grounding fingers 31195 can make contact with the interface port 20 before the center conductor 18 in order to create a ground from the interface port 20 through to the post 40 and thus limit burst that would otherwise occur upon insertion of the center conductor 18 into the interface port 20 in the absence of a ground. Further, when coupled with the threaded exterior surface 23 of the coaxial cable interface port 20, the grounding fingers promote redundant contact, higher retention forces, and continuous grounding from the interface port 20 through to the post 40, even the nut 30 is when loosely connected (i.e., not fully tightened) to the interface port 20. As a result, the conductive insert 31172 insures that the grounding fingers 31195 can make contact with the interface port 20 before the center conductor 18 when the connector 100 is coupled with the interface port 20 in order to create a ground from the interface port 20 through to the post 40 and thus limit burst that would otherwise occur upon insertion of the center conductor 18 into the interface port 20 in the absence of a ground.

Figure 32:
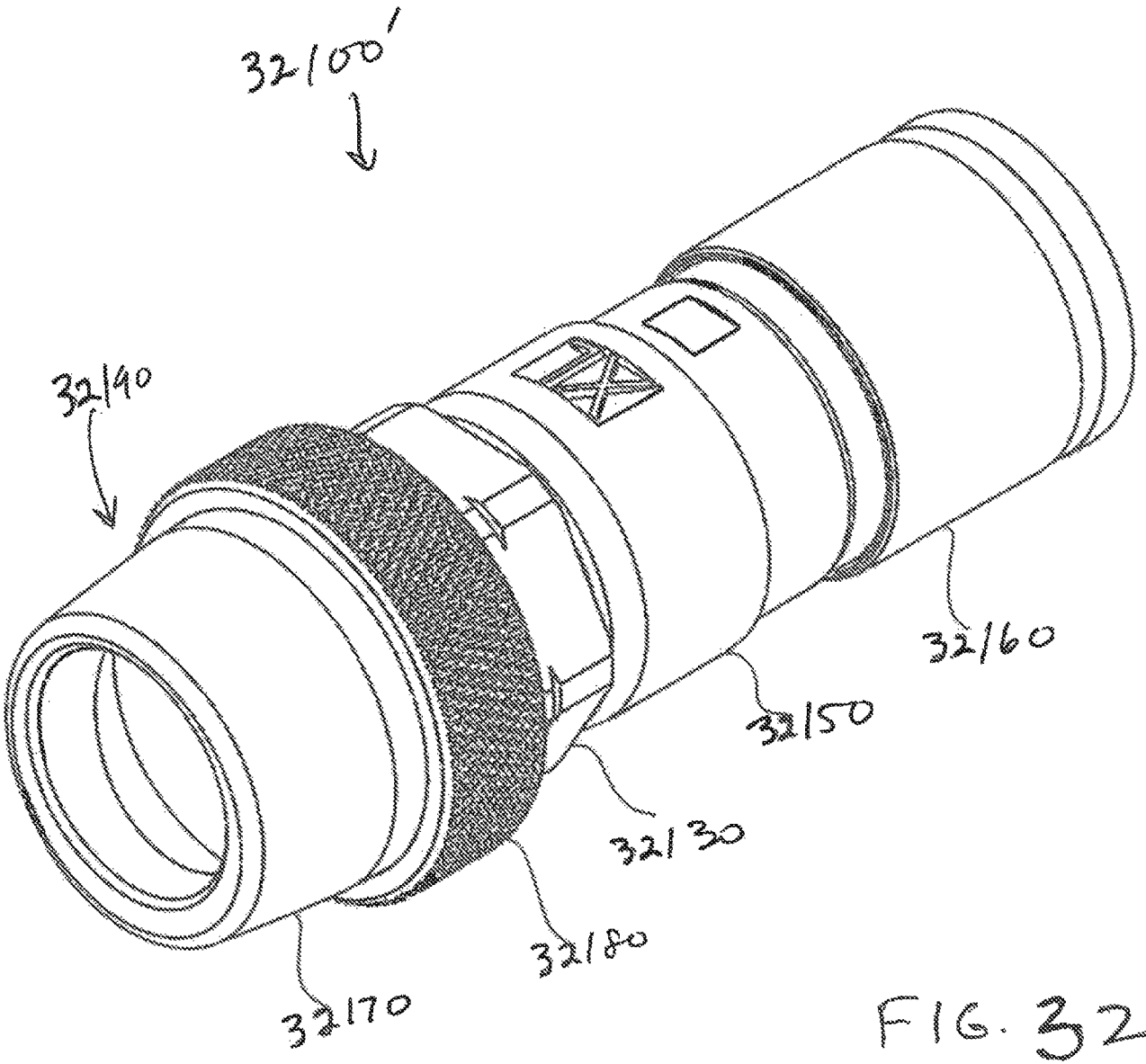
FIG. 32 is a perspective view of an exemplary coaxial cable connector in accordance with various aspects of the disclosure.
Figure 33:
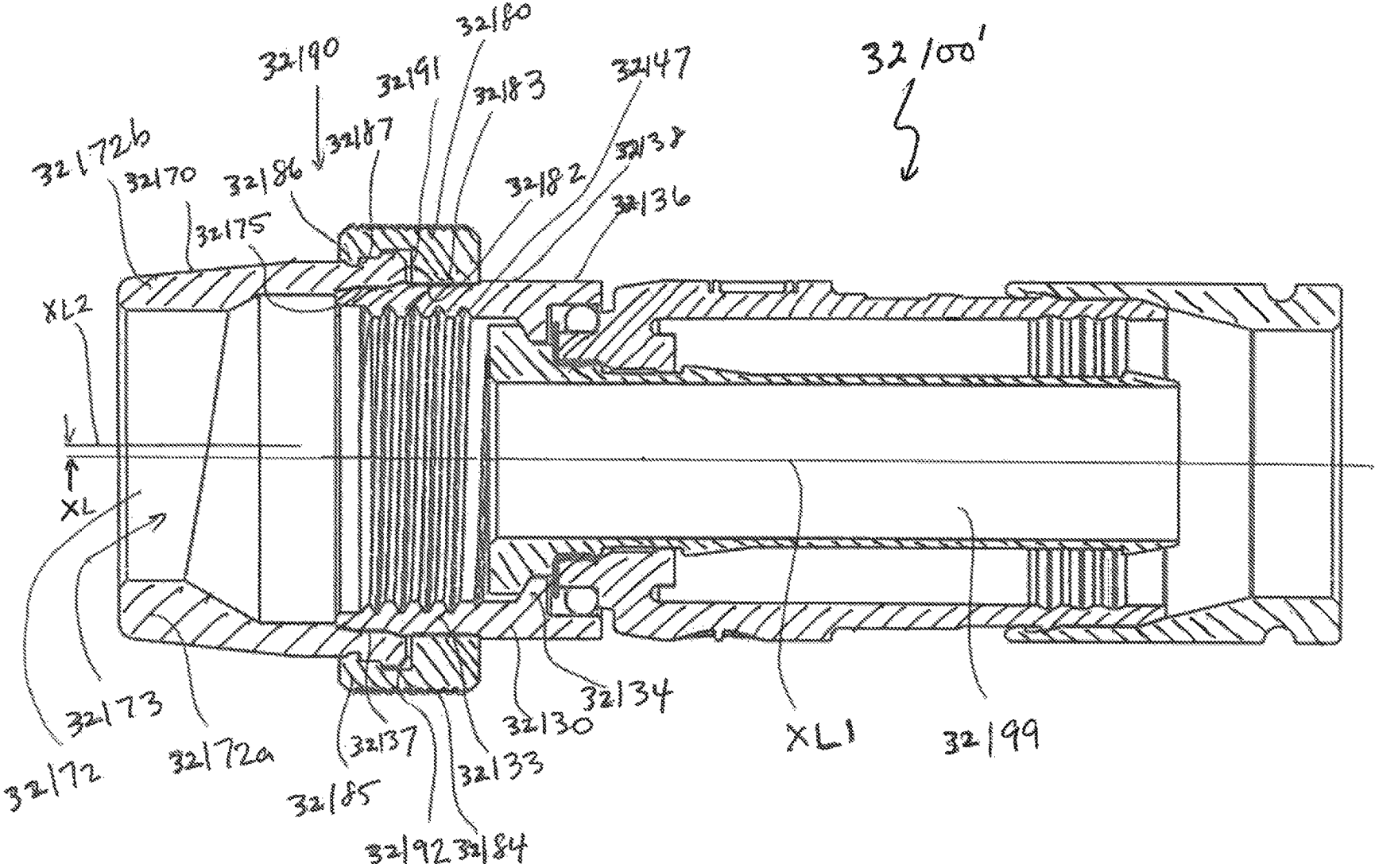
FIG. 33 is a side cross-sectional view of the exemplary coaxial cable connector of FIG. 32.
Figure 34:
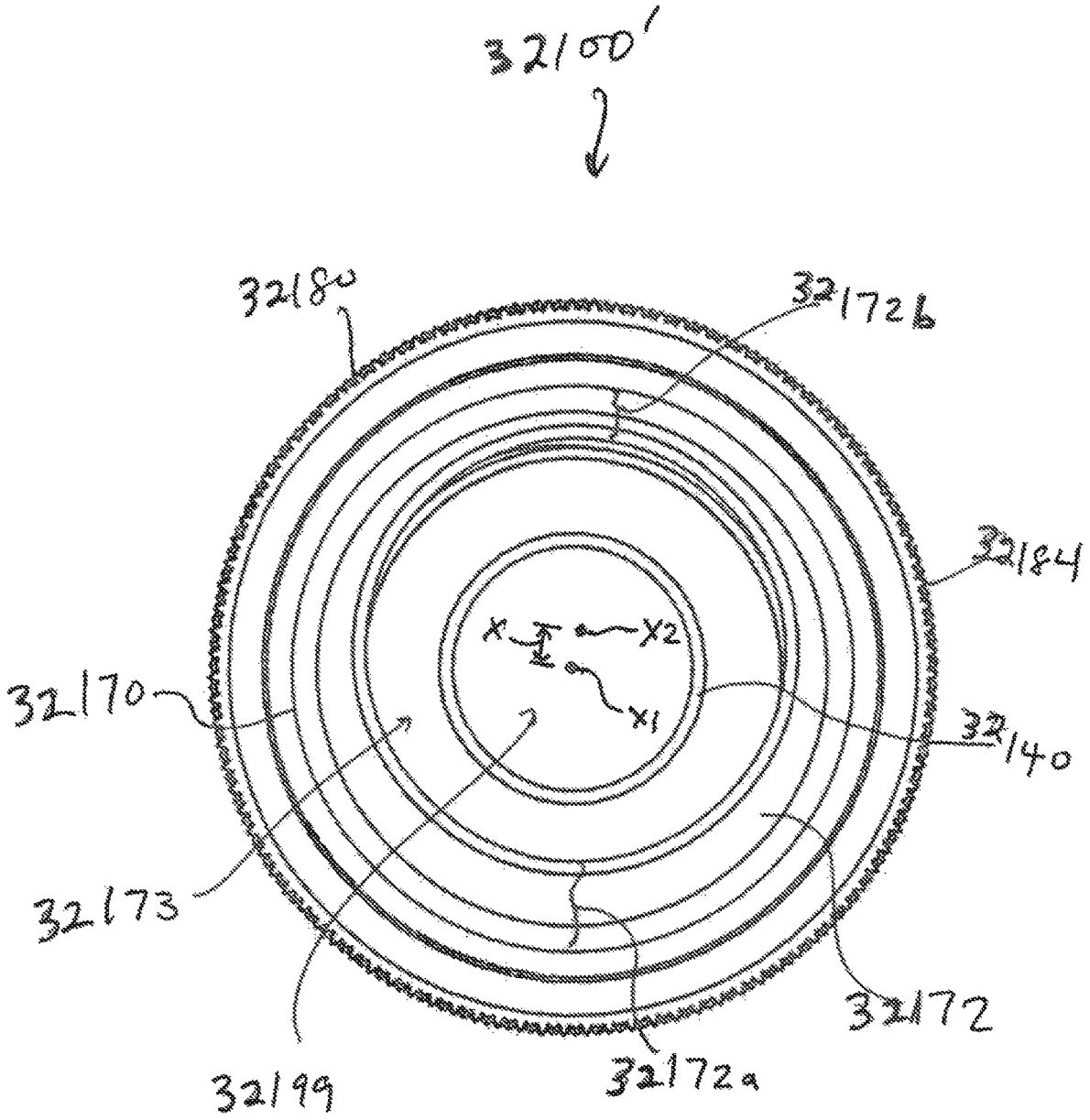
FIG. 34 is a front view of the exemplary coaxial cable connector of FIG. 32.

With reference to the connector embodiment illustrated in FIGS. 32-34, for ease of description, the coaxial cable system components such as connectors, termination devices, filters and the like, referred to and illustrated herein will be of a type and form suited for connecting a coaxial cable or component, used for CATV or other data transmission, to an externally threaded port having a ⅜ inch-32 UNEF 2A thread. Those skilled in the art will appreciate, however, that many system components include a rotatable, internally threaded nut that attaches the component to a typical externally threaded port, the specific size, shape and component details may vary in ways that do not impact the invention per se, and which are not part of the invention per se. Likewise, the externally threaded portion of the port may vary in dimension (diameter and length) and configuration. For example, a port may be referred to as a "short" port where the connecting portion has a length of about 0.325 inches. A "long" port may have a connecting length of about 0.500 inches. All of the connecting portion of the port may be threaded, or there may be an unthreaded shoulder immediately adjacent the threaded portion, for example. In all cases, the component and port must cooperatively engage. According to the embodiments of the present invention, a sealing relationship is provided for the otherwise exposed region between the component connector and the externally threaded portion of the port.

As shown in FIGS. 32 and 33, an exemplary embodiment of the disclosure is directed to a seal assembly 32190 for use with a coaxial connector 32100', similar to the conventional coaxial connector 100 described above. The seal assembly 32190 includes a nut 32130, a seal 32170, and a seal ring 32180.

As shown in FIG. 3, the exemplary seal 32170 has a generally tubular body that is elastically deformable by nature of its material characteristics and design. The seal 32170 may include a nonconductive elastomer and/or a conductive elastomer. The nonconductive elastomer may be made of, for example, an elastomeric material having suitable chemical resistance and material stability (i.e., elasticity) over a temperature range between about −40° C. to +40° C. A typical material can be, for example, silicone rubber. Alternatively, the material may be propylene, a typical O-ring material. Other materials known in the art may also be suitable. The interested reader is referred to http://www.applerubber.com for an exemplary listing of potentially suitable seal materials. The conductive elastomer may be an elastomeric material containing conductive fillers such as, for example, carbon, nickel, and/or silver.

The body of seal 32170 has an anterior end 32188 and a posterior end 32189, the anterior end 32188 being a free end for ultimate engagement with an interface port, while the posterior end 32189 is for ultimate connection to the nut component 32130 of the seal assembly 32190. The seal 32170 has a forward sealing surface 32173, a rear sealing portion 32174 including an interior sealing surface 32175 that integrally engages the nut component 32130, and an integral joint-section 32176 intermediate the anterior end 32188 and the posterior end 32189 of the tubular body. The forward sealing surface 32173 at the anterior end of the seal 32170 may include annular facets to assist in forming a seal with the port or may be a continuous rounded annular surface that forms effective seals through the elastic deformation of the internal surface and end of the seal compressed against the port. The integral joint-section 32176 includes a portion of the length of the seal which is relatively thinner in radial cross-section than the forward sealing surface 32173 to encourage an outward expansion or bowing of the seal upon its axial compression.

The nut component 32130 of the seal assembly 32190, illustrated by example in FIG. 33, has an interior surface, at least a portion 32133 of which is threaded, a connector-grasping portion 32134 (e.g., a lip), and an exterior surface 136 including a seal-grasping surface portion 32137. In an aspect, the seal-grasping surface 32137 can be a flat, smooth surface or a flat, roughened surface suitable to frictionally and/or adhesively engage the interior sealing surface 32175 of the seal 32170. The exterior surface 32136 further includes a nut-turning surface portion 32138. In some aspects, the nut-turning surface portion 32138 may have at least two flat surface regions that allow engagement with the surfaces of a tool such as a wrench. Typically, the nut-turning surface in this aspect will be hexagonal. Alternatively, the nut turning surface may be a knurled surface to facilitate hand-turning of the nut component.

The seal ring 32180 of the seal assembly 32190 has an inner surface 32182 and an outer surface 32184. The inner surface 32182 includes a posterior portion 32183 having a diameter such that the seal ring 32180 is slid over the exterior surface 32136 of the nut component 32130 and creates a press-fit against the exterior surface 32136 of the nut component 32130. The rear sealing portion 32174 of the seal 32170 may include an exterior sealing surface 32177 that is configured to integrally engage the seal ring 32180. The sealing surface 32177 is an annular surface on the exterior of the tubular body. For example, the seal 32170 may have a ridge 32178 at the posterior end 32189 which defines a shoulder 32179. The inner surface 32182 of the seal ring 32180 may include a seal-grasping portion 32185. In an aspect, the seal-grasping portion 32185 can be a flat, smooth surface or a flat, roughened surface suitable to frictionally and/or adhesively engage the exterior sealing surface 32177 of the seal 32170. In an aspect, the seal-grasping portion 32185 may include a ridge 32186 that defines a shoulder 32187 that is suitably sized and shaped to engage the shoulder 32179 of the ridge 32178 of the posterior end 32189 of the seal 32170 in a locking-type interference fit as illustrated in FIG. 33.

Upon engagement of the seal 32170 with the seal ring 32180, a posterior sealing surface 32191 of the seal 32170 abuts a side surface 32192 of the nut 32130 as shown in FIG. 33 to form a sealing relationship in that region. In its intended use, compressive axial force may be applied against one or both ends of the seal 32170 depending upon the length of the port intended to be sealed. The force will act to axially compress the seal whereupon it will expand radially, for example, in the vicinity of the integral joint-section 32176. In an aspect, the integral joint-section 32176 is located axially asymmetrically intermediate the anterior end 32188 and the posterior end 32189 of the tubular body, and adjacent an anterior end of the exterior sealing surface 32177, as illustrated. However, it is contemplated that the joint-section 32176 can be designed to be inserted anywhere between sealing surface 32175 and anterior end 32188. The seal is designed to prevent the ingress of corrosive elements when the seal is used for its intended function.

It should be appreciated that the connector 32100' may be used with various types of ports 20. For example, the connector 32100' may be used with a short port, a long port, or an alternate long port. A short port refers to a port having a length of external threads that extends from a terminal end of the port to an enlarged shoulder that is shorter than a length that the seal 32170, in an uncompressed state, extends beyond a forward end of the nut 32130. When connected to a short port, the seal 32170 is axially compressed between a forward facing surface of the seal ring 32180 and the enlarged shoulder of the short port. Posterior sealing surface 32191 is axially compressed against side surface 32192 of nut 32130, and the end face of forward sealing surface 32173 is axially compressed against the enlarged shoulder, thus preventing ingress of environmental elements between the nut 32130 and the enlarged shoulder of the port 20.

A long port refers to a port having a length of external threads that extends from a terminal end of the port to an unthreaded portion of the port having a diameter that is approximately equal to the major diameter of external threads. The unthreaded portion then extends from the external threads to an enlarged shoulder. The length of the external threads in addition to the unthreaded portion is longer than the length that the seal 32170, in an uncompressed state, extends beyond a forward end of the nut 32130. When connected to a long port, the seal 32170 is not axially compressed between a forward facing surface of the seal ring 32180 and the enlarged shoulder of the short port. Rather, the internal sealing surface 32175 is radially compressed against the seal grasping surface 32137 of the nut 32130 by the seal ring 32180, and the interior portions of the forward sealing surface 32173 are radially compressed against the unthreaded portion of the long port, thereby preventing the ingress of environmental elements between the nut 32130 and the unthreaded portion of the long port. The radial compression of the forward sealing surface 32173 against the unthreaded portion of the port is created by an interference fit. An alternate long port refers to a port that is similar to a long port but where the diameter of the unthreaded portion is larger than the major diameter of the external threads.

As described above, in some embodiments, the forward sealing surface 32173 of the seal 32170 may include a conductive elastomer, and the forward sealing surface 32173 is forward of the center conductor 18. Therefore, regardless of the size of the port, the conductive elastomer of the seal 32170 can make contact with the interface port 20 before the center conductor 18 in order to create a ground from the interface port 20 through to the post 40, by way of the conductive elastomer and the nut 32130, and thus limit burst that would otherwise occur upon insertion of the center conductor 18 into the interface port 20 in the absence of a ground. Furthermore, the conductive elastomer of the seal 32170 provides port continuity and RF shielding, even when the nut 32130 is loosely connected (i.e., not fully tightened) to the interface port 20.

With reference to FIGS. 33 and 34, the exemplary coaxial cable connector 32100' is configured to align the coaxial cable 10 off-center relative to the center of the mating interface port 20 to ensure that the nut 32130 of the connector 32100' will be biased toward one side and thus maintain ground between the nut 32130 and the interface port 20. For example, as shown in FIGS. 33 and 34, the anterior end 32188 of the tubular body of the seal 32170 includes a port engagement portion 32172 having a radial thickness that varies about its circumference. For example, the port engagement portion 32172 has a thickness that varies from a maximum thickness 32172*a* to a minimum thickness 32172*b* that are diametrically opposed to one another. The thickness of the port engagement portion 32172 gradually and continuously decreases from the maximum thickness 32172*a* to the minimum thickness 32172*b* in both circumferential directions extending from the location of the maximum thickness 32172*a*. The anterior end 32188 of the tubular body of the seal 32170 defines a through hole 32173 extending the longitudinal direction and configured to receive the center conductor 18 of the coaxial cable 10.

The nut 32130, the post 32140, and the body 32150 define a through hole 32199 extending in the longitudinal direction and configured to receive the center conductor 18 of the coaxial cable 10. As illustrated in FIG. 3, axis XL1 is the center axis of the through hole 32199 defined by the nut 32130, the post 32140, and the body 32150 extending in the longitudinal direction, while axis XL2 is the center axis of the through hole 32173 of the anterior end 32188 of the tubular body of the seal 170. Axis XL1 and axis XL2 are not concentric, but are offset by a distance XL. Axis XL1 and axis XL2 may be parallel to one another or non-parallel, as long as they are not concentric. Of course, if axis XL and axis XL2 are non-parallel, the axes may intersect at a point.

As a result of the above configuration, the anterior end 32188 of the tubular body of the seal 32170, in particular, the off-center through hole 32199 urges at least the center conductor 18 of the coaxial cable 10 to the off-center position of axis XL2. Thus, when the connector 32100' is coupled with the interface port 20, the center conductor 18 of the coaxial cable 10 is received by a female end of the interface port 20, while nut 32130 receives the interface port 20. Because the center conductor 18 is offset by distance XL, the interface port 20 urges the cable 10, via the center conductor 18, in a direction from axis XL2 toward axis XL1. Thus, a side 32147 of the nut 32130 of the connector 32100' is urged toward the exterior threaded surface 23 at an adjacent side of the interface port 20 by the cable 10 being urged from axis XL2 toward axis XL1 via the center conductor 18. As a result of the off-center coaxial cable, or at least the center conductor 18 of the coaxial cable 10, the nut 32130 of the connector 32100' is biased to one side relative to the interface port 20 and creates radial interference between the nut 32130 and the interface port 20. Thus, the nut 32130 is urged to make contact with the interface port 20 whenever mounted thereon, thus maintaining electrical grounding between the nut 32130 and the port 20 at all times, for example, even when the nut 32130 is not fully tightened to the interface port 20. Thus, even when the nut 32130 is loosely coupled (i.e., partially or loosely tightened) with the interface port 20, electrical ground between the nut 32130 and the interface port 20 can be maintained.

Figure 35:
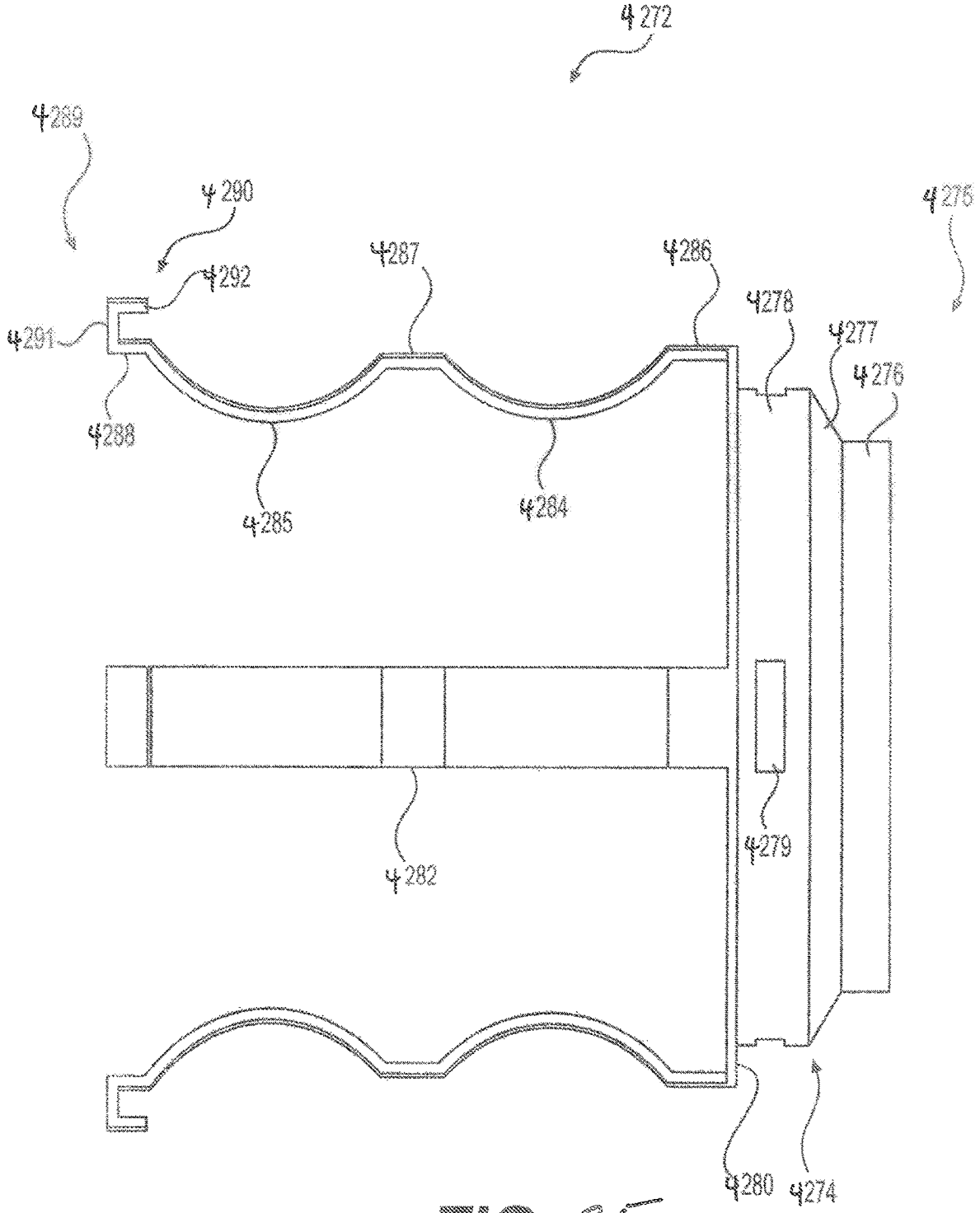
FIG. 35 is a side view of an exemplary conductive insert in accordance with various aspects of the disclosure.
Figure 36:
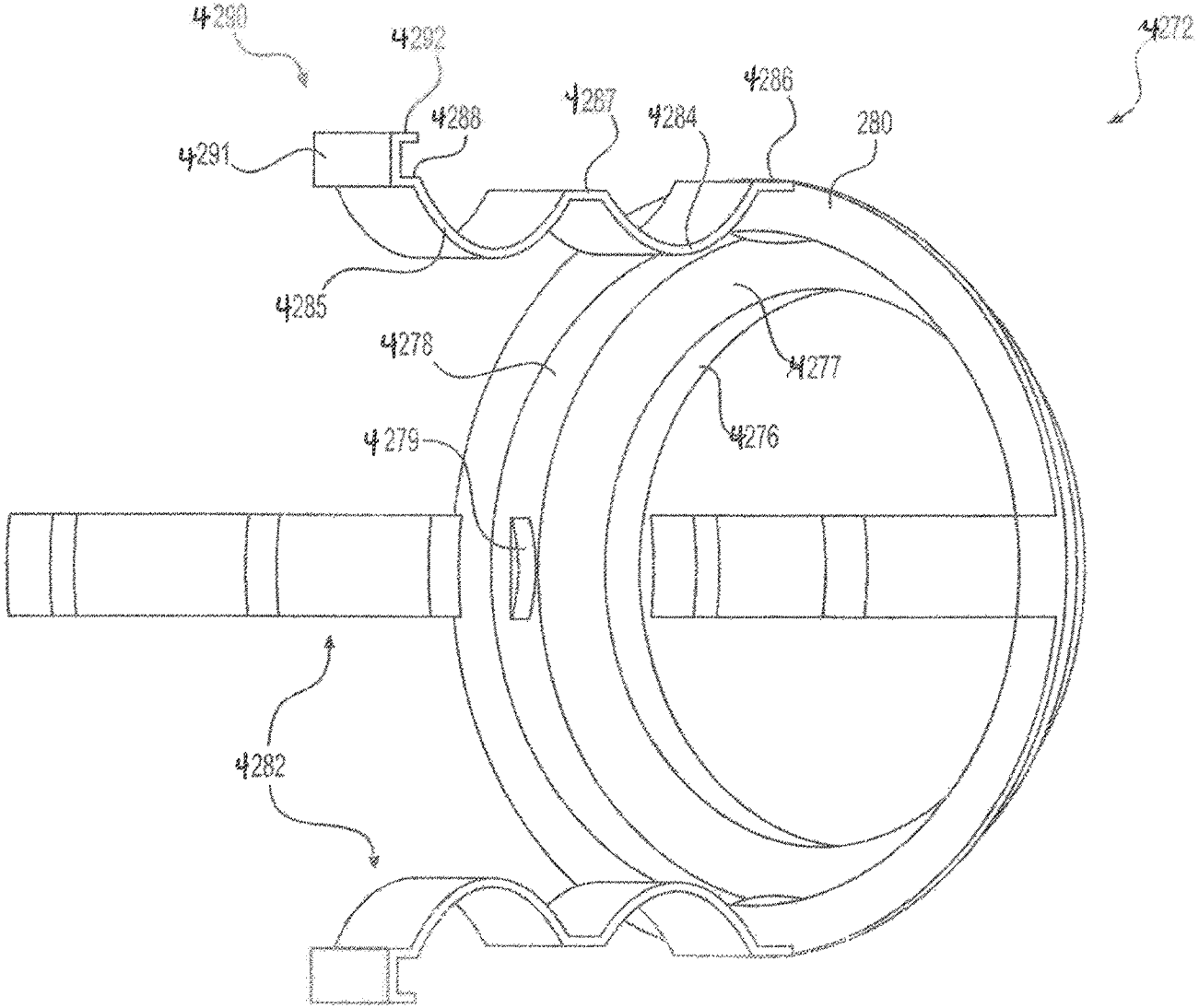
FIG. 36 is a side-front perspective view of the conductive insert of FIG. 35.
Figure 37:
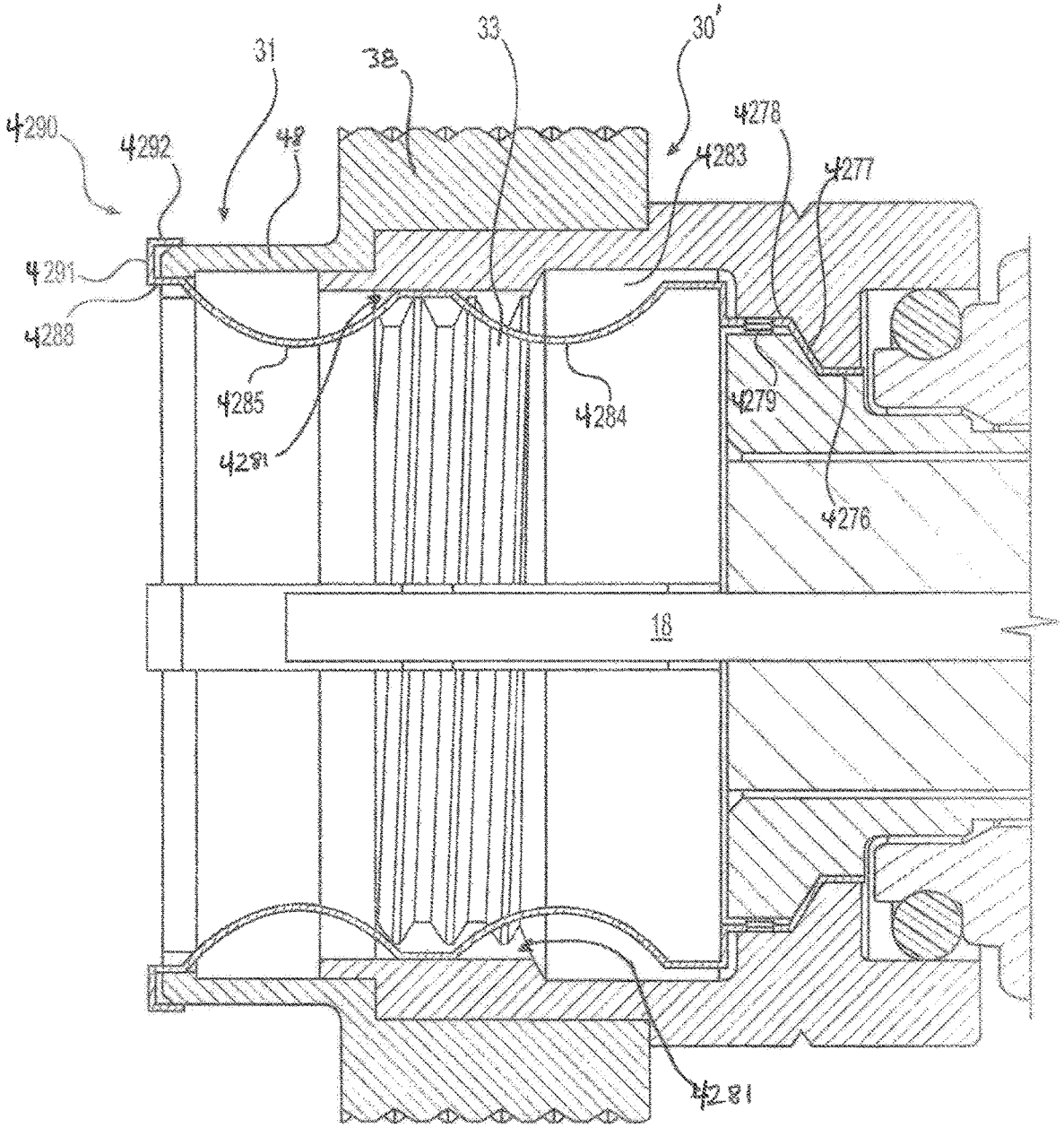
FIG. 37 is a side cross-sectional view of the conductive insert of FIG. 35 coupled with a coaxial connector.

Referring now to FIGS. 35-38, an exemplary conductive insert 4272 in accordance with various aspects of the disclosure is illustrated. As shown in FIG. 35, the conductive insert 4272 may have an annular ring-like portion 4274 at a first end 4275 that is shaped to match an inner profile of the lip 34 of the nut 30 and an outer profile of the flange 44 of the post 40. As shown in FIG. 37, the nut 30 is a portion of a nut assembly 30' that includes a nut cap 38. The nut cap 38 can be press fit on the nut 30 such that the nut 30 and the nut cap 38 are configured to rotate together. In some aspects, the nut cap 38 is integrally formed with the nut 30 as a single monolithic structure. The nut cap 38 may include an outer surface that is knurled or otherwise modified to facilitate gripping by a user. In some aspects, the nut cap 38 may be surrounded by a rubber gripping portion.

The annular portion 4274 may include a small diameter portion 4276, a large diameter portion 4278, and a transition portion 4277 connecting the large diameter portion 4278 with the small diameter portion 4276. When installed with a connector, the small diameter portion 4276 may be disposed between a radially inward facing surface of the lip 34 of the nut 30 and a radially outward facing surface of the post 40, and the large diameter portion 4278 may be disposed between a radially inward facing surface of the nut 30 and a radially outward facing surface of the flange 44 of the post 40. Meanwhile, the transition portion 4277 is between the forward facing surface 35 of the lip 34 of the nut 30 and the rearward facing surface 45 of the flange 44.

As best illustrated in FIG. 36, the large diameter portion 4278 may include one or more resilient tabs 4279 that are cut from the large diameter portion 4278 and bend radially inward. For example, the tabs 4279 remain connected to the large diameter portion 4278 at their circumferential ends, but are separated from the large diameter portion 4278 along their circumferential lengths. The tabs 4279 are resilient such that when the large diameter portion 4278 is disposed between a radially inward facing surface of the nut 30 and a radially outward facing surface of the flange 44 of the post 40, the tabs 4279 provide a radial force against the radially outward facing surface of the flange 44, which urges the large diameter portion 4278 radially outward against the radially inward surface of the nut 30.

A hoop portion 4280 extends radially outward from an end of the large diameter portion 4278 that is opposite to the transition portion 4277. One or more fingers 4282 extend from the hoop portion 4280 in an axial direction away from the annular portion 4274. According to various aspects of the disclosure, each of the fingers 4282 includes two curved portions 4284, 4285 that curve radially inward from radially outermost portions 4286, 4287, 4288 of the fingers 4282. For example, in the illustrated embodiment, the first radially outermost portion 4286 extends from the hoop portion 4280 in the axial direction, and the first curved portion 4284 extends from the first outermost portion 4286 to the second radially outermost portion 4287. The second curved portion 4285 extends from the second outermost portion 4287 to the third radially outermost portion 4288.

Figure 38:
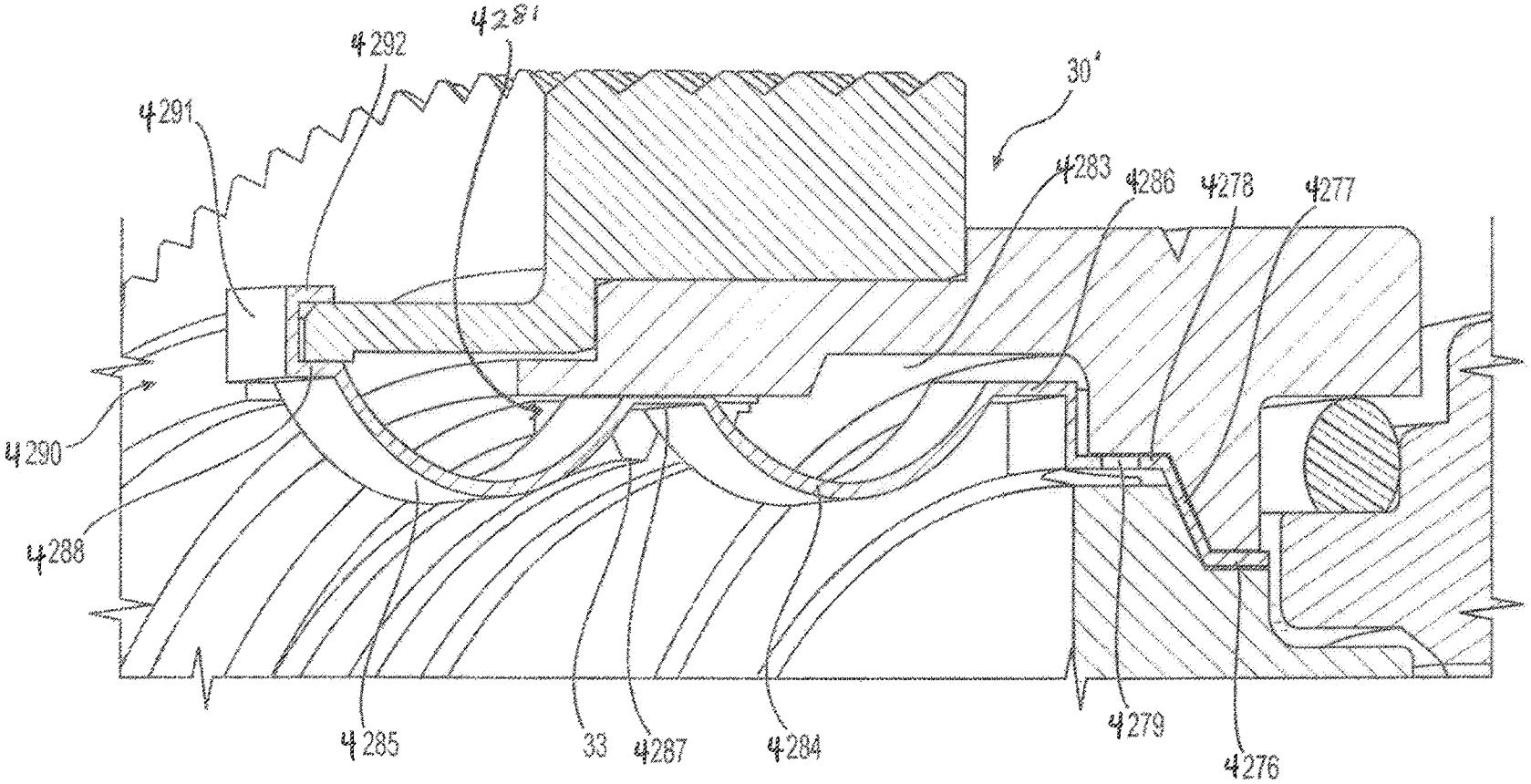
FIG. 38 is a side-front perspective cross-sectional view of the conductive insert of FIG. 35 coupled with a coaxial connector.

A second end 4289 of the conductive insert 4272 includes a securing portion 4290 formed by a radially extending portion 4291 and an axially extending portion 4292 that extends in the axial direction from the radially extending portion 291 toward the first end 4275 of the conductive insert 4272. With reference to FIGS. 37 and 38, the each finger 4282 is sized and arranged such that the third radially outermost portion 4288 can extend beyond the forward end 31 of the nut assembly 30'. The radially extending portion 4291 is structured and arranged to extend beyond an outer diameter of the forward end 31 of the nut assembly 30', and the axially extending portion 4292 wraps back over the forward end 31 of the nut assembly 30'.

When assembled with a connector, for example, the connector 100, the first end 4275 of the conductive insert 4272 is secured to the nut assembly 30' and the post 40 by the matching profiles of the conductive insert 4272, the nut assembly 30', and the post 40. The fingers 4282 are secured to the forward end 31 of the nut assembly 30' by the securing portion 4290. The nut assembly 30' includes one or more grooves 4281, for example, one or more axial grooves, that are each configured to receive the second radially outermost portion 4287 of one of the fingers 4282. The securing portion 4290 is configured to restrict axial movement of the fingers 4282 relative to the nut assembly 30', while each of the one or more grooves 4281 is configured to restrict rotation of one of the fingers 4282 relative to the nut assembly 30'. In some aspects, the one or more grooves 4281 may be circumferential grooves.

The first and second curved portions 4284, 4285 are structured and arranged to extend radially inward beyond threads of the internal threading 33 of the nut 30. Thus, when coupled with the threaded exterior surface 23 of the coaxial cable interface port 20, the first and second curved portions 4284, 4285 promote redundant contact, higher retention forces, and continuous grounding from the interface port 20 through to the post 40, even when loosely connected (i.e., not fully tightened) to the interface port 20.

Referring again to FIG. 37, the nut 30 may include a recess 4283 arranged to receive a portion of the fingers 4282 that may be pushed radially outward when the nut 30 is coupled with the interface port 20. Also, nut cap 38 may include an extension portion 48 that extends forward relative to the internal threading 33 of the nut 30 and relative to a forward end of the center conductor 18. As a result, the second curved portion 4285 can make contact with the interface port 20 before the center conductor 18 in order to create a ground from the interface port 20 through to the post 40 and thus limit burst that would otherwise occur upon insertion of the center conductor 18 into the interface port 20 in the absence of a ground.

Figure 39:
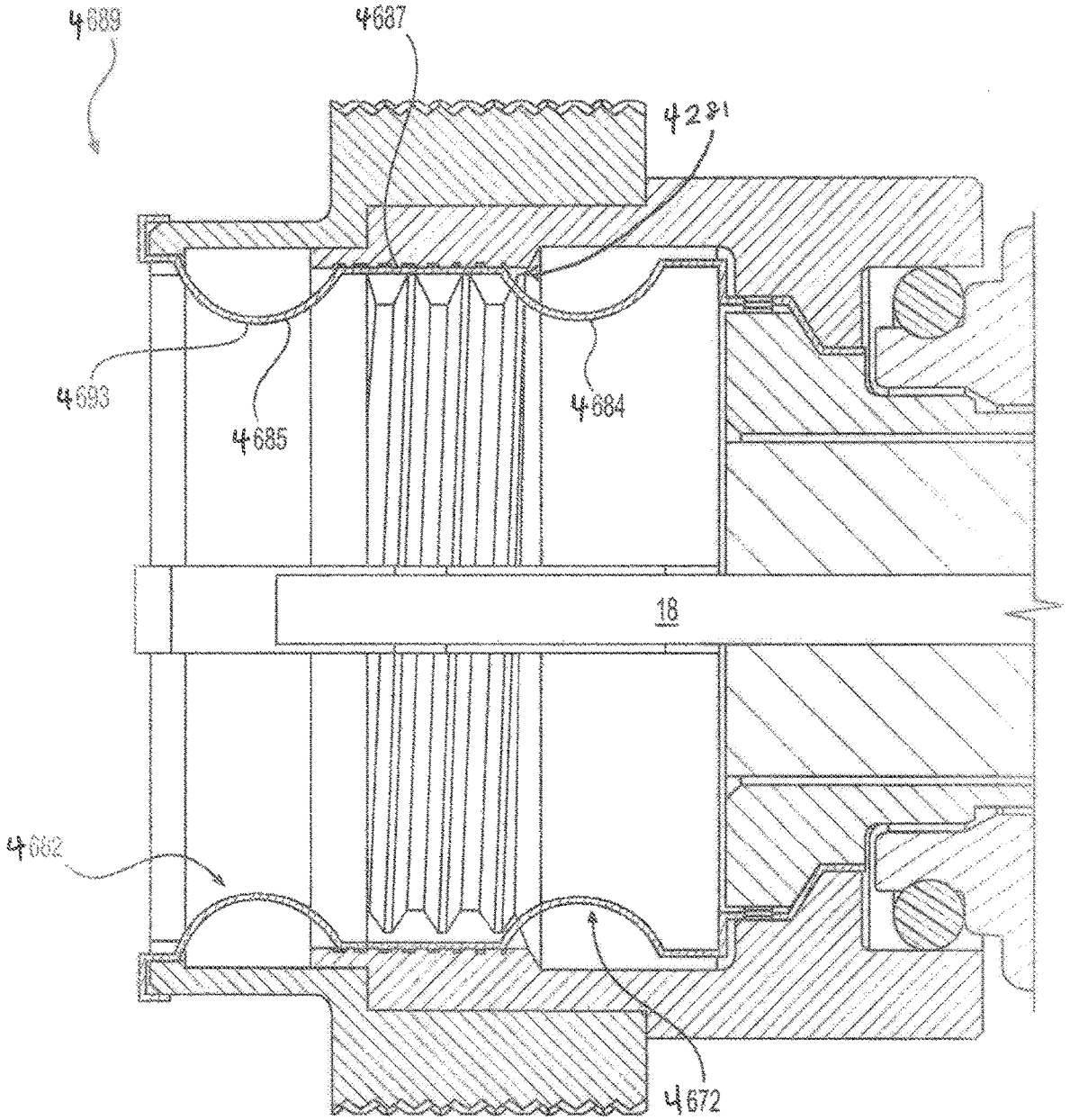
FIG. 39 is a side cross-sectional view of another exemplary conductive insert coupled with a coaxial connector.

Referring now to FIG. 39, a conductive insert 4672 similar to the conductive insert 4272 described above is illustrated. As shown in FIG. 39, the axial length of the second radially outermost portion 4687 of the fingers 4682 may be lengthened and the axial length of the first and second curved portions 4684, 4685 may be shortened such that a radially innermost portion 4693 of the second curved portion 4685 is moved toward the second end 4689 of the conductive insert 4672. As a result, the conductive insert 4672 insures that the second curved portion 4685 can make contact with the interface port 20 before the center conductor 18 in order to create a ground from the interface port 20 through to the post 40 and thus limit burst that would otherwise occur upon insertion of the center conductor 18 into the interface port 20 in the absence of a ground.

Figure 40:
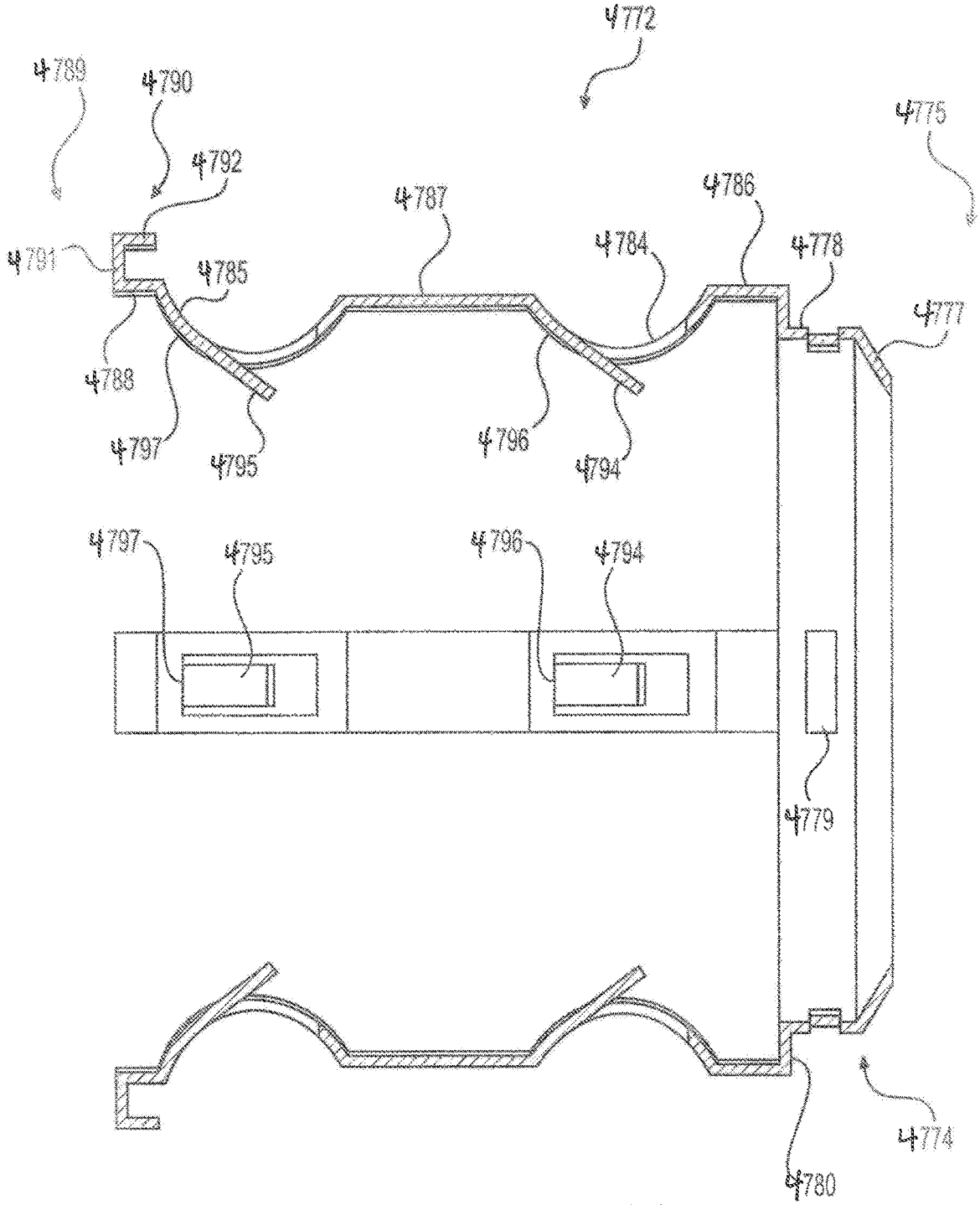
FIG. 40 is a side view of an exemplary conductive insert in accordance with various aspects of the disclosure.
Figure 41:
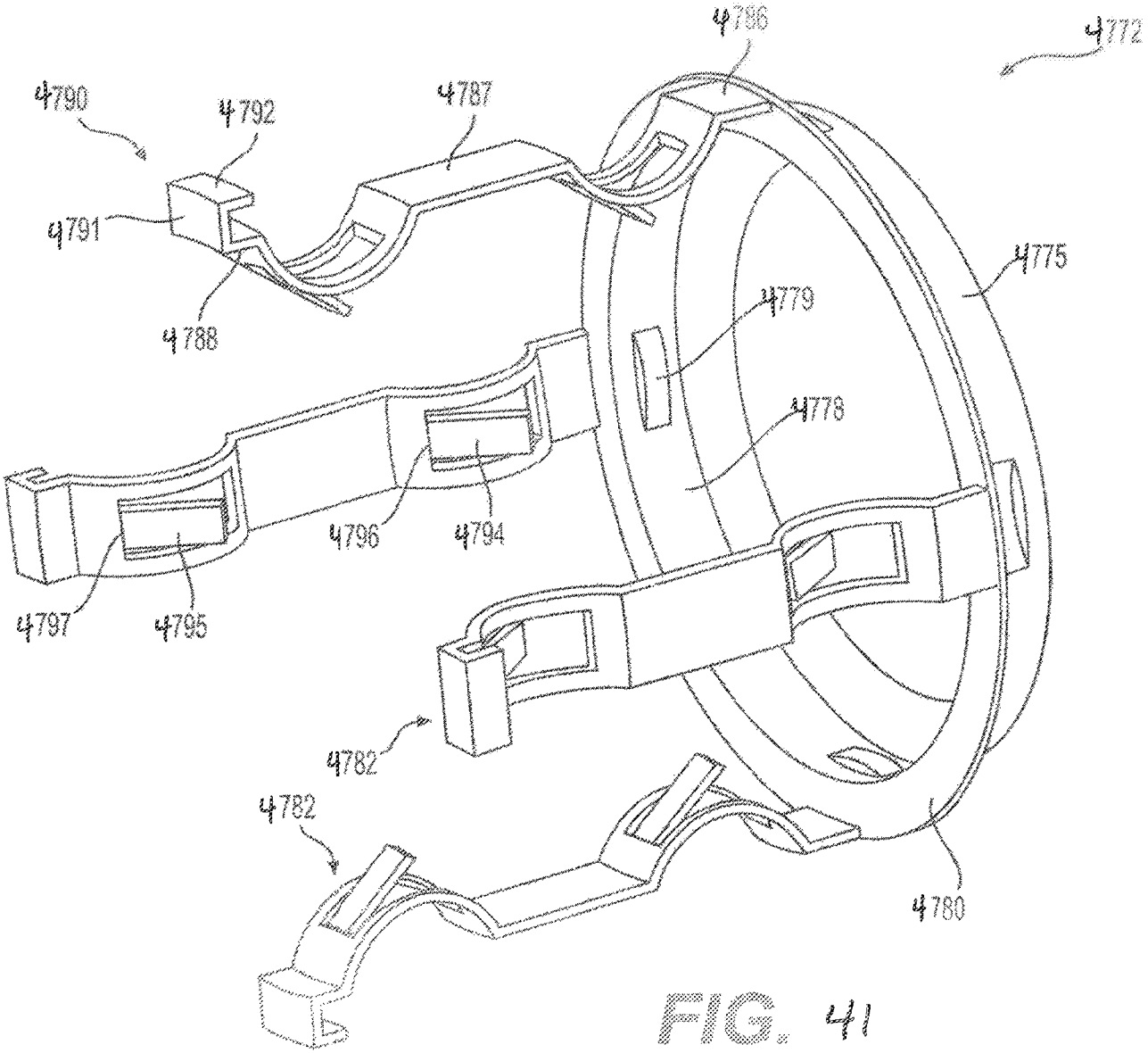
FIG. 41 is a side-front perspective view of the conductive insert of FIG. 40.
Figure 42:
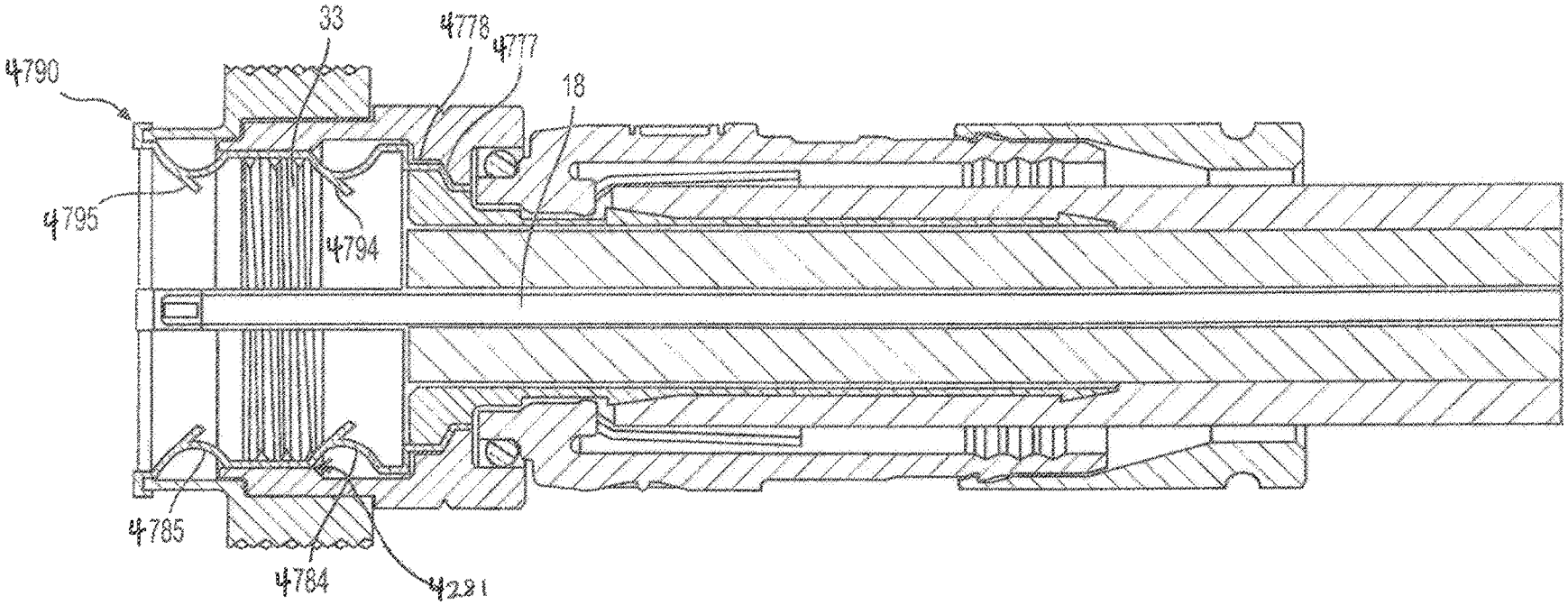
FIG. 42 is a side cross-sectional view of the conductive insert of FIG. 40 coupled with a coaxial connector.
Figure 42:
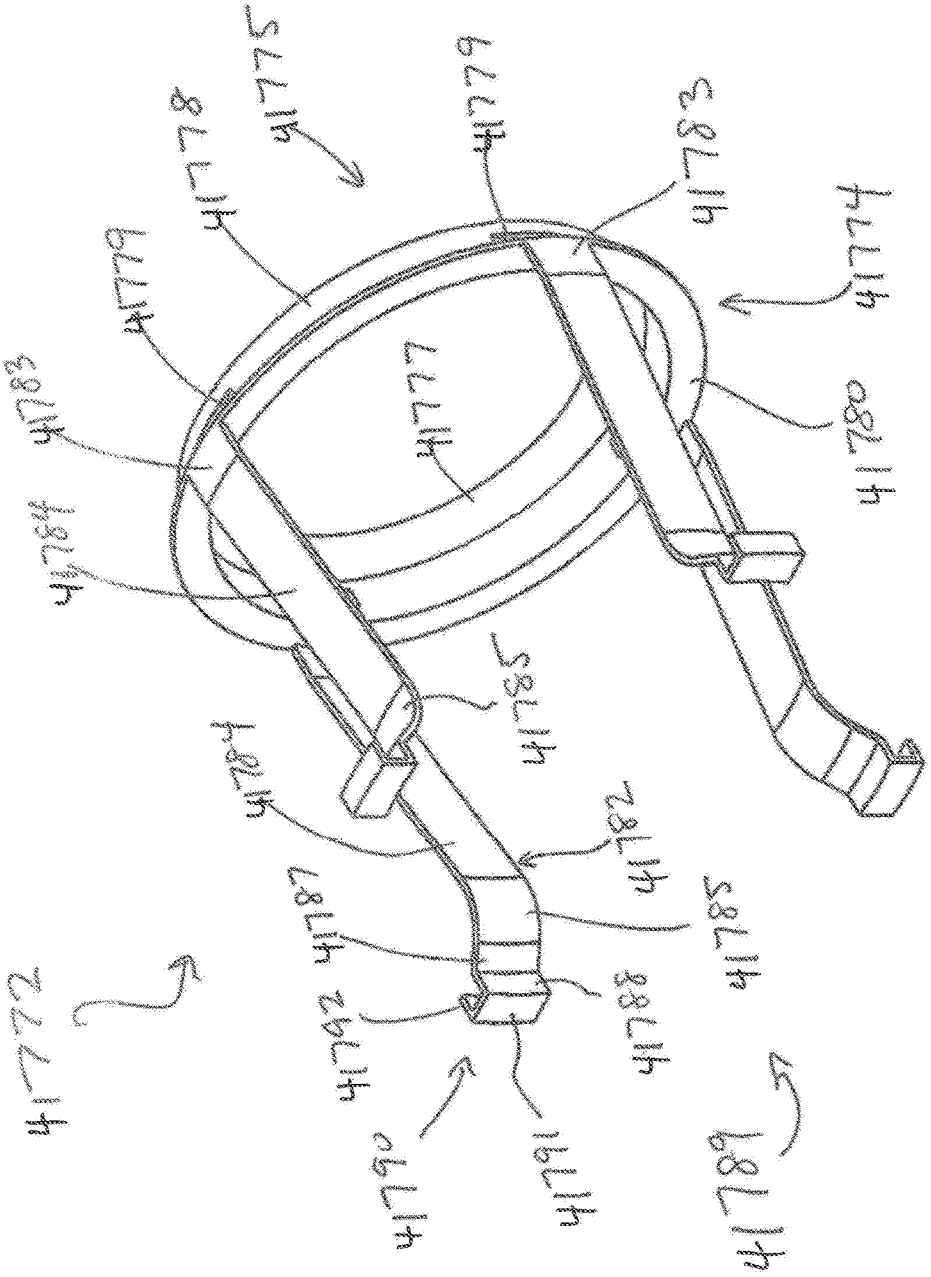

Referring now to FIGS. 40-42, another exemplary conductive insert 4772 in accordance with various aspects of the disclosure is illustrated. As shown in FIG. 40, the conductive insert 4772 may have an annular ring-like portion 4774 at a first end 4775 that is shaped to match an inner profile of the lip 34 of the nut 30 and an outer profile of the flange 44 of the post 40. For example, the annular portion 4774 may include a tapered portion 4777, and a large diameter portion 4778 that extends in an axial direction from an end of the tapered portion 4777 opposite to the first end 4775.

When installed with a connector, the large diameter portion 4778 may be disposed between a radially inward facing surface of the nut 30 and a radially outward facing surface of the flange 44 of the post 40. Meanwhile, the transition portion 4777 is between the forward facing surface 35 of the lip 34 of the nut 30 and the rearward facing surface 45 of the flange 44.

As best illustrated in FIG. 41, the large diameter portion 4778 may include one or more resilient tabs 4779 that are cut from the large diameter portion 4778 and bend radially inward. For example, the tabs 4779 remain connected to the large diameter portion 4778 at their circumferential ends, but are separated from the large diameter portion 4778 along their circumferential lengths. The tabs 4779 are resilient such that when the large diameter portion 4778 is disposed between a radially inward facing surface of the nut 30 and a radially outward facing surface of the flange 44 of the post 40, the tabs 4779 provide a radial force against the radially outward facing surface of the flange 44, which urges the large diameter portion 4778 radially outward against the radially inward surface of the nut 30.

A hoop portion 4780 extends radially outward from an end of the large diameter portion 4778 that is opposite to the transition portion 4777. One or more fingers 4782 extend from the hoop portion 4780 in an axial direction away from the annular portion 4774. According to various aspects of the disclosure, each of the fingers 4782 includes two curved portions 4784, 4785 that curve radially inward from radially outermost portions 4786, 4787, 4788 of the fingers 4782. For example, in the illustrated embodiment, the first radially outermost portion 4786 extends from the hoop portion 4780 in the axial direction, and the first curved portion 4784 extends from the first outermost portion 4786 to the second radially outermost portion 4787. The second curved portion 4785 extends from the second outermost portion 4787 to the third radially outermost portion 4788.

As shown in FIGS. 40-42, each of the first and second curved portions 4784, 4785 includes a tab 4794, 4795 that extends radially inward from the respective curved portions 4784, 4785. The tabs 4794, 4795 are punched out of the curved portions 4784, 4785 such that the tabs 4794, 4795 are cantilevered at a forward end 4796, 4797 thereof. The tabs 4794, 4795 are resilient such that when the tabs engage the interface port 20, tabs 4794, 4795 provide a radial force against an outer surface 23 of the port 20 and are pushed outward by the port 20, thereby ensuring contact with the threaded surface 23 of the port 20. Also, as the nut 30 is coupled to the port 20, the tabs 4794, 4795 engage the threaded outer surface 23 of the port 20 and make it difficult for the nut 30 to be pulled off the port 20, even when the threads 33 of the nut 30 have not yet engaged the threaded outer surface 23 of the port 20.

A second end 4789 of the conductive insert 4772 includes a securing portion 4790 formed by a radially extending portion 4791 and an axially extending portion 4792 that extends in the axial direction from the radially extending portion 4791 toward the first end 4775 of the conductive insert 4772. With reference to FIG. 9, each finger 4782 is sized and arranged such that the third radially outermost portion 4788 can extend beyond the forward end 31 of the nut assembly 30'. The radially extending portion 4791 is structured and arranged to extend beyond an outer diameter of the forward end 31 of the nut assembly 30', and the axially extending portion 4792 wraps back over the forward end 31 of the nut assembly 30'. The nut 30 may include a recess 4783 arranged to receive a portion of the fingers 4782 that may be pushed radially outward when the nut 30 is coupled with the interface port 20.

When assembled with a connector, for example, the connector 100, the first end 4775 of the conductive insert 4772 is secured to the nut assembly 30' and the post 40 by the matching profiles of the conductive insert 4772, the nut assembly 30', and the post 40. The fingers 4782 are secured to the forward end 31 of the nut assembly 30' by the securing portion 4790. The securing portion 4790 restricts axial movement of the fingers 4782 relative to the nut assembly 30', while the one or more grooves 4281 restrict rotation of the fingers 4782 relative to the nut assembly 30'.

The first and second curved portions 4784, 4785 are structured and arranged to extend radially inward beyond threads of the internal threading 33 of the nut 30. Thus, when coupled with the threaded exterior surface 23 of the coaxial cable interface port 20, the first and second curved portions 4784, 4785 promote redundant contact, higher retention forces, and continuous grounding from the interface port 20 through to the post 40, even when loosely connected (i.e., not fully tightened) to the interface port 20. As shown in FIGS. 40-42, the axial length of the second radially outermost portion 4787 of the fingers 4782 may be lengthened and the axial length of the first and second curved portions 4784, 4785 may be shortened such that a radially innermost portion 4793 of the second curved portion 4785 is moved toward the second end 4789 of the conductive insert 4772, similar to the embodiment discussed above with reference to FIG. 39. As a result, the conductive insert 4772 insures that the second curved portion 4785 can make contact with the interface port 20 before the center conductor 18 in order to create a ground from the interface port 20 through to the post 40 and thus limit burst that would otherwise occur upon insertion of the center conductor 18 into the interface port 20 in the absence of a ground.

Figure 44:
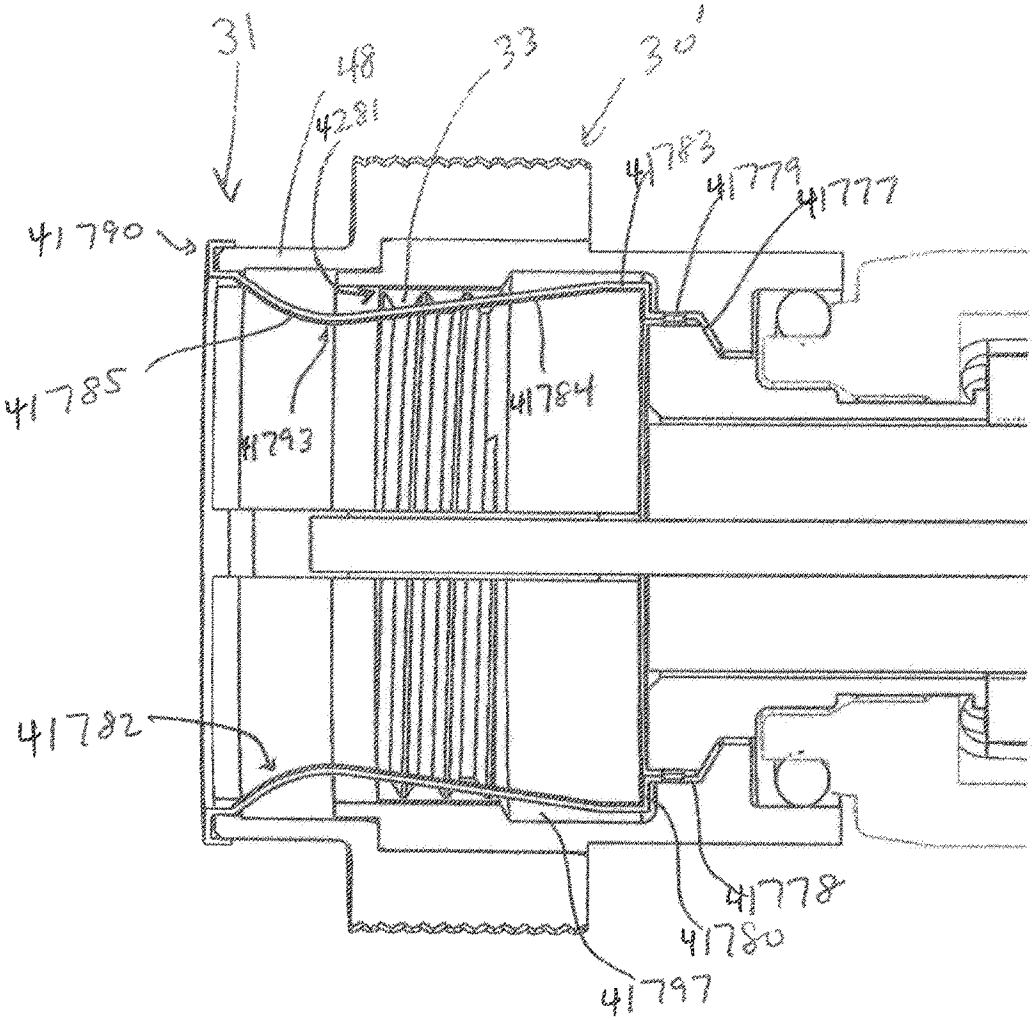
FIG. 44 is a side cross-sectional view of the conductive insert of FIG. 43 coupled with a coaxial connector.

Referring now to FIGS. 43 and 44, an exemplary conductive insert 41772 in accordance with various aspects of the disclosure is illustrated. As shown in FIG. 43, the conductive insert 41772 may have an annular ring-like portion 41774 at a first end 41775 that is shaped to match an inner profile of the lip 34 of the nut 30 and an outer profile of the flange 44 of the post 40. For example, the annular portion 41774 may include a tapered portion 41777, and a large diameter portion 41778 that extends in an axial direction from an end of the tapered portion 41777 opposite to the first end 41775.

When installed with a connector, the large diameter portion 41778 may be disposed between a radially inward facing surface of the nut 30 and a radially outward facing surface of the flange 44 of the post 40. Meanwhile, the transition portion 41777 is between the forward facing surface 35 of the lip 34 of the nut 30 and the rearward facing surface 45 of the flange 44. The large diameter portion 41778 may include one or more resilient tabs 41779 that are cut from the large diameter portion 41778 and bend radially inward. For example, the tabs 41779 remain connected to the large diameter portion 41778 at their circumferential ends, but are separated from the large diameter portion 41778 along their circumferential lengths. The tabs 41779 are resilient such that when the large diameter portion 41778 is disposed between a radially inward facing surface of the nut 30 and a radially outward facing surface of the flange 44 of the post 40, the tabs 41779 provide a radial force against the radially outward facing surface of the flange 44, which urges the large diameter portion 41778 radially outward against the radially inward surface of the nut 30.

A hoop member 41780 extends radially outward from an end of the large diameter portion 41778 that is opposite to the transition portion 41777. One or more fingers 41782 extend from the hoop member 41780 in an axial direction away from the annular portion 41774. According to various aspects of the disclosure, each of the fingers 41782 includes a first straight portion 41783 that extends axially from the hoop member 41780 to a second straight portion 41784. The second straight portion 41784 is angled radially inward relative to the first straight portion 41783 and extends from the first straight portion 41783 to a curved portion 41785 that bends radially outward toward a radially outermost portion 41788 of the respective finger 41782. In some aspects, the curved portion 41785 may be connected directly to the radially outermost portion 41788, while in other aspects, the curved portion 41785 may be connected to the radially outermost portion 41788 by a third straight portion 41787.

A second end 41789 of the conductive insert 41772 includes a securing portion 41790 formed by a radially extending portion 41791 and an axially extending portion 41792 that extends in the axial direction from the radially extending portion 41791 toward the first end 41775 of the conductive insert 41772. With reference to FIG. 44, each finger 41782 is sized and arranged such that the radially outermost portion 41788 can extend beyond the forward end 31 of the nut 30. The radially extending portion 41791 is structured and arranged to extend beyond an outer diameter of the forward end 31 of the nut 30, and the axially extending portion 41792 wraps back over the forward end 31 of the nut 30. The nut 30 may include a recess 41797 arranged to receive a portion of the fingers 41782 that may be pushed radially outward then the nut 30 is coupled with the interface port 20.

When assembled with a connector, for example, the connector 100, the first end 41775 of the conductive insert 41772 is secured to the nut assembly 30' and the post 40 by the matching profiles of the conductive insert 41772, the nut assembly 30', and the post 40. The fingers 41782 are secured to the forward end 31 of the nut assembly 30' by the securing portion 41790. The securing portion 41790 restricts axial motion of the fingers 41782 relative to the nut assembly 30', while the one or more grooves 281 restrict rotation of the fingers 41782 relative to the nut assembly 30'.

As illustrated in FIG. 44, the second straight portion 41784 and the curved portion 41785 are structured and arranged to extend radially inward beyond threads of the internal threading 33 of the nut 30. Also, the nut 30 may include an extension portion 48 that extends forward relative to the internal threading 33 of the nut 30 and relative to a forward end of the center conductor 18. Thus, a radially innermost portion 41793 of the second curved portion 41785 is forward of the internal threading 33 of the nut. As a result, the curved portion 41785 can make contact with the interface port 20 before the center conductor 18 in order to create a ground from the interface port 20 through to the post 40 and thus limit burst that would otherwise occur upon insertion of the center conductor 18 into the interface port 20 in the absence of a ground. Thus, when coupled with the threaded exterior surface 23 of the coaxial cable interface port 20, the second straight portion 41784 and the curved portion 41785 promote redundant contact, higher retention forces, and continuous grounding from the interface port 20 through to the post 40, even when loosely connected (i.e., not fully tightened) to the interface port 20. As a result, the conductive insert 41772 insures that the curved portion 41785 can make contact with the interface port 20 before the center conductor 18 when the connector 100 is coupled with the interface port 20 in order to create a ground from the interface port 20 through to the post 40 and thus limit burst that would otherwise occur upon insertion of the center conductor 18 into the interface port 20 in the absence of a ground.

Figure 45:
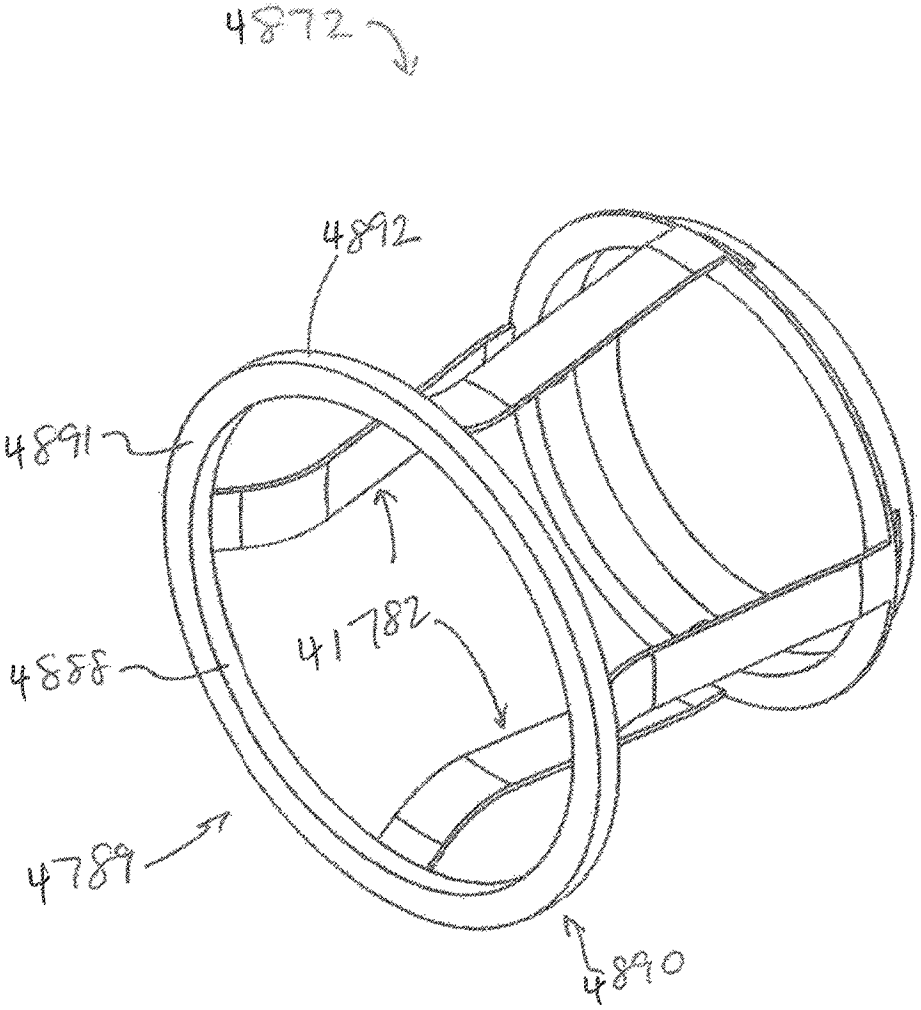
FIG. 45 is a side-front perspective view of another exemplary conductive insert in accordance with various aspects of the disclosure.
Figure 46:
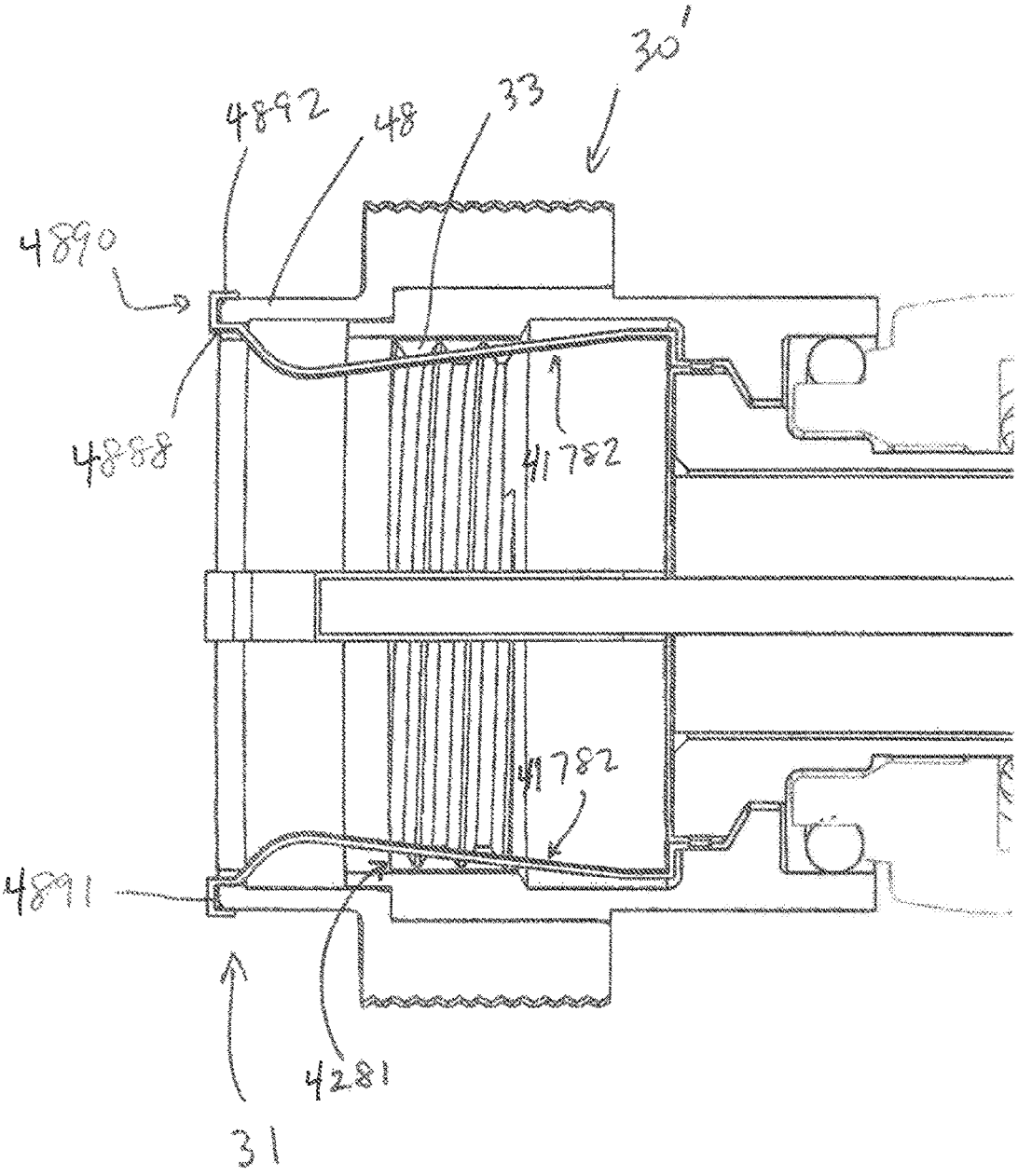
FIG. 46 is a side cross-sectional view of the conductive insert of FIG. 45 coupled with a coaxial connector.

Referring now to FIGS. 45 and 46, an exemplary conductive insert 4872 in accordance with various aspects of the disclosure is illustrated. The conductive insert 4872 is substantially the same as the conductive insert 41772 described above, except for the securing portion 4890 at the second end 41789 of the conductive insert 4872. The securing portion 4890 is formed by an annular hoop portion 4891 and an annular ring portion 4892. The annular hoop portion 4891 extends from a radially outermost ring portion 4888 and has a radial length that is structured and arranged to extend beyond an outer diameter of the forward end 31 of the nut assembly 30'. The radially outermost ring portion 4888 is coupled to each of the fingers 41782. The annular ring portion 4892 extends axially from the annular hoop portion 4891 so as to wrap back over the forward end 31 of the nut assembly 30'. The securing portion 4890 restricts axial motion of the fingers 41782 relative to the nut assembly 30', while the one or more grooves 4281 restrict rotation of the fingers 4782 relative to the nut assembly 30'.

Figures 47, 48, 49:
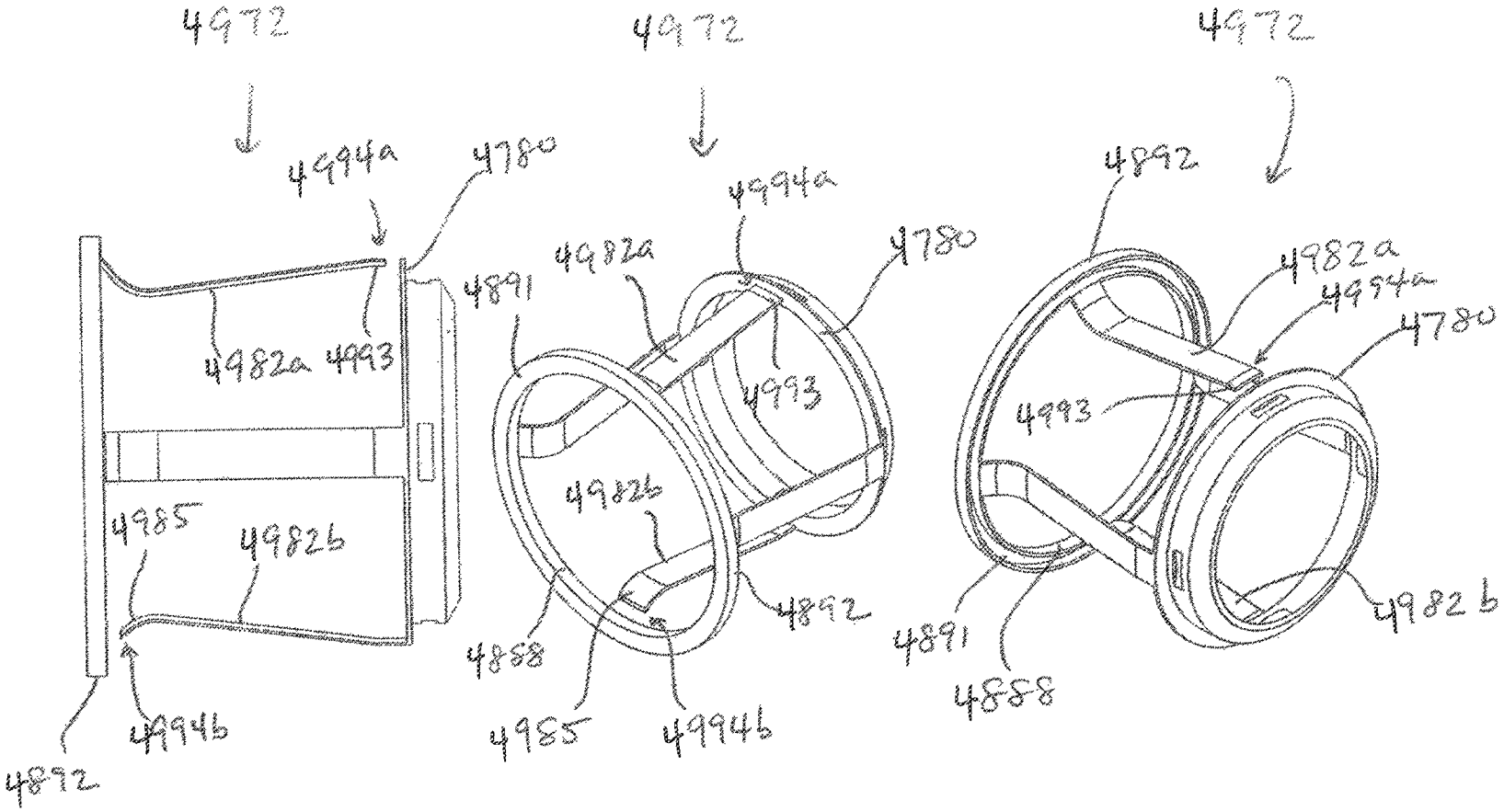
FIG. 47 is a side view of another exemplary conductive insert in accordance with various aspects of the disclosure.
FIG. 48 is a side-front perspective view of the conductive insert of FIG. 47.
FIG. 49 is a side-rear perspective view of the conductive insert of FIG. 47.

Referring now to FIGS. 47-49, an exemplary conductive insert 4972 in accordance with various aspects of the disclosure is illustrated. The conductive insert 4972 is substantially the same as the conductive insert 4872 described above, except that one or more of the fingers 4982*a*, 4982*b* may have a free end 4994*a*, 4994*b* so as to be cantilevered. For example, one of the fingers 4982*a* may have a free end 4994*a* defined by a first straight portion 4983 that is spaced from and not directly connected with the hoop member 4780, and another one of the fingers 4982*b* may have a free end 4994*b* defined by a curved portion 4985 that is spaced from and not directly connected with the radially outermost ring portion 4888. These cantilevered fingers 4982*a*, 4982*b* may provide additional flexibility to facilitate coupling of the nut 30 with the interface port 20.

It should be understood that when a connector is being installed to a mating port and the center conductor makes contact with the ground path of the port, there may be a signal burst that can make its way into the network and cause speed issues and other network issues. However, in any of the aforementioned connectors, if the nut and/or the grounding member is configured with an axial length such that the grounding member and/or nut can make contact with the external threads of the port before the center conductor makes contact with the port, the signal burst can be prevented, and the signal from the center conductor will be transferred to the interface port.

The accompanying figures illustrate various exemplary embodiments of coaxial cable connectors that provide improved grounding between the coaxial cable, the connector, and the coaxial cable connector interface port. It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A nut assembly for a coaxial cable connector, the nut assembly comprising:

a nut configured to engage an interface port;

a cap encircling a portion of the nut;

wherein the nut includes an internal threaded portion spaced from a forward end of the nut in an axial direction, the internal threaded portion being configured to engage external threads of the interface port;

wherein the nut includes a plurality of resilient fingers extending from the internal threaded portion of the nut to the forward end of the nut, the resilient fingers being configured to define an inner diameter smaller than an outer diameter of the interface port;

wherein each of the resilient fingers is configured to taper radially inward from a first diameter at a rearward end portion of the resilient finger to a bend point having a second diameter, smaller than the first diameter, at a middle portion of the resilient finger and to flare radially outward from the second diameter at the bend point to the forward end of the nut;

wherein the forward end of the nut includes a tooth extending radially inward and having a curved front end and a flat angle rear end, the flat angle rear end facing rearward and radially inward relative so as to form an acute angle relative to the axial direction;

wherein the flat angle rear end of the tooth is configured to contact a surface of a thread of the external threads of the interface port so as to provide a first contact point between the nut and the external threads of the interface port when the nut is coupled to the interface port;

wherein the bend point is configured to provide a second contact point between the nut and the external threads of the interface port when the nut is coupled to the interface port;

wherein the internal threaded portion of the nut and the external threads of the interface port are configured to provide a retention force between the nut and the interface port when the internal threaded portion is threadedly coupled to the external threads;

wherein the first contact point and the second contact point are configured to increase the retention force between the nut and the interface port when the internal threaded portion is threadedly coupled to the external threads;

wherein the cap is configured to inhibit radially outward deflection of the resilient fingers, thereby increasing a spring force of the resilient fingers and the retention force between the nut and the interface port; and wherein the tooth and the bend point are configured to provide ground continuity between the nut and the interface port before the internal threaded portion of the nut is coupled with the external threads of the interface port.

2. A nut assembly for a coaxial cable connector, the nut assembly comprising:

a nut configured to engage an interface port;

a cap encircling a portion of the nut;

wherein the nut includes an internal threaded portion configured to engage external threads of the interface port;

wherein the nut includes at least one resilient finger extending in an axial direction from the internal threaded portion of the nut toward a forward end of the nut;

wherein the forward end of the nut includes a tooth extending radially inward;

wherein the tooth is configured to contact a surface of a thread of the external threads of the interface port when the nut is coupled to the interface port;

wherein the internal threaded portion of the nut and the external threads of the interface port are configured to provide a retention force between the nut and the interface port when the internal threaded portion is threadedly coupled to the external threads;

wherein the forward end of the cap includes a lip extending radially inward and configured to engage an outer surface of the at least one resilient finger opposite to the tooth; and wherein the tooth is configured to provide ground continuity between the nut and the interface port before the internal threaded portion of the nut is coupled with the external threads of the interface port.

3. The nut assembly of claim 2, wherein the resilient finger is configured to taper radially inward from a first diameter at a rearward end portion of the resilient finger to a bend point having a second diameter, smaller than the first diameter, at a middle portion of the resilient finger and to flare radially outward from the second diameter at the bend point to the forward end of the nut.

4. The nut assembly of claim 3, wherein the bend point is configured to provide ground continuity between the nut and the interface port before the internal threaded portion of the nut is coupled with the external threads of the interface port.

5. The nut assembly of claim 3, wherein the tooth and the bend point are configured to increase the retention force between the nut and the interface port when the internal threaded portion is threadedly coupled to the external threads.

6. The nut assembly of claim 3, wherein the cap is configured to inhibit radially outward deflection of the resilient finger, thereby increasing a spring force of the resilient finger and the retention force between the nut and the interface port.

7. The nut assembly of claim 3, wherein the at least one resilient finger includes a plurality of resilient fingers, the plurality of resilient fingers being configured to define an inner diameter smaller than an outer diameter of the interface port.

8. The nut assembly of claim 3, wherein the internal threaded portion is spaced from the forward end of the nut in the axial direction.

9. The nut assembly of claim 3, wherein the tooth has a curved front end and a flat angle rear end, the flat angle rear end facing rearward and radially inward relative so as to form an acute angle relative to the axial direction.

10. The nut assembly of claim 9, wherein the flat angle rear end of the tooth is configured to contact a surface of a thread of the external threads of the interface port so as to provide a first contact point between the nut and the external threads of the interface port when the nut is coupled to the interface port.

11. A nut assembly for a coaxial cable connector, the nut assembly comprising:

a nut configured to engage an interface port;

a cap encircling a portion of the nut;

wherein the nut includes an internal threaded portion configured to engage external threads of the interface port;

wherein the nut includes at least one resilient finger extending in an axial direction from the internal threaded portion of the nut toward a forward end of the nut;

wherein the resilient finger is configured to taper radially inward from a first diameter at a rearward end portion of the resilient finger to a bend point having a second diameter, smaller than the first diameter, at a middle portion of the resilient finger and to flare radially outward from the second diameter at the bend point to the forward end of the nut;

wherein the internal threaded portion of the nut and the external threads of the interface port are configured to provide a retention force between the nut and the interface port when the internal threaded portion is threadedly coupled to the external threads;

wherein the forward end of the cap includes a lip extending radially inward and configured to engage an outer surface of the at least one resilient finger; and wherein the bend point is configured to provide ground continuity between the nut and the interface port before the internal threaded portion of the nut is coupled with the external threads of the interface port.

12. The nut assembly of claim 11, wherein the cap is configured to inhibit radially outward deflection of the resilient fingers, thereby increasing a spring force of the resilient fingers and the retention force between the nut and the interface port.

13. The nut assembly of claim 11, wherein the at least one resilient finger includes a plurality of resilient fingers, the plurality of resilient fingers being configured to define an inner diameter smaller than an outer diameter of the interface port.

14. The nut assembly of claim 11, wherein the internal threaded portion is spaced from a forward end of the nut in an axial direction.

15. The nut assembly of claim 11, wherein the forward end of the nut includes a tooth extending radially inward.

16. The nut assembly of claim 15, wherein the tooth is configured to contact a surface of a thread of the external threads of the interface port when the nut is coupled to the interface port.

17. The nut assembly of claim 15, wherein the tooth is configured to provide ground continuity between the nut and the interface port before the internal threaded portion of the nut is coupled with the external threads of the interface port.

18. The nut assembly of claim 15, wherein the tooth and the bend point are configured to increase the retention force between the nut and the interface port when the internal threaded portion is threadedly coupled to the external threads.

19. The nut assembly of claim 11, wherein the forward end of the nut includes a tooth extending radially inward and having a curved front end and a flat angle rear end, the flat angle rear end facing rearward and radially inward relative so as to form an acute angle relative to the axial direction.

20. The nut assembly of claim 19, wherein the flat angle rear end of the tooth is configured to contact a surface of a thread of the external threads of the interface port so as to provide a first contact point between the nut and the external threads of the interface port when the nut is coupled to the interface port.

* * * * *